US007568785B2

(12) United States Patent
Deguchi et al.

(10) Patent No.: US 7,568,785 B2
(45) Date of Patent: Aug. 4, 2009

(54) NOZZLE PLATE AND METHOD OF MANUFACTURING THE SAME

(75) Inventors: Haruhiko Deguchi, Tenri (JP); Chiyoshi Yoshioka, Nara (JP); Yasuhiro Sakamoto, Matsubara (JP); Hidetsugu Kawai, Kashiba (JP); Shigeaki Kakiwaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 185 days.

(21) Appl. No.: 10/562,080

(22) PCT Filed: Apr. 28, 2004

(86) PCT No.: PCT/JP2004/006226

§ 371 (c)(1),
(2), (4) Date: Dec. 22, 2005

(87) PCT Pub. No.: WO2005/000590

PCT Pub. Date: Jan. 6, 2005

(65) Prior Publication Data

US 2006/0176338 A1 Aug. 10, 2006

(30) Foreign Application Priority Data

Jun. 27, 2003 (JP) ..... 2003-185637
Aug. 29, 2003 (JP) ..... 2003-209835

(51) Int. Cl.
*B41J 2/14* (2006.01)
*B41J 2/16* (2006.01)

(52) U.S. Cl. ..... 347/48; 347/56

(58) Field of Classification Search ..... 347/20, 347/44–47, 63
See application file for complete search history.

(56) References Cited

U.S. PATENT DOCUMENTS 5,589,083 A 12/1996 Ahn et al.
5,646,662 A 7/1997 Kitahara
6,054,011 A * 4/2000 Radke et al. ..... 156/326
6,290,331 B1 * 9/2001 Agarwal et al. ..... 347/47

(Continued)

FOREIGN PATENT DOCUMENTS

JP 63-001551 1/1988

(Continued)

OTHER PUBLICATIONS

Applicant's English language discussion of JP 9-216368.

*Primary Examiner*—Juanita D Stephens
(74) *Attorney, Agent, or Firm*—Edwards Angell Palmer & Dodge LLP; David G. Conlin; David A. Tucker

(57) ABSTRACT

A nozzle plate (8) of the present invention is arranged such that, between (i) a first nozzle layer (1) having a first nozzle hole (orifice) (11*a*) that discharges a liquid substance and (ii) a second nozzle layer (2) having a second nozzle hole (11*b*) that is connected to the first nozzle hole (11*a*) and receives the liquid substance, a blocking layer (3) having a higher resistance to etching than the first nozzle layer (1) is provided. In this nozzle plate (8), the blocking layer (3) is locally formed around a connecting part at which the first nozzle hole (11*a*) is connected to the second nozzle hole (11*b*). On account of this, the first nozzle hole of the nozzle plate is highly precisely formed, and the deformation of the nozzle plate, e.g. warpage, hardly occurs.

29 Claims, 19 Drawing Sheets

U.S. PATENT DOCUMENTS

| | | | | |
|---|---|---|---|---|
| 6,368,515 | B1 * | 4/2002 | Kaminishi et al. | 216/27 |
| 6,880,916 | B2 * | 4/2005 | Kim | 347/47 |
| 2001/0017639 | A1 * | 8/2001 | Noguchi et al. | 347/45 |
| 2001/0028378 | A1 | 10/2001 | Lee et al. | |
| 2004/0084403 | A1 | 5/2004 | Ohkuma | |
| 2004/0090483 | A1 * | 5/2004 | Gue et al. | 347/20 |

FOREIGN PATENT DOCUMENTS

| | | |
|---|---|---|
| JP | 63-145040 | 6/1988 |
| JP | 63-256454 | 10/1988 |
| JP | 03-239559 | 10/1991 |
| JP | 05-177834 | 7/1993 |
| JP | 06-134994 | 5/1994 |
| JP | 06-206315 | 7/1994 |
| JP | 07-201806 | 8/1995 |
| JP | 09-216368 | 8/1997 |
| JP | 2000-185407 | 7/2000 |
| JP | 2000-198206 | 7/2000 |
| JP | 2000-218792 | 8/2000 |
| JP | 2001-018399 | 1/2001 |
| JP | 2001-239671 | 9/2001 |
| JP | 2001-277502 | 10/2001 |
| JP | 2001-287369 | 10/2001 |
| JP | 2001-301177 | 10/2001 |
| JP | 2003-094665 | 4/2003 |
| JP | 2004-034533 | 2/2004 |
| KR | 10-84239 A | 9/2001 |

* cited by examiner

NOZZLE PLATE AND METHOD OF MANUFACTURING THE SAME

TECHNICAL FIELD

The present invention relates to the structure of a nozzle plate of a minute dot formation device that forms a minute pattern by minute dots, and also relates to a method of manufacturing the nozzle plate.

BACKGROUND ART

Inkjet printers have conventionally used as machines for carrying out printing on paper. In the meanwhile, focusing attention on the versatility and cost-effectiveness of the ink jet printers, it has been attempted to use an inkjet printer for the processes that have conventionally been done by photolithography, e.g. the formation of a miniature pattern such as a color filter of a liquid crystal display device, and the formation of a conductor pattern on a print circuit board. For this reason, it has become popular to develop a minute dot formation device that can form a highly-precise minute pattern by directly forming minute ink dots on a drawing object (e.g. a print circuit board and a color filer for liquid crystal display).

Such a minute dot formation device requires a nozzle plate having excellent discharging characteristics, e.g. stable discharge and highly precise landing of droplets.

The following will describe the structure and manufacturing method of a conventional nozzle plate. Japanese Laid-Open Patent Application No. 9-216368 (published on Aug. 19, 1997) discloses a technology to form a nozzle plate by dry etching and wet etching. FIGS. 19(*a*) and 19(*b*) illustrate the nozzle plate (hereinafter, conventional nozzle plate) of the above-described Patent Document 1.

The conventional nozzle plate is made up of an SOI (Silicon on Insulator) substrate 21. As shown in FIGS. 19(*a*) and 19(*b*), the SOI substrate 21 is arranged such that an $SiO_2$ layer 26 which is an etching stop layer covers the entirety of a supporting silicon layer 25, and a silicon layer 24 which is an active layer is further provided on the $SiO_2$ layer 26. The silicon layer 24 has an orifice 22, the silicon layer 25 has a tapered portion 23, and the orifice 22 is connected with the tapered portion 23.

The conventional method of manufacturing the nozzle plate (hereinafter, conventional method) is arranged as follows. First, the surface of the silicon layer 24 which is an active layer is oxidized, so that an oxidized film (not illustrated) is formed. Then a predetermined pattern is formed on the oxidized film 28. Using this pattern as a mask, dry etching is performed. At this time, the etching does not go beyond an $SiO_2$ layer 26 that functions as an etching stop layer. As a result, the orifice 22 is formed. Subsequently, the surface of the silicon layer 25 which is a supporting layer is oxidized, so that an oxidized film (not illustrated) is formed. A predetermined pattern is formed on this oxidized film. Using the pattern as a mask, dry etching is performed in an undercut manner so that the etching is stopped at the $SiO_2$ layer 26. As a result, the tapered portion 23 is formed. Finally, the SiO2 layer 26 and the surface oxidized film, which are between the orifice 22 and tapered portion 23, are etched away using a fluoric etchant.

The arrangement above, however, has the following problems.

Since the $SiO_2$ layer 26 which is the etching stop layer is entirely formed between the silicon layers 24 and 25, the nozzle plate may be greatly warped by the stress due to the difference of linear expansion coefficients between silicon and $SiO_2$. The warpage of the nozzle plate induces not only the decrease in precision of the joining between the nozzle plate and an inkjet head but also the decrease in the structural reliability of the nozzle plate.

In the conventional nozzle plate, sufficient rigidity of the silicon layers 24 and 25 is required to avoid the aforesaid warpage of the nozzle plate due to the difference of linear expansion coefficients between silicon and $SiO_2$. Therefore, it is unavoidable to increase the thickness of the silicon layer 24 where the orifice 22 is formed and the thickness of the silicon layer 25 where the tapered portion 3 is formed (silicon layer 24 is 15 μm thick and SI layer 25 is 100 μm thick).

This increases an amount of silicon to be etched away at the time of the formation of the orifice 22 and the tapered portion 23, thereby increasing an error in the etching. That is, the precision in the formation of the nozzle (i.e. orifice 22 and tapered portion 23), through which droplets flow, is decreased. On this point, Patent Document 1 describes that the processing accuracy of the nozzle is not more than ±1 micrometer, as compared to the planned sizes. This processing accuracy is not sufficient for minute dot formation devices.

The present invention was done to solve the above-described problems, and the objective of the present invention is to create a nozzle plate that has a highly-precise first nozzle hole and is not liable to deformations such as warpage, and the objective is also to create a manufacturing method of the nozzle plate.

DISCLOSURE OF INVENTION

To achieve the objective above, the nozzle plate of the present invention comprises: a first nozzle layer having a first nozzle hole through which a liquid substance is discharged; a second nozzle layer having a second nozzle hole that is connected to the first nozzle hole and receives the liquid substance; and a blocking layer which is provided between the first nozzle layer and the second nozzle layer and has a higher resistance to etching than the first nozzle layer, the blocking layer being locally formed around a connecting part at which the first nozzle hole is connected to the second nozzle hole.

The first nozzle hole is provided for discharging the liquid substance supplied to the second nozzle hole. The liquid substance is not only liquids but also substances whose viscosity allows them to be discharged through the first nozzle hole.

The blocking layer is formed around the connecting part at which the first nozzle hole is connected to the second nozzle hole. At the time of etching the first nozzle hole, the blocking layer functions as a mask that determines the shape of the opening of the first nozzle hole.

According to the arrangement above, the blocking layer is locally formed so that the area of contact between the first nozzle layer and the blocking layer or between the second nozzle layer and the blocking layer is reduced. This makes it possible to significantly restrain the stress due to the difference of linear expansion coefficients between the first and second nozzle layers and the blocking layer, and hence it is possible to prevent the nozzle plate from being greatly warped. Therefore, it is possible to improve the precision of the connection between the nozzle plate and, for instance, an inkjet head, and the structural reliability of the nozzle plate is also improved.

Furthermore, since the occurrence of the stress is restrained, the rigidity required for the first and second nozzle layers is not high, and hence the thickness of the first nozzle layer and the thickness of the second nozzle layer are reduced.

In other words, an amount of the layer to be etched away for forming the first and second nozzle holes is reduced, so that the formation error is reduced. It is therefore possible to form the first and second nozzle holes with high precision.

Moreover, since the thickness of the first nozzle layer and the thickness of the second nozzle layer are reduced, the sizes of the first and second nozzle holes are reduced. This makes it possible to increase the concentration of the first nozzle holes, thereby improving the resolution of a drawn image.

In addition to the above, the nozzle plate of the present invention is preferably arranged such that the blocking layer is larger in size than the second nozzle hole at the connecting part.

In a case where the outer shape of the locally-formed blocking layer is minimum in size, the outer shape of the blocking layer is identical with the outer shape of the second nozzle hole, at the aforesaid connecting part. This is because, if, at the connecting part, the outer shape of the blocking layer is smaller than the outer shape of the second nozzle hole to be formed, the etching of the second nozzle hole goes beyond the blocking layer and the first nozzle layer is etched from the surrounding area of the blocking layer.

When the outer shape of the blocking layer is larger than the minimum size (i.e. the size of the second nozzle hole at the connecting part) as in the arrangement above, the blocking layer functions as the stopper at the time of the etching of the second nozzle hole. It is therefore possible to surely stop the etching of the second nozzle hole, by the blocking layer.

Also, thanks to the arrangement above, the second nozzle hole does not penetrate the blocking layer at the time of etching of the second nozzle layer. On this account, the thickness of the first nozzle layer is uniform, and there is no variation in the flow resistance of the liquid substance.

In addition to the above, the nozzle plate of the present invention is preferably arranged such that the first nozzle hole includes a part that penetrates the first nozzle layer and a part that penetrates the blocking layer.

According to the arrangement above, it is possible to form a penetrating part in the first nozzle, by using the blocking layer as an etching mask. The penetrating part thus formed and the penetrating part of the blocking layer are identical with each other in terms of diameter. Therefore the first nozzle hole has a high precision in terms of shape.

In addition to the above, the nozzle plate of the present invention is preferably arranged such that the second nozzle hole has a tapered shape so as to be narrowed at the connecting part.

According to this arrangement, since the second nozzle hole is taper-shaped, the occurrence of the turbulent liquid flow is restrained inside the second nozzle hole. The stability of the discharge of droplets is therefore improved.

In addition to the above, the nozzle plate of the present invention is preferably arranged such that the first nozzle layer and the second nozzle layer are made of a polymeric organic material, and the blocking layer is made of at least one material selected from the group consisting of a metal material, an inorganic oxide material, and an inorganic nitride material.

According to the arrangement above, the first nozzle layer and the second nozzle layer are easily processed by dry etching using a plasma including oxygen. Meanwhile, the blocking layer is rarely etched because the blocking layer is highly resistant to the dry etching using a plasma including oxygen. It is therefore possible to highly precisely form the first and second nozzle holes.

Since the second nozzle hole in the second nozzle layer does not penetrate the blocking layer, the thickness of the first nozzle layer is uniform, and there is no variation in the flow resistance of the liquid substance.

In addition to the above, the nozzle plate of the present invention is preferably arranged such that the first nozzle layer and the second nozzle layer are made of polyimide resin, and the blocking layer is made of at least one material selected from the group consisting of Ti, Al, Au, Pt, Ta, W, Nb, $SiO_2$, $Al_2O_3$, and SiN.

According to the arrangement above, the first nozzle layer and the second nozzle layer are easily processed by dry etching using a plasma including oxygen. Meanwhile, the blocking layer is rarely etched because the blocking layer is highly resistant to the dry etching using a plasma including oxygen. It is therefore possible to highly precisely form the first and second nozzle holes.

Since the second nozzle hole in the second nozzle layer does not penetrate the blocking layer, the thickness of the first nozzle layer is uniform, and there is no variation in the flow resistance of the liquid substance.

In addition to the above, the nozzle plate of the present invention is preferably arranged such that at least one of the first nozzle layer and the second nozzle layer is made of a material that predominantly includes at least one of Si, $SiO_2$, and $Si_3N_4$, and the blocking layer is made of a material that predominantly includes at least one of Al, Cu, Au, Pt, aluminum oxide, and aluminum nitride.

According to the arrangement above, the first nozzle layer and the second nozzle layer are easily processed by dry etching using a plasma including fluorine. Meanwhile, the blocking layer is rarely etched because the blocking layer is highly resistant to the dry etching using a plasma including fluorine. It is therefore possible to highly precisely form the first and second nozzle holes.

Since the second nozzle hole in the second nozzle layer does not penetrate the blocking layer, the thickness of the first nozzle layer is uniform, and there is no variation in the flow resistance of the liquid substance.

Provided that the first nozzle layer is made of $SiO_2$ or $Si_3N_4$, when, for example, a liquid repellent film is formed on the liquid substance discharge side, the adherence of the liquid repellent film is improved, so that the peeling or breakage of the liquid repellent film is prevented.

To achieve the objective above, the nozzle plate of the present invention comprises: a nozzle layer having at least one first nozzle hole that discharges a liquid substance; a reinforcing plate having a second nozzle hole that is connected to the first nozzle hole and receives the liquid substance, the reinforcing plate being fixed to the nozzle layer; and a blocking layer which has a higher resistance to etching than the nozzle layer and is formed at least around a connecting part at which the first nozzle hole is connected to the second nozzle hole.

The first nozzle hole is provided for discharging the liquid substance supplied to the second nozzle hole. The liquid substance is not only liquids but also substances that whose viscosity allows them to be discharged through the first nozzle hole.

The blocking layer is formed around the connecting part at which the first nozzle hole is connected to the second nozzle hole. At the time of etching the first nozzle hole, the blocking layer functions as a mask that determines the shape of the opening of the first nozzle hole.

According to the arrangement above, the reinforcing plate that is fixed to the nozzle layer is independently formed. This significantly expands the ranges of choice for the material of the reinforcing plate. Therefore, a highly-rigid reinforcing plate can be adopted, and the warpage of the nozzle plate is prevented.

Moreover, the blocking layer is processed so as to have a predetermined shape of minimum required, without being influenced by the shape of the second nozzle hole of the reinforcing plate. It is therefore possible to reduce the size of the contact between the nozzle layer and the blocking layer.

Therefore, it is possible to significantly restrain the stress on account of the difference of linear expansion coefficients between (i) the nozzle layer and the reinforcing plate and (ii) the blocking layer, and hence it is possible to prevent the nozzle plate from being greatly warped.

Because of the above, the structural reliability of the nozzle plate is improved. Also, in a case where, for instance, the nozzle plate is joined with an inkjet head, the accuracy of the joining is improved.

Moreover, since the rigidity required for the nozzle layer is reduced thanks to the rigidity of the reinforcing plate, it is possible to reduce the thickness of the nozzle layer. That is, since the first nozzle hole is formed in the thin nozzle layer, the first nozzle hole that controls the size of discharged droplets is formed highly precisely.

Also, as described above, the nozzle layer having the first nozzle hole is formed in a process different from a process of forming the reinforcing plate having the second nozzle hole. Therefore, the diameter of the hole by which the size of discharged droplets is controlled is determined by the processing of the thin nozzle layer. On this account, the first nozzle hole is highly precisely formed.

In addition to the above, the nozzle plate of the present invention is preferably arranged such that the blocking layer is formed inside an aperture of the second nozzle hole.

According to the arrangement, the blocking layer is provided inside the aperture of the second nozzle hole. It is therefore possible to minimize the stress occurring around the blocking layer, and the blocking layer is not provided between the nozzle layer and the reinforcing plate. On this account, the precision of the joining between the nozzle layer and the reinforcing plate is improved.

According to the arrangement above, the size of the contact between the nozzle layer and the blocking layer is further reduced. This further restrains the stress due to the difference of linear expansion coefficients between the reinforcing plate and the blocking layer, and prevents the nozzle plate from being significantly warped.

Therefore, it is possible to improve the precision of the connection between the nozzle plate and, for instance, an inkjet head, and the structural reliability of the nozzle plate is also improved.

Also, as described above, the nozzle layer is formed in a step different from a step of forming the reinforcing plate. On this account, the first and second nozzle holes are small in size. This makes it possible to increase the concentration of the first nozzle holes, and improve the resolution of a drawn image.

In addition to the above, the nozzle plate of the present invention is preferably arranged such that the first nozzle hole includes a part that penetrates the first nozzle layer and a part that penetrates the blocking layer.

According to the arrangement above, it is possible to form the part penetrating the nozzle layer by using the blocking layer as an etching mask. The part is identical in diameter with a part penetrating the blocking payer. With this, it is possible to form the first nozzle hole highly precisely.

In addition to the above, the nozzle plate of the present invention is preferably arranged such that the nozzle layer is made of a polymeric organic material, the blocking layer is made of a material selected from the group consisting of a metal material, an inorganic oxide material, and an inorganic nitride material, and the reinforcing plate is made of a material selected from the group consisting of silicon, an inorganic oxide material, and a polymeric organic material.

According to the arrangement above, the nozzle layer is easily processed by dry etching using a plasma including oxygen. Meanwhile, the blocking layer is rarely etched because the blocking layer is highly resistant to the dry etching using a plasma including oxygen. It is therefore possible to highly precisely form the first nozzle hole.

In addition to the above, the nozzle plate of the present invention is preferably arranged such that the nozzle layer is made of polyimide resin, the blocking layer is made of at least one material selected from the group consisting of Ti, Al, Au, Pt, W, Nb, $SiO_2$, $Al_2O_3$, and SiN, and the reinforcing plate is made of either (i) a ceramic material mainly including at least one of silicon, glass and $Al_2O_3$, or (ii) polyimide resin.

According to the arrangement above, the nozzle layer is easily processed by dry etching using a plasma including oxygen. Meanwhile, the blocking layer is rarely etched because the blocking layer is highly resistant to the dry etching using a plasma including oxygen. It is therefore possible to highly precisely form the first nozzle hole.

In addition to the above, the nozzle plate of the present invention is preferably arranged such that the nozzle layer is made of a material mainly including at least one of Si, $SiO_2$, and $Si_3N_4$, the blocking layer is made of a material mainly including at least one of Al, Cu, Au, Pt, aluminum oxide, and aluminum nitride, and the reinforcing plate is made of either (i) a ceramic material mainly including at least one of Si, glass, and $Al_2O_3$, or (ii) polyimide resin.

According to the arrangement above, the nozzle layer is easily processed by dry etching using a plasma including fluorine. Meanwhile, the blocking layer is rarely etched because the blocking layer is highly resistant to the dry etching using a plasma including fluorine. It is therefore possible to highly precisely form the first nozzle hole.

Provided that the nozzle layer is made of $SiO_2$ or $Si_3N_4$, when, for example, a liquid repellent film is formed on the liquid substance discharge side, the adherence of the liquid repellent film is improved, so that the peeling or breakage of the liquid repellent film is prevented.

To achieve the objective above, the manufacturing method of a nozzle plate of the present invention, the nozzle plate having a first nozzle hole through which a liquid substance is discharged, comprises the steps of: (i) forming a nozzle layer for forming the first nozzle hole; (ii) locally forming a blocking layer on the nozzle layer, the blocking layer having an opening that is a part of the first nozzle hole, and the blocking layer functioning as an etching mask used for forming the first nozzle hole; and (iii) forming a first nozzle hole that penetrates the nozzle layer from the opening, the first nozzle hole being formed by etching, using the blocking layer as the etching mask, the nozzle layer through the opening.

According to the method, it is possible to form the first nozzle hole in the nozzle layer, by using the blocking layer as an etching mask. The first nozzle hole is identical with the opening of the blocking layer in terms of diameter. On this account, the first nozzle hole is highly-precisely formed.

The material of the blocking layer is chosen in consideration of the function as an etching mask for the etching of the first nozzle hole or of the function as a side wall of the first nozzle hole. For this reason, the first nozzle hole is formed in a highly precise manner.

Since the blocking layer is locally formed, the size of the contact between the nozzle layer and the blocking layer is reduced. This restrains the stress due to the difference of linear expansion coefficients between the nozzle layer and the blocking layer, and prevents the nozzle plate from being significantly warped. Therefore, it is possible to improve the precision of the connection between the nozzle plate and, for instance, an inkjet head, and the structural reliability of the nozzle plate is also improved.

Since the occurrence of the stress is restrained as above, the rigidity required for the nozzle layer is reduced, and hence the thickness of the nozzle layer can be reduced. That is, an amount of the layer to be etched away to form the first nozzle hole is reduced, so that the formation error is reduced. It is therefore possible to form the first nozzle hole with high precision.

Furthermore, since the thickness of the nozzle layer is reduced as above, the size of the first nozzle hole is reduced. This makes it possible to increase the concentration of the first nozzle holes, and increase the resolution of a drawn image.

In addition to the above, the manufacturing method of the nozzle plate of the present invention preferably further comprises the step of: (iv) connecting, with the nozzle layer, a reinforcing plate which is independently formed and has a second nozzle hole, the step (iv) being performed after the steps (i)-(iii).

According to the method, the blocking layer is small in size so as to be placed inside the second nozzle hole, on condition that the blocking layer is large enough to function as an etching mask for forming the first nozzle hole. In addition, since the blocking layer is inside the aperture of the second nozzle hole, the blocking layer does not contact the reinforcing plate. This makes it possible to significantly reduce the stress on account of the difference of linear expansion coefficients between (i) the nozzle layer and the reinforcing plate and (ii) the blocking layer. It is therefore possible to prevent the nozzle plate from being greatly warped.

Moreover, since the reinforcing plate is formed independently of the nozzle layer, it is possible to simplify the manufacturing steps and reduce the manufacturing costs.

To achieve the objective above, the manufacturing method of the nozzle plate of the present invention, the nozzle plate having a nozzle hole through which a liquid substance is discharged, comprises the steps of: (i) forming a first nozzle layer for forming a first nozzle hole: (ii) locally forming a blocking layer on the nozzle layer, the blocking layer having an opening that is a part of the first nozzle hole, and the blocking layer functioning as an etching mask used for forming the first nozzle hole; and (iii) on the first nozzle layer and the blocking layer, forming a second nozzle layer for forming a second nozzle hole; (iv) forming the second nozzle hole that reaches the blocking layer, by etching and penetrating the second nozzle layer; and (v) forming a first nozzle hole that penetrates the first nozzle layer, by etching, using the blocking layer as the etching mask, the first nozzle layer through the opening.

According to the method, it is possible to form the first nozzle hole in the first nozzle layer, by using the blocking layer as an etching mask. The first nozzle hole is identical with the opening of the blocking layer, in terms of diameter. On this account, the first nozzle hole is highly precisely formed.

The blocking layer functions as the stopper at the time of the etching of the second nozzle hole. It is therefore possible to surely stop the etching of the second nozzle hole, by the blocking layer. Also, thanks to the arrangement above, the second nozzle hole does not penetrate the blocking layer at the time of etching of the second nozzle layer. On this account, the thickness of the first nozzle layer is uniform, and there is no variation in the flow resistance of the liquid substance.

The material of the blocking layer is chosen in consideration of the function as an etching mask for the etching of the first nozzle hole or of the function as a side wall of the first nozzle hole. For this reason, the first nozzle hole is formed in a highly precise manner.

To form the first and second nozzle holes by etching, the etching of the blocking layer is performed in one direction. On this account, the first nozzle hole is easily aligned with the second nozzle hole, as compared to a conventional arrangement in which the etching is performed in two opposing directions.

In addition to the above, the manufacturing method of the nozzle plate of the present invention is preferably arranged such that the steps (iv) and (v) are successively carried out.

According to the method, it is possible to use, in the step (v), the etching device and (a) the etching liquid or (b) etching gas, which are used in the step (iv).

This makes it possible to simplify the manufacturing process.

To achieve the objective above, the nozzle plate of the present invention comprises: a first nozzle layer having a first nozzle hole through which a liquid substance is discharged; a second nozzle layer having a second nozzle hole that is connected to the first nozzle hole and receives the liquid substance; and a discharge layer that has an opening and has a higher resistance to etching than the first nozzle layer, the discharge layer being provided on a liquid substance discharging side of the first nozzle layer, and the first nozzle hole penetrating the first nozzle layer and being connected with the opening.

The first nozzle hole is provided for discharging the liquid substance supplied to the second nozzle hole. The opening connected to the first nozzle hole is a discharge characteristics contributing part that greatly contributes to the direction of discharging the liquid substance and the control of a discharged amount. The liquid substance is not only liquids but also substances that are viscous enough to be discharged through the first nozzle hole.

According to the arrangement above, the discharge layer, which has a higher resistance to etching than the first nozzle layer, is provided with the discharge characteristics contributing part, i.e. the opening.

At the time of etching the first nozzle layer in order to form the first nozzle hole, the discharge layer is highly resistant to the etching. On this account, it is possible to restrain the occurrence of deformation or the like of the opening of the discharge layer.

For example, assume that the opening of the discharge layer, which has been formed in advance, is filled with the material of the first nozzle layer, and then the first nozzle layer is etched so that the first nozzle hole is formed, and the opening is formed as the discharge characteristics contributing part. Even in such a case, since the discharge layer has a higher resistance to etching than the first nozzle layer, the etching of the first nozzle layer is surely stopped when the discharge layer is exposed.

In other words, the discharge characteristics contributing part is identical with the opening that has been formed in advance, in terms of the shape.

As a result, it is possible to significantly improve the precision of the shape of the discharge characteristics contributing part, as compared to a case where the discharge characteristics contributing part of the first nozzle hole is directly formed on the first nozzle layer, without forming the discharge layer on the first nozzle layer.

Because of the above, the direction of discharging the liquid substance and the control of a discharged amount become stable, and a high-resolution image is drawn.

In the nozzle plate of the present invention, the discharge layer is preferably formed in the first nozzle layer.

According to the arrangement above, the discharge layer is thinner than the first nozzle layer. An amount of the layer to be etched away for forming the opening is reduced as the thickness of the discharge layer is reduced. On this account, the opening is highly precisely formed.

Therefore, the discharge characteristics contributing part of the first nozzle is formed with a higher precision, when, as described above, the discharge characteristics contributing part is formed so as to be identical in terms of the shape with the opening which has been formed in advance.

Because of the above, the direction of discharging the liquid substance and the control of a discharged amount become further stable, and an image with a higher resolution is drawn.

In the nozzle plate of the present invention, it is preferable that the discharge layer be predominantly made of an inorganic material.

According to this arrangement, since the discharge layer is made of an inorganic material, the shape of the opening formed on the discharge layer is maintained even if, for example, a liquid repellent film is formed on the discharge layer.

That is, in a case where a liquid-repellent material is applied to the surface of the discharge layer at the time of forming the liquid repellent film, the liquid-repellent material entered in the opening is easily removed by, for example, performing dry etching using a plasma including oxygen. Also, the opening is not damaged by the dry etching, and the shape of the opening is not changed.

Because of the above, the direction of discharging the liquid substance and the control of a discharged amount become further stable, and an image with a higher resolution is drawn.

The nozzle plate of the present invention is preferably arranged such that, that part of the first nozzle layer where the nozzle hole penetrates is a first nozzle hole part, and an outer shape of the discharge layer is larger than an outer shape of the first nozzle hole part at an interface between the discharge layer and the first nozzle layer.

According to the arrangement above, the discharge layer functions as a stopper layer used for etching the first nozzle layer. That is, in a case where, in order to form the first nozzle hole, the first nozzle layer is etched from the second nozzle layer side, the etching is almost automatically stopped at the discharge layer, and the first nozzle hole part is formed.

This prevents the first nozzle layer from being excessively etched, and hence the first nozzle hole part with a predetermined shape is easily formed.

The nozzle plate of the present invention is preferably arranged such that the discharge layer is locally formed around the opening.

The arrangement above makes it possible to reduce the contact between the discharge layer and the first nozzle layer. Therefore, it is possible to significantly reduce the stress on account of the difference of linear expansion coefficients between the discharge layer and the first nozzle layer. On this account, it is possible to prevent the nozzle plate from being greatly warped. Moreover, it is possible to improve the precision of the joining between the nozzle plate and, for instance, an inkjet head, and the structural reliability of the nozzle plate is also improved.

Since the occurrence of the stress is restrained as above, the rigidity required for the first and second nozzle layers is reduced, and hence the thickness of the first and second nozzle layers can be reduced. That is, an amount of the layers to be etched away to form the first and second nozzle holes is reduced, so that the formation error is reduced. It is therefore possible to form the first nozzle hole and the second nozzle hole with high precision.

Also, since the thickness of the first nozzle layer and the thickness of the second nozzle layer are reduced, the sizes of the first and second nozzle holes are reduced. This makes it possible to increase the concentration of the first nozzle holes, and improve the resolution of the drawn image.

The nozzle plate of the present invention is preferably arranged such that, between the first nozzle layer and the second nozzle layer, a blocking layer which has a higher resistance to etching than the first nozzle layer is locally formed, and the first nozzle hole penetrates the blocking layer and is connected to the second nozzle hole.

According to this arrangement, at the time of etching the first nozzle layer and forming the first nozzle hole, the blocking layer functions as a mask for determining the shape of the opening of the first nozzle hole.

With this, it is possible to form the part penetrating the first nozzle layer. The diameter of the penetrating part of the first nozzle layer is identical with the diameter of the part penetrating the blocking layer. For this reason, the first nozzle hole is highly precisely formed.

Also, since the blocking layer is locally formed, it is possible to reduce the contact between the first nozzle layer and the blocking layer or between the second nozzle layer and the blocking layer. Therefore, it is possible to significantly reduce the stress on account of the difference of linear expansion coefficients between (i) the first and second nozzle layers and (ii) the blocking layer, so that the nozzle plate is not greatly warped. Moreover, it is possible to improve the precision of the joining between the nozzle plate and, for instance, an inkjet head, and the structural reliability of the nozzle plate is also improved.

Furthermore, since the occurrence of the stress is restrained as above, the rigidity required for the first and second nozzle layers is reduced, and hence the thickness of the first and second nozzle layers can be reduced. That is, an amount of the layers to be etched away to form the first and second nozzle holes is reduced, so that the formation error is reduced. It is therefore possible to form the first nozzle hole and the second nozzle hole with high precision.

Also, since the thickness of the first nozzle layer and the thickness of the second nozzle layer are reduced, the sizes of the first and second nozzle holes are reduced. This makes it possible to increase the concentration of the first nozzle holes, and improve the resolution of a drawn image.

The nozzle plate of the present invention is preferably arranged such that, the blocking layer has a higher resistance to etching than the second nozzle layer, and an outer shape of the blocking layer is larger than an outer shape of the second nozzle hole at a connecting part at which the first nozzle hole is connected to the second nozzle hole.

As in the arrangement above, the blocking layer has a higher resistance to etching than the second nozzle layer, and the outer shape of the blocking layer is larger than the outer shape of the second nozzle hole at the connecting part at which the first and second nozzle holes are connected to each other. Therefore, the blocking layer functions as a stopper for the etching of the second nozzle hole, and hence the etching of the second nozzle hole is surely stopped by the blocking layer. Moreover, since the second nozzle hole does not penetrate the blocking layer at the time of etching the second nozzle layer, the thickness of the first nozzle layer is kept uniform.

In other words, on account of the blocking layer, the formation of the second nozzle hole accurately ends at the surface of the blocking layer. For this reason, the first nozzle layer is not damaged by excessive etching at the time of forming the second nozzle hole, and hence the length of the first nozzle hole is controlled by determining the thickness of the first nozzle layer. Therefore, the flow resistance becomes stable, the discharge of droplets becomes stable, and the precision of the landing of droplets and the resolution are improved.

The nozzle plate of the present invention is preferably arranged such that the first nozzle layer has a higher resistance to etching than the second nozzle layer.

According to this arrangement, the first nozzle layer functions as a stopper for the etching of the second nozzle hole, and hence the etching of the second nozzle hole stops at the first nozzle layer.

In this manner, the etching of the second nozzle hole stops at the first nozzle layer, without providing the blocking layer. On this account, the aforesaid stress between (i) the first and second nozzle layers and (ii) the blocking layer is not produced, and hence the warpage of the nozzle plate is further effectively prevented.

The nozzle plate of the present invention is preferably arranged such that a first nozzle hole part that penetrates the first nozzle layer is taper-shaped so that a connecting part at which the first nozzle hole part contacts the opening is narrow.

According to the arrangement, since the first nozzle hole part is taper-shaped, the occurrence of the turbulent liquid flow is restrained inside the first nozzle hole. The stability of the discharge of droplets is therefore improved.

The nozzle plate of the present invention is preferably arranged such that the second nozzle hole is taper-shaped so that a connecting part where the second nozzle hole contacts the first nozzle hole is narrow.

According to this arrangement, since the second nozzle hole is taper-shaped, the occurrence of the turbulent liquid flow is restrained inside the first nozzle hole. The stability of the discharge of droplets is therefore improved.

The nozzle plate of the present invention is preferably arranged such that a liquid repellent film is formed at least on a liquid substance discharge side of the discharge layer.

According to the arrangement, since the liquid repellent film is formed at least on the liquid substance discharge side of the discharge layer, the meniscus shape of the liquid substance, which is formed in the opening, is stable, and hence the direction of the discharge of the liquid substance is stable. Therefore, the precision of the landing of droplets and the resolution of a drawn image are improved.

Note that, at the time of forming the liquid repellent film, it is preferable to form the liquid repellent film in such a manner as not to allow the film to enter the hole (inner wall) through the opening. For instance, a part of the liquid repellent film, which entered to the hole through the opening, may be removed by dry etching or the like.

To achieve the objective above, the nozzle plate of the present invention comprises: a first nozzle layer having a first nozzle hole through which a liquid substance is discharged; a reinforcing plate having a second nozzle hole that is connected to the first nozzle hole and receives the liquid substance, the reinforcing plate being fixed to the first nozzle layer; a blocking layer which has a higher resistance to etching than the first nozzle layer and is formed at least around a connecting part at which the first nozzle hole is connected to the second nozzle hole; and a discharge layer which has an opening, has a higher resistance to etching than the first nozzle layer, and is formed so as to contact a liquid substance discharge side of the first nozzle layer, the first nozzle hole penetrating the first nozzle layer and being connected with the opening.

According to the arrangement, on the discharge layer having a higher resistance to etching than the first nozzle layer, a discharge characteristics contributing part functioning as the aforesaid opening is formed.

Therefore, in etching the first nozzle layer in order to form the first nozzle hole, the discharge layer is highly resistant to the etching. On this account, it is possible to restrain the occurrence of deformation or the like of the opening of the discharge layer.

For example, assume that the opening of the discharge layer, which has been formed in advance, is filled with the material of the first nozzle layer, and then the first nozzle layer is etched so that the first nozzle hole is formed, and the opening is formed as the discharge characteristics contributing part. Even in such a case, since the discharge layer has a higher resistance to etching than the first nozzle layer, the etching of the first nozzle layer is surely stopped when the discharge layer is exposed.

In other words, the discharge characteristics contributing part is identical with the opening, in terms of the shape.

As a result, it is possible to significantly improve the precision of the shape of the discharge characteristics contributing part, as compared to a case where the discharge characteristics contributing part of the first nozzle hole is directly formed on the first nozzle layer, without forming the discharge layer on the first nozzle layer.

Because of the above, the direction of discharging the liquid substance and the control of a discharged amount become stable, and a high-resolution image is drawn.

Also, the blocking layer functions as a mask for determining the shape of the opening of the first nozzle hole, at the time of etching the first nozzle hole. It is therefore possible to form the first nozzle hole highly precisely.

Moreover, the blocking layer is processed so as to have a predetermined shape of minimum required, without being influenced by the shape of the second nozzle hole of the reinforcing plate. It is therefore possible to reduce the size of the contact between the first nozzle layer and the blocking layer.

According to the arrangement above, the reinforcing plate that is fixed to the first nozzle layer is independently formed. This significantly expands the ranges of choice for the material of the reinforcing plate. Therefore, a highly-rigid reinforcing plate can be adopted, and the warpage of the nozzle plate is prevented.

Therefore, it is possible to significantly reduce the stress on account of the difference of linear expansion coefficients between (i) the first nozzle layer and the reinforcing plate and (ii) the blocking layer, so that the nozzle plate is not greatly warped.

Moreover, since the rigidity required for the first nozzle layer is reduced thanks to the rigidity of the reinforcing plate, it is possible to reduce the thickness of the first nozzle layer. That is, since the first nozzle hole is formed in the thin first nozzle layer, the first nozzle hole is formed highly precisely.

The nozzle plate of the present invention is preferably arranged such that the discharge layer is made of a material mainly including at least one of Al, Pt, Au, $Al_2O_3$, and AlN, the first nozzle layer is made of a silicon compound, and the second nozzle layer is made of organic resin.

According to this arrangement, the material of which the discharge layer is made is highly resistant to (i) etching of the silicon compound of which the first nozzle layer is made (e.g. dry etching using a plasma including fluorine) or (ii) etching of the organic resin of which the second nozzle layer is made (e.g. dry etching using a plasma including oxygen).

On this account, the discharge layer is not damaged at the time of forming the first and second nozzle holes. That is to say, the opening does not deform in the process of forming the nozzle (first and second nozzle holes), so that the nozzle plate having the opening with very high processing accuracy is provided. This improves the precision of the landing of droplets and the resolution of a drawn image.

Moreover, the silicon compound of which the first nozzle layer is made is highly resistant to the etching of the organic resin of which the second nozzle layer is made (e.g. dry etching using a plasma including oxygen). For this reason, the first nozzle layer is not greatly damaged by the excessive etching at the time of forming the second nozzle hole.

This makes it possible to restrain the changes in the length (depth) of the first nozzle hole and the changes in the flow resistance on account of the reduction of the thickness of the first nozzle layer. It is therefore possible to restrain the degradation of the stability of the discharge of droplets.

The nozzle plate of the present invention is preferably arranged such that the discharge layer is made of a silicon compound, the first nozzle layer is made of a metal material mainly comprising aluminum, and the second nozzle layer is made of organic resin.

According to the method, the material of which the discharge layer is made is highly resistant to (i) the etching of the metal material mainly including aluminum, of which the first nozzle layer is made (e.g. dry etching using a plasma including chlorine) or (ii) the etching of the organic resin of which the second nozzle layer is made (e.g. dry etching using a plasma including oxygen).

On this account, the opening is not damaged at the time of forming the first and second nozzle holes. That is to say, the opening does not deform in the process of forming the nozzle (first and second nozzle holes), so that the nozzle plate having the opening with very high processing accuracy is provided. This improves the precision of the landing of droplets and the resolution of a drawn image.

Furthermore, the metal material mainly including aluminum, of which the first nozzle layer is made, is highly resistant to the etching of the organic resin of which the second nozzle layer is made (e.g. dry etching using a plasma including oxygen). For this reason, the first nozzle layer is not greatly damaged by the excessive etching at the time of forming the second nozzle hole.

This makes it possible to restrain the changes in the length (depth) of the first nozzle hole and the changes in the flow resistance on account of the reduction of the thickness of the first nozzle layer. It is therefore possible to restrain the degradation of the stability of the discharge of droplets.

The nozzle plate of the present invention is preferably arranged such that the first nozzle layer is made of organic resin, and the discharge layer is made of a material that mainly includes at least one of Ti, Al, Au, Pt, Ta, W, Nb, $SiO_2$, $Al_2O_3$, $Si_3N_4$, and AlN.

According to this arrangement, the first nozzle layer is easily processed by dry etching using a plasma including oxygen. Moreover, the discharge layer is rarely etched because of high resistance to the dry etching using a plasma including oxygen. This makes it possible to form the opening with a high precision.

According the arrangement above, the blocking layer can be made of a material identical with that of the discharge layer. In such a case, it is possible to use the blocking layer as a mask for determining the shape of the opening of the first nozzle hole, at the time of forming the first nozzle hole by etching the first nozzle layer. It is therefore possible to improve the processing accuracy of the first nozzle hole, as compared to the patterning by resist.

In a case where the first and second nozzle layers are both made of the organic resin, the blocking layer is highly resistant to the dry etching using a plasma including oxygen, which is performed for forming the second nozzle hole. On this account, the formation of the second nozzle hole accurately stops at the blocking layer.

This causes the length (depth) of the first nozzle hole and the flow resistance to be stable. Also, since the flow resistance becomes stable, the stability of the discharge of droplets is improved. This improves the precision of the landing of droplets and a high-resolution image drawing is realized.

The nozzle plate of the present invention is preferably arranged such that the first nozzle layer is made of a material mainly including at least one of Si, $SiO_2$, and $Si_3N_4$, and the discharge layer is made of a material mainly including at least one of Al, Ni, Fe, Co, Cu, Au, Pt, aluminum oxide, and aluminum nitride.

According to this arrangement, the first nozzle layer is easily processed by dry etching using a plasma including fluorine. Moreover, the discharge layer is highly resistant to the dry etching using a plasma including fluorine, and hence the discharge layer is rarely etched. On this account, it is possible to form the opening with a high precision.

According the arrangement above, the blocking layer can be made of a material identical with that of the discharge layer. In such a case, the blocking layer can be used as a mask for determining the shape of the opening of the first nozzle hole, at the time of forming the first nozzle hole by etching the first nozzle layer. It is therefore possible to improve the processing accuracy of the first nozzle hole, as compared to the patterning by resist.

In a case where the first and second nozzle layers are made of silicon or silicon compound, the blocking layer is highly resistant to the dry etching using a plasma including fluorine, by which the second nozzle hole is formed. It is therefore possible to accurately stop the formation of the second nozzle hole, by the blocking layer.

Also, in a case where the second nozzle layer is made of organic resin, the blocking layer is highly resistant to the dry etching using a plasma including oxygen, by which the second nozzle hole is formed. It is therefore possible to accurately stop the formation of the second nozzle hole, by the blocking layer. On account of this, the length of the first nozzle hole becomes stable, and the flow resistance becomes stable. As a result, the stability of the discharge is improved. The precision of the landing of droplets is therefore improved, and a high-resolution image drawing is realized.

That is, in the arrangement above, the second nozzle layer may be made of organic resin, silicon, or silicon compound. The choice of the material is wide in this manner, and hence the nozzle plate is easily manufactured.

To achieve the objective above, the manufacturing method of the nozzle plate of the present invention, the nozzle plate including a first nozzle layer that has a first nozzle hole including a first opening and a first nozzle hole part, comprises the steps of: (i) forming a discharge layer where the first opening is formed, the discharge layer having a higher resistance to etching than the first nozzle layer; (ii) forming a first nozzle layer that fills the first opening and covers the discharge layer; (iii) forming the first nozzle hole part in the first nozzle layer, in line with a position where the first opening is formed; and (iv) removing a part of the first nozzle layer by etching, the part being in the first nozzle hole part.

The first opening is a discharge characteristics contributing part that greatly contributes to the direction of discharging the liquid substance and the control of a discharged amount. The liquid substance is not only liquids but also substances that are viscous enough to be discharged through the first nozzle hole.

According to the method, since the discharge layer has a higher resistance to etching than the first nozzle layer, the nozzle layer is etched and the etching surely stops when the discharge layer exposes, in the step (i).

That is, the discharge characteristics contributing part is identical, in terms of the shape, with the first opening which has been formed in advance.

As a result, it is possible to significantly improve the precision of the shape of the discharge characteristics contributing part, as compared to a case where the discharge characteristics contributing part of the first nozzle hole is directly formed on the first nozzle layer, without forming the discharge layer on the first nozzle layer.

Because of the above, the direction of discharging the liquid substance and the control of a discharged amount become stable, and a high-resolution image is drawn.

Preferably, the manufacturing method of the nozzle plate of the present invention further comprises the steps of: (v) forming a second nozzle layer in such a manner as to fill the first opening and the first nozzle hole part and to cover the first nozzle layer, the second nozzle layer having a lower resistance to etching than the first nozzle layer; and (vi) forming, by etching the second nozzle layer, a second nozzle hole that penetrates the second nozzle layer, the steps (v) and (vi) being performed after the step (iv).

According to this method, the first nozzle layer functions as a stopper for the etching of the second nozzle hole. On this account, the etching of the second nozzle layer at the time of forming the second nozzle hole is stopped at the first nozzle layer, without the formation of an etching stopper such as a blocking layer.

Therefore, there is no stress on account of the difference of linear expansion coefficients between (i) an etching stopper such as a reinforcing plate and (ii) the first and second nozzle layers.

As a result, it is possible to prevent the nozzle plate from being greatly warped, and it is possible to improve the precision of the connection between the nozzle plate and, for instance, an inkjet head, and the structural reliability of the nozzle plate is also improved.

Furthermore, since the occurrence of the stress is restrained as above, the rigidity required for the first nozzle layer is reduced, and hence the thickness of the first nozzle layer can be reduced. That is, an amount of the layer to be etched away to form the first nozzle hole is reduced, so that the formation error is reduced. It is therefore possible to form the first nozzle hole with high precision.

Also, to form the first and second nozzle holes by etching, the etching of the discharge layer is performed in one direction. On this account, the first nozzle hole is easily aligned with the second nozzle hole, as compared to a conventional arrangement in which the etching is performed in two opposing directions.

Preferably, the manufacturing method of the nozzle plate of the present invention further comprises the steps of: (vii) locally forming a blocking layer on the first nozzle layer in such a manner as to correspond to the first opening, the blocking layer having a second opening and having a higher resistance to etching than the first nozzle layer and the second nozzle layer; and (viii) forming a second nozzle layer that fills the second opening and covers the first nozzle layer, and then forming, by etching the second nozzle layer, a second nozzle hole that penetrates the second nozzle layer and reaches the blocking layer, the steps (vii) and (viii) being performed between the step (ii) and (iii).

According to this method, the blocking layer functions as a stopper for the etching of the second nozzle hole, and hence the etching of the second nozzle hole is surely stopped by the blocking layer. Moreover, since the second nozzle hole does not penetrate the blocking layer at the time of etching the second nozzle layer, the thickness of the first nozzle layer is kept uniform.

In other words, on account of the blocking layer, the formation of the second nozzle hole accurately ends at the surface of the blocking layer. For this reason, the first nozzle layer is not damaged by excessive etching at the time of forming the second nozzle hole, and hence the length of the first nozzle hole is controlled by determining the thickness of the first nozzle layer. Therefore, the flow resistance becomes stable, the discharge of droplets becomes stable, and the precision of the landing of droplets and the resolution are improved.

Also, since the blocking layer is locally formed, the size of the contact between the first nozzle layer and the blocking layer is reduced. This restrains the stress due to the difference of linear expansion coefficients between the first nozzle layer and the blocking layer, and prevents the nozzle plate from being significantly warped.

Also, to form the first and second nozzle holes by etching, the etching of the blocking layer is performed in one direction. On this account, the first nozzle hole is easily aligned with the second nozzle hole, as compared to a conventional arrangement in which the etching is performed in two opposing directions.

Preferably, the manufacturing method of the nozzle plate of the present invention further comprises the steps of: (ix) removing a part of the second nozzle layer, the part being in the first nozzle hole part; and (x) removing a part of the second nozzle layer, the part being in the first opening, the steps (ix) and (x) being performed following the step (vi).

According to this method, it is possible to perform the etching of the first nozzle hole, using the etching device and (a) the etching liquid or (b) etching gas, which are used in the step (viii).

This makes it possible to simplify the manufacturing process.

In the manufacturing method of the nozzle plate of the present invention, the steps (iii) and (iv) are preferably performed following the step (viii).

According to this method, it is possible to perform the etching of the first nozzle hole, using the etching device and (a) the etching liquid or (b) etching gas, which are used in the step (viii).

This makes it possible to simplify the manufacturing process.

Preferably, the manufacturing method of the nozzle plate of the present invention further comprises the steps of: (xi) forming a liquid repellent film having a lower resistance to etching than the discharge layer; and (xii) removing a part of the liquid repellent film by performing etching from an opposite side of the first opening, the part being in the first nozzle, the steps (xi) and (xii) being performed after the steps (i)-(iv).

According to this method, a part of the liquid repellent film, which entered to the hole (inner wall) through the first opening, is removed by performing the etching from the opposite side of the first opening.

Since the discharge layer is highly resistant to the etching of the liquid repellent film, the first opening does not deform in the process of removing that part of the liquid repellent film which entered into the hole through the first opening.

This increases the margin for the etching by which the entered part of the liquid repellent film is removed. It is therefore possible to almost completely remove the entered part of the liquid repellent film, by sufficiently performing the etching.

As a result, since it is possible to prevent the liquid repellent film from remaining in the first opening (inner wall), the wettability of the discharged liquid on the first opening becomes stable and the precision of the landing of the discharged droplets is improved. For this reason, a nozzle plate with a high image drawing resolution is stably manufactured.

For a fuller understanding of the nature and advantages of the invention, reference should be made to the ensuing detailed description taken in conjunction with the accompanying drawings.

BRIEF DESCRIPTION OF DRAWINGS

FIG. 1(*b*) illustrates a cross section which is taken along a line A-A' in FIG. 1(*a*).

FIG. 5(*b*) illustrates a cross section which is taken along a line B-B' in FIG. 5(*a*).

FIG. 11(*b*) is a cross section which is taken along a line A-A' of FIG. 11(*a*).

FIG. 15(*b*) is a cross section which is taken along a line B-B' of FIG. 15(*a*).

FIG. 19(*b*) is a cross section which is taken along a line C-C' of FIG. 19(*a*).

BEST MODE FOR CARRYING OUT THE INVENTION

The present invention will be described in reference to Embodiments and Comparative Examples. The present invention, however, is not limited to these Embodiments and Comparative Examples at all.

Embodiment 1

Embodiment 1 of the present invention is described below with reference to the attached drawings.

(Nozzle Plate)

Figure 1:
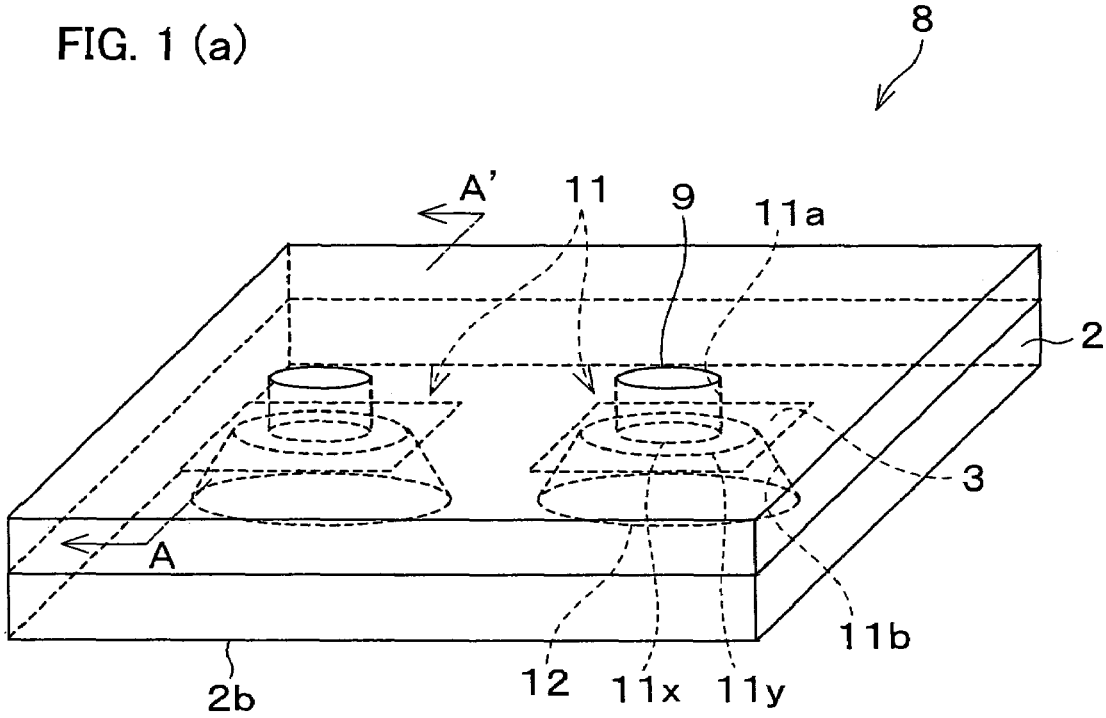
FIG. 1(*a*) is an oblique perspective view of a nozzle plate of Embodiment 1 of the present invention.
Figure 1:
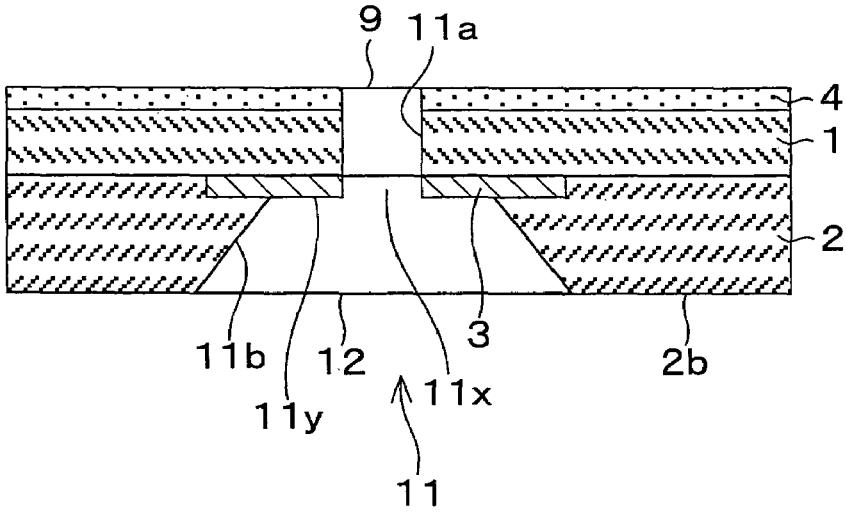

FIG. 1(*a*) is an oblique perspective view of a part of a nozzle plate of the present invention, which is used in a minute dot formation device. FIG. 1(*b*) is a cross section which is taken along a line A-A' of FIG. 1(*a*). The nozzle plate has at least one liquid (liquid substance) discharge opening 9. In FIG. 1(*a*), there are two liquid discharge openings 9.

As shown in FIGS. 1(*a*) and 1(*b*), the nozzle plate 8 includes a first nozzle layer 1, a second nozzle layer 2, a stopper layer 3 (blocking layer), a liquid repellent film 4, and a nozzle hole 11. On the liquid discharging side of the first nozzle layer 1, the liquid repellent film 4 is formed. On the other side, the second nozzle layer 2 is formed. In the second nozzle layer 2, the stopper layer 3 is provided between the first and second nozzle layers 1 and 2, and is in touch with the first nozzle layer 1. Also, the stopper layer 3 is locally formed around the first nozzle hole 11*a* that has the aforesaid liquid discharge opening 9. That is, the first nozzle hole 11*a* penetrates the liquid repellent film 4 and the first nozzle layer 1, and further penetrates the center of the locally-formed stopper layer 3.

The second nozzle hole 11*b* and the first nozzle hole 11*a* form the nozzle hole 11. The second nozzle hole 11*b* is taper-shaped (i.e. shaped like a truncated cone) and spreads to the bottom, from the connecting part with the cylindrical first nozzle hole 11*a*. The second nozzle hole 11*b* penetrates the second nozzle layer 2, and opens at the surface 2*b* which is opposite to the liquid repellent film 4.

The upper base 11*y* of the truncated-cone-shaped second nozzle hole 11*b* is a circle around the first nozzle hole 11*a*, and the stopper layer 3 is exposed as the upper base 11*y*. On this account, the (substantially circular) connecting part 11*x* between the first and second nozzle holes 11*a* and 11*b* is smaller in diameter than the external diameter of the upper base 11*y* of the second nozzle hole 11*b* (i.e. smaller than the outer shape of the second nozzle hole 11*b* at the connecting part 11*x*). As described above, the substantially-circular opening of the first nozzle hole 11*a* functions as the liquid discharge opening 9. Meanwhile, the substantially-circular opening of the second nozzle hole 11*b* functions as a liquid supply opening 12.

Although the sizes and materials of the members will specifically described below, the present invention is not limited to those specific examples.

The first nozzle layer 1 is a polyimide film about 1 μm thick. The second nozzle layer 2 is a polyimide film about 20 μm thick.

The stopper layer 3 is made of a metal material mainly comprising titanium and is substantially square about 20 μm on a side, in order to restrain the warpage due to the overall stress of the nozzle plate 8.

The diameter of the opening (liquid crystal discharge opening 9) of the first nozzle hole 11*a* is about 3 μm. The outer diameter of the upper base 11*y* of the second nozzle hole 11*b* is 10 μm, and the diameter of the opening (liquid inflow opening 12) is 30 μm.

The liquid repellent film 4 on the first nozzle layer 1 is a fluoropolymer film or a silicon polymer film.

In the present embodiment, the stopper layer 3 is locally formed at the location where the nozzle hole 11 is formed. Therefore, in comparison with the convention arrangement in which the stopper layer is entirely formed between the first and second nozzle layers, it is possible to significantly restrain the stress on account of the difference of linear expansion coefficients between the first and second nozzle layers 1 and 2 and the stopper layer 3, and hence it is possible to prevent the nozzle plate 8 to be greatly warped.

Figure 19:
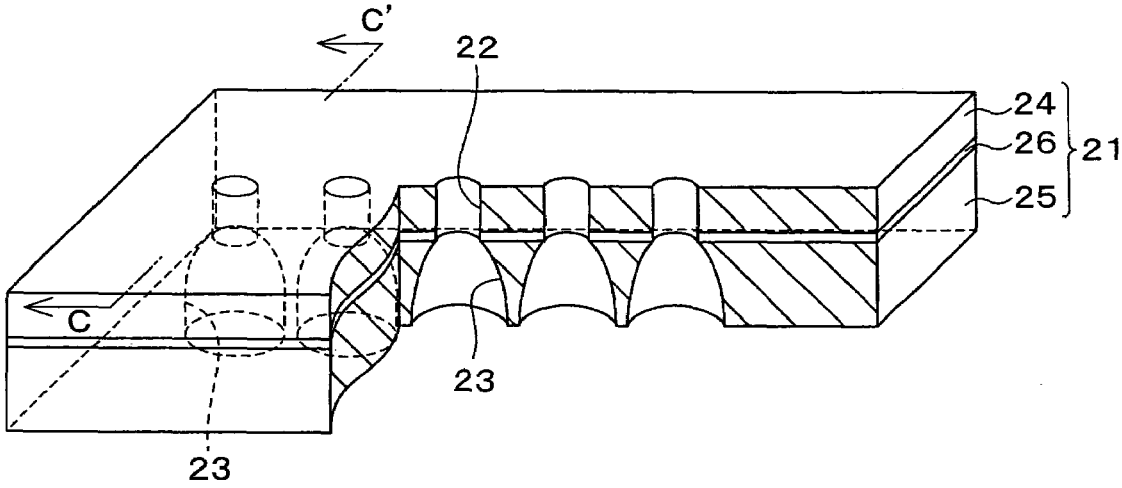
FIG. 19(*a*) is an oblique perspective view of a conventional nozzle plate.
Figure 19:
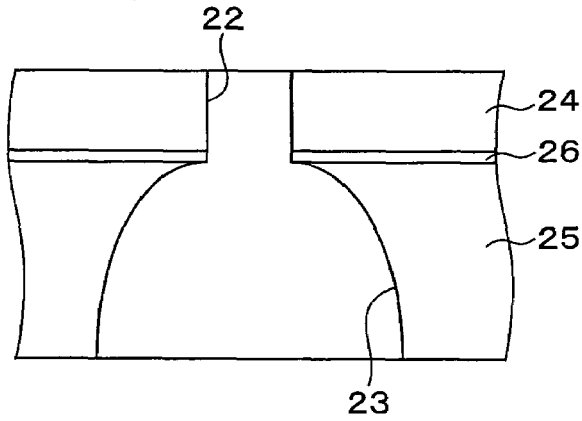

Since the generation of the stress is restrained, the rigidity of the first and second nozzle layers 1 and 2 is not required to be high. It is therefore possible to reduce the thickness of the first nozzle layer 1 and the thickness of the second nozzle layer 2, in comparison with the conventional arrangement (silicon layer 24 is 15 μm thick and silicon layer 25 is 100 μm thick as shown in FIGS. 19(*a*) and 19(*b*)). (In the present embodiment, the first nozzle layer 1 is 1 μm thick and the second nozzle layer 2 is 20 μm thick.) This reduces an amount of the first and second nozzle layers 1 and 2 to be etched away at the time of forming the first and second nozzle holes 11*a* and 11*b*, and hence the formation error is reduced. As a result, it is possible to produce a highly-precise nozzle hole 11.

Also, since the second nozzle hole 11*b* is taper-shaped, the occurrence of the turbulent liquid flow is restrained inside the second nozzle hole 11*b*. The stability of the discharge of droplets is therefore improved.

Also, as described above, the thickness of the second nozzle layer 2 is thin as compared to the conventional arrangement. On this account, even if the second nozzle hole 11*b* is taper-shaped, the liquid inflow opening 12 is small as compared to the conventional arrangement. This makes it possible to further improve the degree of concentration of the nozzle holes 11.

With the liquid repellent film 4, it is possible to prevent the droplets from adhering to the first nozzle layer 1 in the vicinity of the first nozzle hole 11*a*.

It is noted that the material of the first nozzle layer 1 is not limited to polyimide. The material may be (i) a polymeric organic material other than polyimide, (ii) a silicon compound material such as $SiO_2$ and $Si_3N_4$, or (iii) silicon.

The material of the stopper layer 3 is not limited to the metal material mainly comprising titanium, either. The material of the stopper layer 3 can be optionally chosen on condition that the material is highly resistant to the etching process of the first and second nozzle layers 1 and 2 and to the etching of the below-mentioned sacrifice layer 5. In other words, the material is required to be highly resistant to an etching gas (a plasma including oxygen, a plasma including fluorine, or the like), or to be highly resistant to the etchant (nitric acid, an aqueous solution of potassium hydroxide, or the like). Specific examples of the metal material are: a metal material mainly comprising Ti, Al, Cu, Au, Pt, Ta, W, Nb, and the like; an inorganic oxide material mainly including $SiO_2$, $Al_2O_3$ and the like; an inorganic nitride material mainly made of $Si_3N_4$ or the like; or the like.

The material of the second nozzle layer 2 is not limited to polyimide, either. Being similar to the first nozzle layer 1, the material of the second nozzle layer 2 may be a polymeric organic material other than polyimide, a silicon compound material such as $SiO_2$ and $Si_3N_4$, or silicon.

The shape of the stopper layer 3 is not limited to the substantially square shape, on condition that the stopper layer 3 locally locates at the position where the nozzle hole 11 is formed. For example, the stopper layer 3 may have a circular shape. The circular shape is preferable because it has the highest isotropy and hence the reduction of the stress is isotropic. As shown in FIG. 1(*a*), in the present embodiment, one nozzle hole 11 is formed in one stopper layer 3. The present invention is not limited to this arrangement, so that a plurality of nozzle holes 11 may be formed in one stopper layer 3, as long as the stress is restrained as compared to the conventional arrangement.

Figure 2:
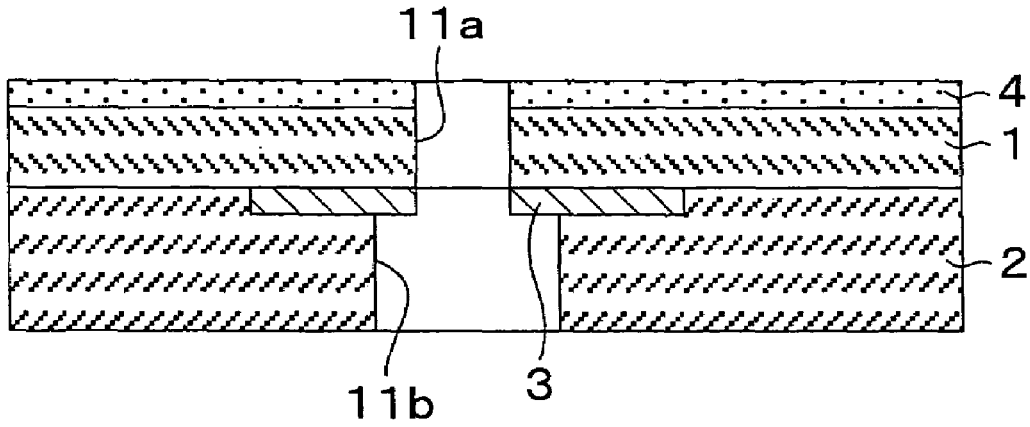
FIG. 2 is a cross section illustrating a variant example of the nozzle plate.
Figure 8:
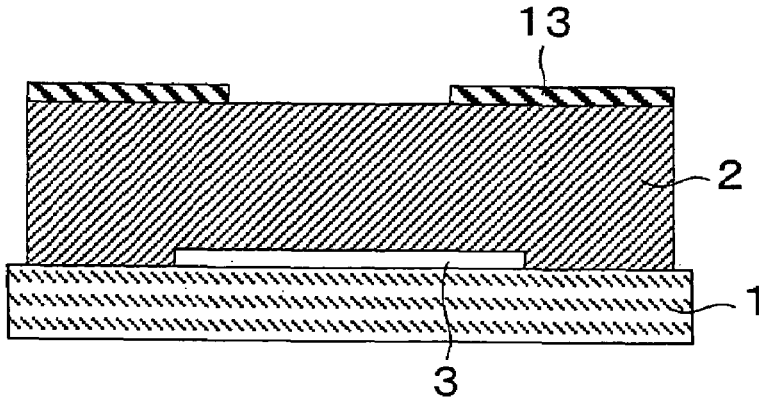
FIGS. 8(*a*)-8(*c*) are cross sections illustrating another manufacturing method of the nozzle plate of Embodiment 1 of the present invention.
Figure 8:
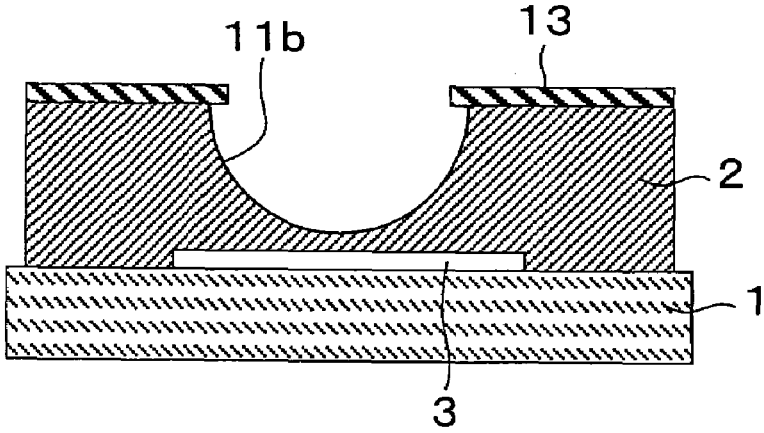
Figure 8:
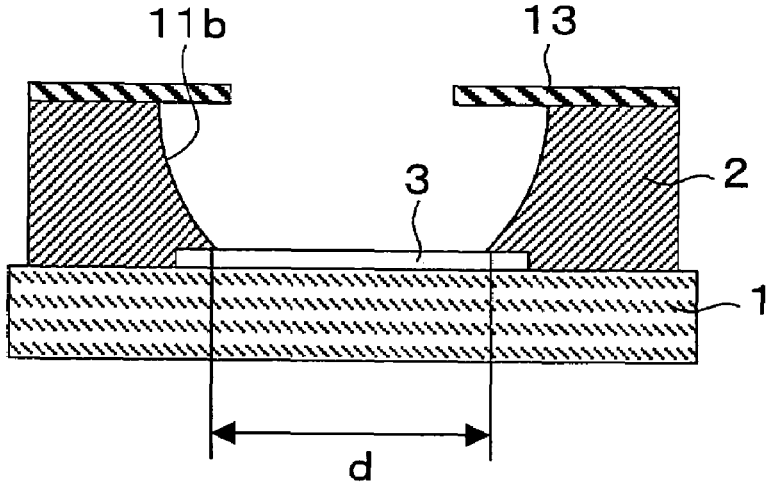

As shown in FIG. 1(*b*), in the present embodiment, the diameter of the connecting part 11*x* between the first and second nozzle holes 11*a* and 11*b* is smaller than the diameter of the upper base 11*y* of the second nozzle hole 11*b*, but it is not necessary to arrange them in that way. The diameter of the connecting part 11*x* may be identical with the diameter of the joint section 11*y*. In the present embodiment, the second nozzle hole 11*b* is truncated-cone-shaped (taper-shaped) so that the connecting part 11*x* with the first nozzle hole 11*a* is narrow, but it is not necessary to arrange the second nozzle hole 11*b* in that way. For example, as shown in FIG. 2, the second nozzle hole 11*b* may be straight (cylindrical) so that the side wall of the second nozzle hole 11*b* is perpendicular to the stopper layer 3. With this arrangement, the liquid inflow opening 12 of the second nozzle hole 11*b* is further reduced in size, and hence the concentration of the nozzles is further increased. Also, the second nozzle hole 11*b* may be tapered with bulge, as shown in FIG. 8(*c*).

As described above, since the nozzle plate has the first nozzle layer 1, the stopper layer 3, and the second nozzle layer 2, the shape of the liquid discharge opening 9 depends on the processing accuracy of the first nozzle layer 1 which is 1 μm thick. On this account, the precision of the shape of the liquid discharge opening 9 is improved.

The rigidity of the nozzle plate 8 is maintained by the second nozzle layer 2. As a result, the overall rigidity of the nozzle plate 8 is improved and the handling of the same is easy.

Since the shape of the stopper layer 3 is reduced as much as possible, the warpage of the nozzle plate 8 due to the stress is restrained.

Also, since the thickness of the nozzle plate 8 is also reduced as much as possible, the liquid inflow opening 12 of the nozzle plate 8 is reduced in size, and hence the concentration of the nozzle holes 11 is increased. This makes it possible to draw a high-resolution image.

Since the nozzle plate 8 is reinforced by the thick second nozzle layer 2, the warpage is restrained and the handling is easy.

Even if the processing accuracy of the second nozzle hole 11*b* through the thick second nozzle layer 2 is low, the etching does not go beyond the stopper layer 3, at the time of the processing of the second nozzle hole 11*b*. On this account, the low processing accuracy of the second nozzle hole 11*b* does not influence on the first nozzle hole 11*a* that controls the size of discharged droplets.

Since the stopper layer 3 is thinner than the first nozzle layer 1 in the nozzle plate 8, the precision of the shape is high after the etching of the stopper layer 3 by means of photolithography, as compared to a case where the first nozzle layer 1 is directly processed by photolithography, without using the stopper layer 3. Moreover, since the first nozzle layer 1 is processed by utilizing the stopper layer 3 as a mask and with a high etching selectivity, the first nozzle hole 11*a* that controls the size of discharged droplets is highly precisely formed.

In a case where the first nozzle layer 1 is made of $SiO_2$ or $Si_3N_4$, the adherence of the liquid repellent film 4 formed on the first nozzle layer 1 is improved, so that the peeling or breakage of the liquid repellent film 4 is prevented. As a result, the discharging direction of the droplets becomes stable and the resolution of a drawn image is improved.

(Manufacturing Method of Nozzle Plate)

Figure 3:
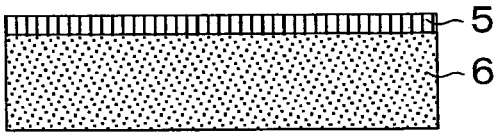
FIGS. 3(*a*)-3(*g*) illustrate cross sections showing a manufacturing method of the nozzle plate of Embodiment 1 of the present invention.
Figure 3:
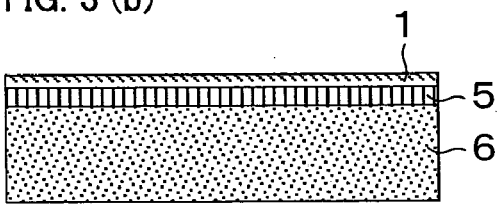
Figure 3:
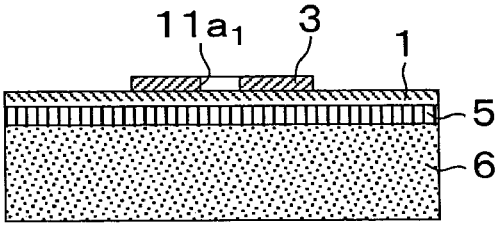
Figure 3:
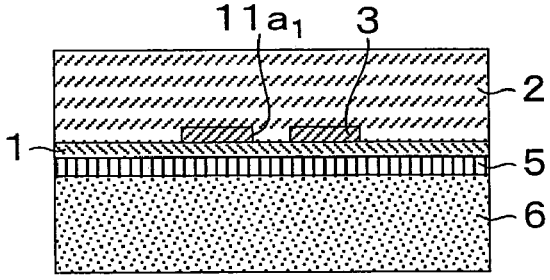
Figure 3:
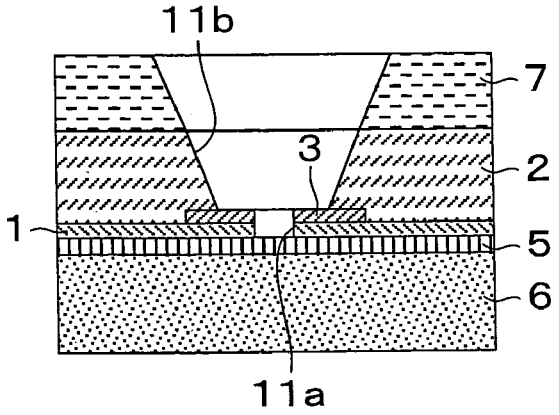
Figure 3:
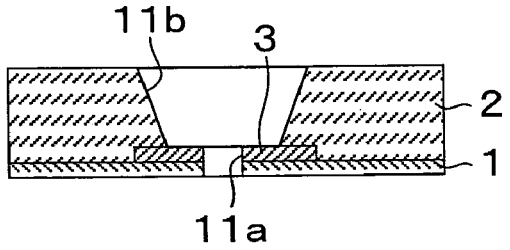
Figure 3:
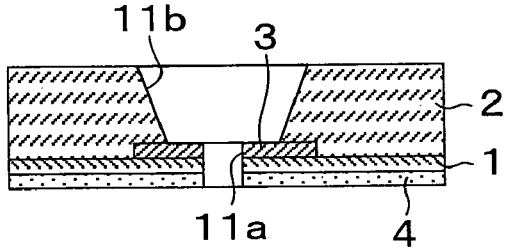
Figure 4:
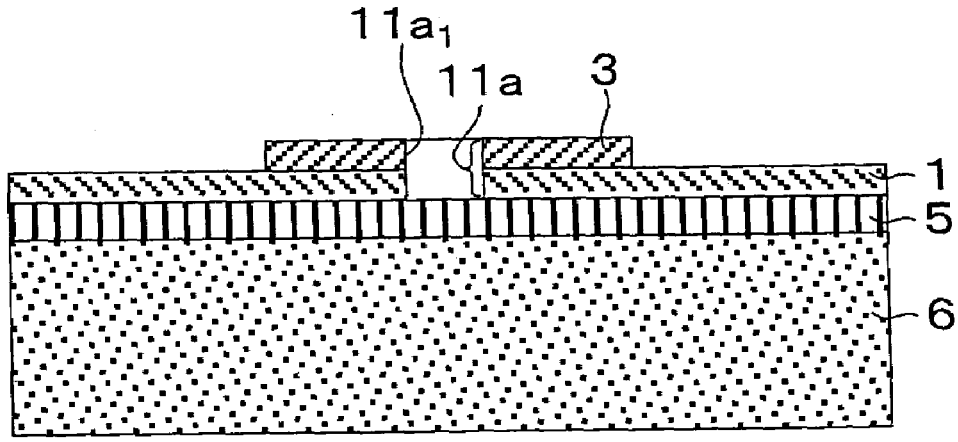
FIG. 4 is a cross section showing a variant example of the manufacturing method of the nozzle plate.

The following will describe a manufacturing method of the nozzle plate of the present embodiment. FIGS. 3(*a*)-3(*g*) show the manufacturing steps of the nozzle plate of the present embodiment. FIG. 4 shows a variant example of the step shown in FIG. 3(*c*).

There is provided a substrate 6 made of Si, glass, and the like, which is used for temporarily maintaining a predetermined thickness. A sacrifice layer 5 is formed on this substrate 6, by wet plating using nickel (see FIG. 3(*a*)). The sacrifice layer 5 is 10 μm thick.

Subsequently, to the sacrifice layer 5, polyimide resin is applied so that a polyimide film 1 μm thick is formed. As a result, the first nozzle layer 1 is formed (first step; FIG. 3(*b*)). The polyimide resin is applied to the sacrifice layer 5 by spin coating, and is heated for 2 hours at 350° C.

On the first nozzle layer 1, the stopper layer 3 is formed (second step; FIG. 3(*c*)). First, using a material mainly comprising titanium, the stopper layer 3 which is 0.5 μm thick (5000 Å) is formed by sputtering. Then the stopper layer 3 is subjected to photolithography, and a resist pattern with a predetermined shape is formed thereon. Then the stopper layer 3 is processed so as to substantially be a square about 20 μm on a side, by means of dry etching using argon ions, e.g. by ion milling. Through the dry etching, one opening 11$a_1$ which is 3 μm in diameter is formed inside the substantial square. This opening 11$a_1$ is a formation pattern of the below-mentioned first nozzle hole 11*a*, and becomes a part of the first nozzle hole 11*a*.

Subsequently, the second nozzle layer 2 20 μm thick is formed on the first nozzle layer 1 and the stopper layer 3 (third step; FIG. 3(*d*)). Being similar to the first nozzle layer 1, the second nozzle layer 2 which is 20 μm thick is formed in such a way that polyimide resin is applied by means of spin coat and a polyimide film 20 μm thick is formed after the heating for 2 hours at 350° C. At this time, the opening 11$a_1$ of the stopper layer 3 is stuffed with the polyimide resin.

Then on the second nozzle layer 2, a resist pattern 7 is formed by photolithography, and dry etching is performed using a gas mainly comprising oxygen. As a result the tapered (truncated-cone-shaped) second nozzle hole 11*b* is formed in the second nozzle layer 2 (fourth step; FIG. 3(*e*)). It is noted that the dry etching does not go beyond the stopper layer 3. that is to say, the dry etching does not proceed at a portion where the stopper layer 3 is exposed, except at the aforesaid opening 11$a_1$.

To cause the second nozzle hole 11*b* to have a tapered shape, the etch rate of the resist pattern 7 is equalized with the etch rate of the polyimide resin of the second nozzle layer 2 at the time of the etching, the resist pattern 7 is made tapered by post-baking the resist pattern 7 for 60 minutes at 150° C., and the tapered shape is transferred to the second nozzle layer 2 by means of etching.

Figure 9:
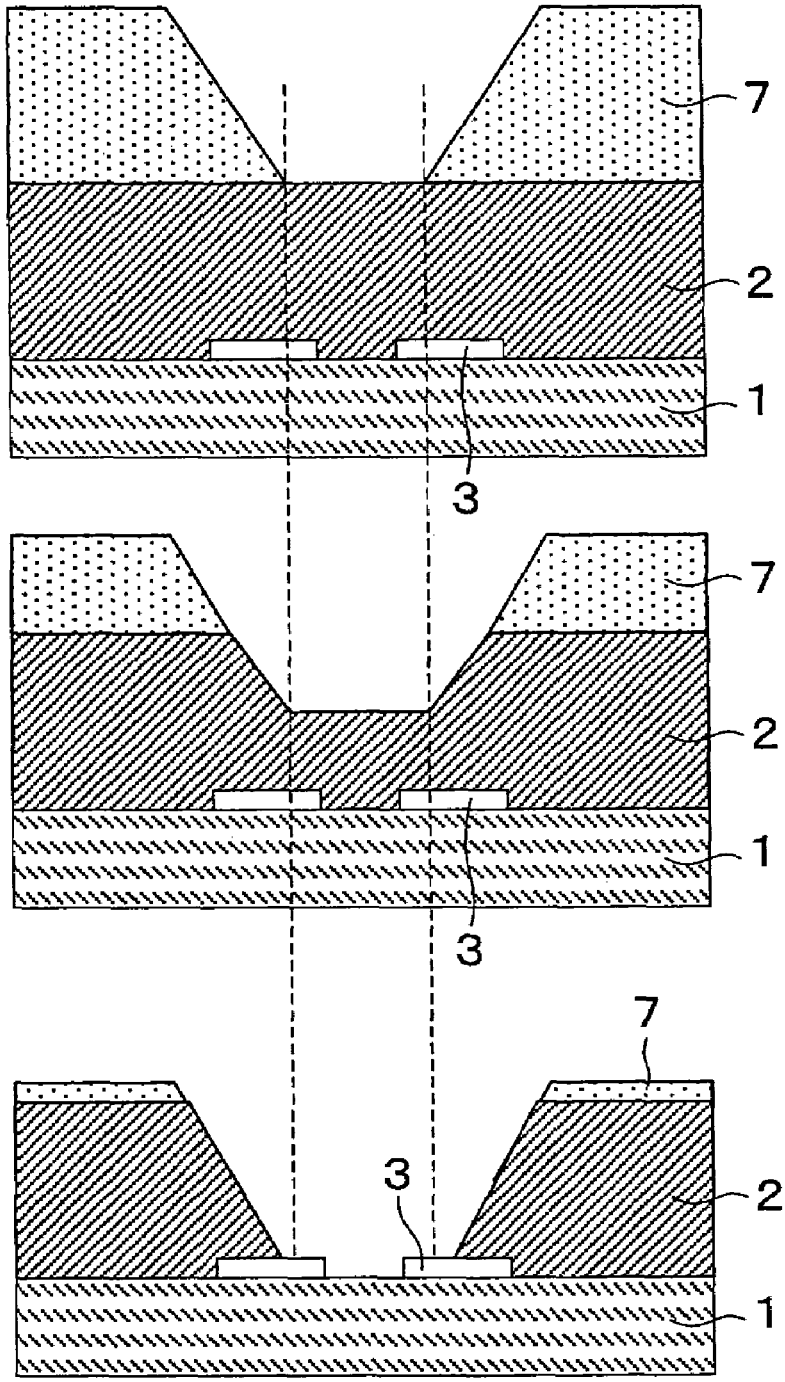
FIG. 9 is a cross section illustrating another manufacturing method of the nozzle plate of Embodiment 1 of the present invention.

That is, as shown in FIG. 9, the resist pattern 7, which has a tapered cross section and has an etch rate substantially identical with that of the polyimide resin (second nozzle layer 2), is formed. Then the resist pattern 7 is etched at the rate identical with the rate of the etching of the polyimide resin, so that the edge portion of the of the resist pattern 7 is widened. The polyimide resin (second nozzle layer 2) is also etched at this time. As a result, the wall (of the second nozzle hole 11*b*) as a result of the etching has a shape identical with that of the initially-formed tapered wall (resist pattern 7) of the resist.

Note that, since the etch rate of the resist pattern 7 is almost identical with the etch rate of the second nozzle layer 2, the resist pattern 7 is preferably thicker than the second nozzle layer 2.

Following the fourth step, the first nozzle hole 11*a* is formed by etching the first nozzle layer 1 (fifth step; see FIG. 3(*e*)). The first nozzle hole 11*a* is processed so as to have a shape (substantially circular shape, 3 μm in diameter) determined by the opening 11$a_1$, of the stopper layer 3, which has been made in the previous step. On this occasion, the stopper layer 3 is scarcely etched by the dry etching, of this step, which is performed using a gas mainly comprising oxygen. Therefore, the pattern formed on the stopper layer 3 scarcely changes and the first nozzle hole 11*a* as a result of the process has a substantially perpendicular shape, as shown in FIG. 3(*e*). In this manner, the first nozzle hole 11*a* is formed with a high precision.

Subsequently, the resist pattern 7 is removed by a resist peeling liquid, and only the sacrifice layer 5 is etched away by dipping into an aqueous solution mainly made of nitric acid and water. As a result, the nozzle plate 8 is detached from the substrate 6 (FIG. 3(*f*)). As described above, the polyimide resin of which the first and second nozzle layers 1 and 2 are made and titanium of which the stopper layer 3 is made are scarcely etched by the etching liquid for the sacrifice layer 5. For this reason, the etching of the sacrifice layer 5 does not change the shape and does not decrease the structural reliability.

Then the liquid repellent film 4 is formed on the surface of the first nozzle layer 1 (FIG. 3(*g*)). In this process, fluoropolymer is used in consideration of the easiness of the application. The fluoropolymer is applied to the surface of the first nozzle layer 1 by stamping or the like, and as a result the liquid repellent film 4 which is a polymer film is formed. As to a part of the liquid repellent film entered inside the first nozzle hole 11*a*, the part is removed after the formation of the liquid repellent film, by performing dry etching from the second nozzle hole 11*b* side, using a plasma including oxygen. This makes it possible to minimize the damage of the nozzle plate 8.

In the present embodiment, the first nozzle hole 11*a* is formed by etching using the stopper layer 3 as a mask. It is therefore possible to form the first nozzle hole 11*a* highly precisely.

Also, at the time of etching the second nozzle layer 2, the etching automatically stops at the stopper layer 3. This makes it possible to define the etching depth of the second nozzle hole 11*b*.

The material of the stopper layer 3 is chosen in consideration of the function as a blocking layer for the etching of the first nozzle hole 11*a* or of the function as a side wall of the first nozzle hole 11*a*. For this reason, the first nozzle hole 11*a* is formed in a highly precise manner. Moreover, since the first nozzle layer 1 or the second nozzle layer is formed so as to be thin, an amount of the first and second nozzle layers 1 and 2 to be etched away is small at the time of etching these layers 1 and 2, and hence the formation error is reduced. It is therefore possible to form the nozzle hole 11 highly precisely.

More specifically, as a result of an evaluation of the shape of each of 200 liquid discharge openings 9 of the nozzle plate 8 made though the steps of the present embodiment, the variation in the shape was very low (±0.2 μm), i.e. the liquid discharge openings 9 were highly precisely formed. Also, the nozzle plate was very flat, as the warpage was not more than 10 μm.

To form the first and second nozzle holes 11*a* and 11*b* by etching, the etching of the stopper layer 3 is performed in one direction. On this account, the first nozzle hole 11*a* is easily aligned with the second nozzle hole 11*b*, as compared to a conventional arrangement in which the etching is performed in two opposing directions.

material soluble in a KOH aqueous solution, and (iii) a material that can be etched by an oxygen plasma, such as polyimide. Also, apart from the plating, the method for forming the sacrifice layer 5 may be vapor deposition, sputtering, coating, or the like, in consideration of the materials.

The material of the first and second nozzle layers 1 and 2 is required to be rarely damaged by the etching of the sacrifice layer 5. The stopper layer 3 is required to be made of a material highly resistant to the etching of the sacrifice layer 5 and the etching of the first and second nozzle holes 11*a* and 11*b*.

Table. 1 shows preferable combinations of the materials (of the sacrifice layer, first nozzle layer, stopper layer, and second nozzle layer) and the methods (for forming the stopper layer, first nozzle hole, and second nozzle hole, and for removing the sacrifice layer).

TABLE 1

| LAYERS | | | |
|---|---|---|---|
| SACRIFICE LAYER | FIRST NOZZLE LAYER | STOPPER LAYER | SECOND NOZZLE LAYER |
| Ni, Al, Cu | POLYIMIDE | Ti, W, Nb, Au, Pt, SiO2, $Si_3N4$, $Al_2O_3$ | POLYIMIDE |
| Ni, Al, Cu | POLYIMIDE | Au, Pt, $Al_2O_3$ | $SiO_2$, Si |
| Ni, Al, Cu | $SiO_2$, Si | Au, Pt, $Al_2O_3$ | POLYIMIDE |
| Ni, Al, Cu | $SiO_2$, Si | Au, Pt, $Al_2O_3$ | $SiO_2$, Si |
| POLYIMIDE | $SiO_2$, Si | AL, Cu, Ni, Fe, Co, $Al_2O_3$ | $SiO_2$, Si |

| METHODS | | | |
|---|---|---|---|
| MANUFACTURING METHOD OF STOPPER LAYER | MANUFACTURING METHOD OF FIRST NOZZLE HOLE | MANUFACTURING METHOD OF SECOND NOZZLE HOLE | REMOVAL OF SACRIFICE LAYER |
| Ar DRY ETCHING | $O_2$ DRY ETCHING | $O_2$ DRY ETCHING | NITRIC ACID |
| Ar DRY ETCHING | $O_2$ DRY ETCHING | $CF_4$ DRY ETCHING OR $SF_6$ DRY ETCHING | NITRIC ACID |
| Ar DRY ETCHING | $CF_4$ DRY ETCHING OR $SF_6$ DRY ETCHING | $O_2$ DRY ETCHING | NITRIC ACID |
| Ar DRY ETCHING | $CF_4$ DRY ETCHING OR $SF_6$ DRY ETCHING | $CF_4$ DRY ETCHING OR $SF_6$ DRY ETCHING | NITRIC ACID |
| Ar DRY ETCHING OR Cl DRY ETCHING | $CF_4$ DRY ETCHING OR $SF_6$ DRY ETCHING | $CF_4$ DRY ETCHING OR $SF_6$ DRY ETCHING | $O_2$ PLASMA ETCHING |

In the steps of forming the first and second nozzle holes 11*a* and 11*b* (i.e. fourth and fifth steps), it is possible to carry out the etching in the fifth step using the etching device and (i) etching liquid or (ii) etching gas, which are used in the fourth step. This makes it possible to simplify the manufacturing process.

In the present embodiment, the sacrifice layer 5 is made of nickel, the first and second nozzle layers 1 and 2 are made of polyimide resin, and the stopper layer 3 is made of titanium, but the combination of the materials is not limited to the above.

Apart from nickel, the material of the sacrifice layer 5 may be chosen from the followings, in consideration of the materials of the first and second nozzle layers 1 and 2 and the stopper layer 3: (i) copper nitrate or aluminum nitrate, (ii) a As shown in Table. 1, the first and second nozzle layers 1 and 2 are not necessarily made of a polymeric organic material such as polyimide resin, and an inorganic silicon compound such as silicon and $SiO_2$ may be used. However, the dry etching of silicon and $SiO_2$ requires a reactive gas including fluorine, but titanium in the present embodiment does not excel in the resistance to such dry etching. For this reason, it is preferable to use a stopper layer 3 made of an etching-resistant material such as gold.

Also, the stopper layer 3 may be made of a material other than titanium, in accordance with the combinations in Table. 1. The material is selected from those described in Table. 1. Note that, titanium of which the stopper layer 3 is made can be etched by a plasma of a mixed gas of $CF_4$ and oxygen. However, the first nozzle layer 1 (polyimide) formed under titanium is etched by the gas plasma, at a speed higher than that of titanium. As a result, the first nozzle layer 1 is greatly damaged. For this reason, the present embodiment adopts dry etching using argon ions, for the patterning of the stopper layer 3. In this manner, the dry etching using argon ions is adopted so that the difference between the etch rate of the stopper layer 3 and the etch rate of the first nozzle layer 1 is small, and hence the patterning of the stopper layer 3 is carried out while the damage of the first nozzle layer 1 is minimized.

In the second step, the stopper layer 3 is formed so as to have a square shape. The present invention, however, is not limited to this. The shape and size of the stopper layer 3 may be optionally determined on condition that, at the time of forming the second nozzle hole 11*b*, the second nozzle hole 11*b* reaches the stopper layer 3 and the etching cannot proceed beyond the stopper layer 3. It is preferable that the shape and size of the stopper layer 3 is suitable for maximally restraining the warpage of the nozzle plate 8 on account of the stress from the stopper layer 3. As to the size of the stopper layer 3, the size is preferably as small as possible.

In the second step, (i) the determination of the shape of the stopper layer 3 and (ii) the formation of the opening 11$a_1$ that functions as the formation pattern of the first nozzle hole 11*a* are carried out at the same time. Alternatively, these two processes (i) and (ii) may be carried out as two etching steps. In the meanwhile, in the second step, the first nozzle hole 11*a* may be processed at the time of forming the nozzle hole processing pattern (stopper layer 3 which has the opening 11$a_1$), as shown in FIG. 4. In such a case, the opening 11$a_1$ which has been formed is stuffed at the time of forming the second nozzle layer 2 (third step). For this reason, the opening 11$a_1$ is formed again in the fifth step.

In the fourth step, it is possible to form a second nozzle hole 11*b* whose side wall is bulged (curved) as shown in FIGS. 8(*a*)-8(*c*), by adjusting the material of the mask and the etching conditions at the time of processing the second nozzle hole 11*b*.

That is, a mask 13 made of $SiO_2$, which is highly resistant to oxygen plasma etching, is formed on the second nozzle layer 2 (see FIG. 8(*a*)), and the oxygen plasma etching is carried out with a high gas pressure (e.g. 500 mTorr) (see FIG. 8(*b*)). As a result, undercut is carried out below the mask 13, so that a bulged tapered part is formed (see FIG. 8(*c*)).

However, if the etching is excessively performed, the diameter d of the second nozzle hole 11*b* becomes wide at the connecting part between the second nozzle hole 11*b* and the stopper layer 3, so that a large stopper layer 3 is required. For this reason, it is preferable to suitably control the etching.

The liquid repellent film 4 is not necessarily made of fluoropolymer. The material of the liquid repellent film 4 may be silicon polymer film, DLC (Diamond-Like Carbon), or the like.

According to the manufacturing steps above, the first nozzle hole 11*a* is processed by highly-selective processing means with the use of, as a mask, the stopper layer 3 which has the opening 11$a_1$. For this reason, the change in the opening 11$a_1$ is small during the processing, and the variation in the shape of the first nozzle hole 11*a*, on account of excessive etching, variation in the thickness of the first nozzle layer 1, or the like, is small. It is therefore possible to perform the processing highly precisely in terms of the shape and with good reproducibility.

Since the second nozzle hole 11*b* is processed by the processing means which is highly selective to the stopper layer 3, the processing of the second nozzle hole 11*b* is stopped at the stopper layer 3, in a highly reproducible manner. On this account, the processing accuracy of the second nozzle hole 11*b* rarely influences on the processing accuracy of the first nozzle hole 11*a*, and hence it is possible to stably manufacture thick nozzle plates 8 in each of which the liquid discharge opening 9 is precisely formed.

Embodiment 2

The following will describe Embodiment 2 of the present invention in reference to figures.

(Nozzle Plate)

Figure 5:
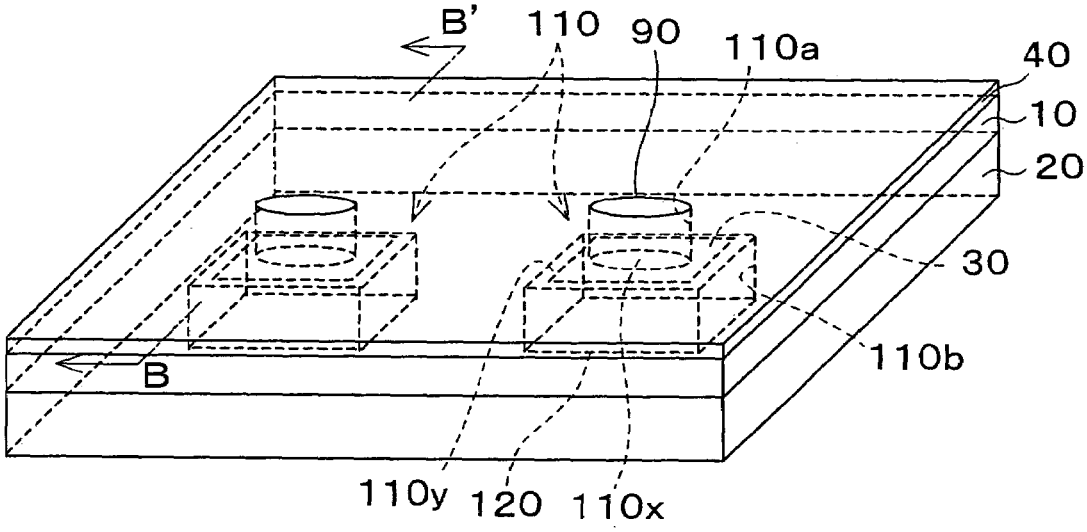
FIG. 5(*a*) is an oblique perspective view of a nozzle plate of Embodiment 2 of the present invention.
Figure 5:
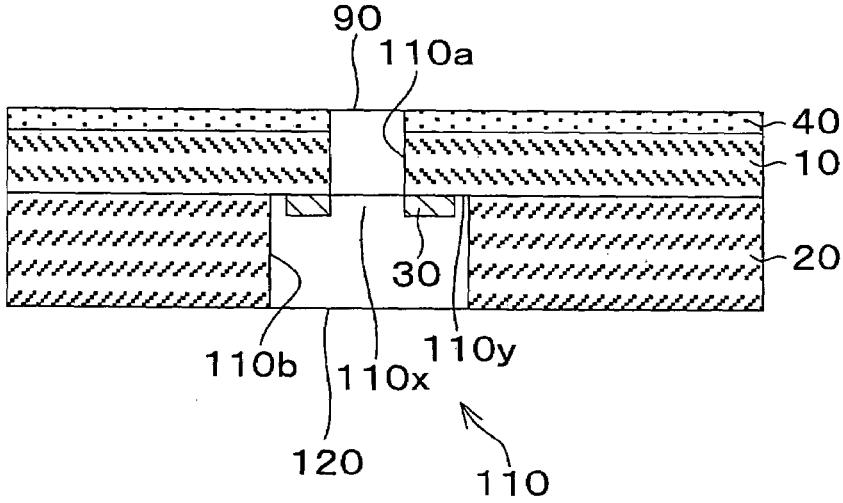

FIG. 5(*a*) is an oblique perspective view of a part of a nozzle plate of the present invention, which is used in a minute dot formation device. FIG. 5(*b*) is a cross section which is taken along a B-B' line of FIG. 5(*a*). The nozzle plate has one or more liquid (liquid substance) discharge opening 90. In FIG. 5(*b*), there are two liquid discharge openings 90.

As shown in FIG. 5(*a*), the nozzle plate 80 includes a nozzle layer 10, a stopper layer 30 (blocking layer), a reinforcing plate 20, and a nozzle hole 110. On the liquid discharging side of the nozzle layer 10, a liquid repellent film 40 is formed. On the other side, the reinforcing plate 20 is provided. The stopper layer 30 is provided between the nozzle layer 10 and the reinforcing plate 20, and is locally formed at the position where the first nozzle hole 110*a* is formed. The opening of this first nozzle hole 110*a* is the liquid discharge opening 90. In other words, the first nozzle hole 110*a* penetrates the liquid repellent film 40 and the nozzle layer 10, and also penetrates the center of the locally-formed stopper layer 30.

The rectangular-parallelepiped second nozzle hole 110*b* penetrates the reinforcing plate 20, and this reinforcing plate 20 and the cylindrical first nozzle hole 110*a* constitute the nozzle hole 110.

The stopper layer 30 between the nozzle layer 10 and the reinforcing plate 20 is inside the second nozzle hole 110*b*, (i.e. inside the aperture). On this account, the (substantially-square) bottom of the second nozzle hole 110*b*, i.e. the opening of the second nozzle 110*b* functions as a liquid supply opening 120. The contact face (substantially square with a hole) between the nozzle layer 10 and the stopper layer 30 locates inside the (substantially square shaped) bottom face 110*y* which functions as the far wall of the second nozzle hole 110*b*. Inside (at the center) of the contact face, a (substantially circular) connecting part 110*x* of the first and second nozzle holes 110*a* and 110*b* is provided.

In the present embodiment, the nozzle layer 10 is made up of a polyimide film 1 μm thick.

The stopper layer 30 is made of a metal material mainly comprising titanium, and has a substantially square shape about 10 μm on a side, in order to restrain the warpage on account of the overall stress of the nozzle plate 80.

The diameter of the opening (liquid discharge opening 90) of the first nozzle hole 110*a* is 3 μm.

The liquid repellent film 40 is made of a polymeric material including fluoropolymer.

The reinforcing plate 20 is made up of 50 μm-thick silicon. The opening (liquid supply opening 120) of the aforesaid substantially-square second nozzle hole 110*b* is 30 μm on a side.

In the present embodiment, the stopper layer 30 is only required to function as a blocking layer at the time of etching the first nozzle hole 110*a* as stated below. For this reason, the stopper layer 30 is provided inside the second nozzle hole 110*b*, and is small in size.

In this manner, the contact face between the nozzle layer 10 and the stopper layer 30 is minimized in size. Also, the contact face between the reinforcing plate 20 and the stopper layer 30 is eliminated. For these reasons, the stress on account of the difference of linear expansion coefficients between (i) the nozzle layer 10 and the reinforcing plate 20 and (ii) the stopper layer 30 is significantly restrained as compared to the conventional arrangement and Embodiment 1. It is therefore possible to prevent the nozzle plate 80 from being greatly warped.

The material of the nozzle layer 10 is not limited to polyimide. The material may be (i) a polymeric organic material other than polyimide, (ii) a silicon compound material such as $SiO_2$ and $Si_3N_4$, or (iii) silicon.

Also, the material of the stopper layer 30 is not limited to the metal material mainly comprising titanium, either. The material of the stopper layer 30 may be optionally determined on condition that the material is highly resistant to the etching of the nozzle layer 10 and the etching of the sacrifice layer 50. That is, the material is required to be highly resistant to a plasma including oxygen, a plasma including fluorine, nitric acid, an aqueous solution of potassium hydroxide, or the like. Specific examples of the material are: a metal material mainly comprising Ti, Al, Cu, Au, Pt, Ta, W, Nb, $SiO_2$, $Al_2O_3$, $Si_3N_4$, or the like; an inorganic oxide material; an inorganic nitride material; or the like.

The reinforcing plate 20 is not necessarily made of Si. The reinforcing late 20 may be made of a silicon compound material such as $SiO_2$ and $Si_3N_4$.

Since the shape of the stopper layer 30 can be optionally determined as long as the stopper layer 30 is locally provided at the position where the nozzle hole 110 is formed, the stopper layer 30 does not necessarily have a substantially square shape. For example, the shape of the stopper layer 30 may be circular. The circular shape is preferable because it has the highest isotropy and hence the reduction of the stress is isotropic. As shown in FIG. 5(*a*), in the present embodiment, one nozzle hole 110 is formed in one stopper layer 30. The present invention is not limited to this arrangement, so that a plurality of nozzle holes 110 may be formed in one stopper layer 3, as long as the stress is restrained as compared to the conventional arrangement.

The second nozzle hole 110*b* of the reinforcing plate 20 does not necessarily have a rectangular parallelepiped shape (i.e. square shape in cross section). The second nozzle hole 110*b* may be cylindrical or tapered (i.e. shaped like a truncated cone).

As described above, the nozzle plate includes the nozzle layer 10, the stopper layer 30, and the reinforcing plate 20. On this account, the following effects are obtained.

The shape of the liquid discharge opening 90 depends on the processing accuracy of the nozzle layer 10 1 μm thick. For this reason, it is possible to improve the accuracy of the shape of the liquid discharge opening 120.

The rigidity of the nozzle plate 80 is maintained by the reinforcing plate 20. This improves the overall rigidity of the nozzle plate 80, and the handling of the nozzle plate 80 is easy.

Since the size of the stopper layer 30 is small, the warpage of the nozzle plate 80 on account of the stress is restrained.

Since the thickness of the nozzle plate 80 is minimized, the liquid inflow opening 120 of the nozzle plate 80 is small. For this reason, the concentration of the nozzle holes 110 is increased. This makes it possible to draw a high-resolution image.

The stopper layer 30 is processed so as to have a predetermined shape of minimum required, without being influenced by the shape of the second nozzle hole 110*b* of the reinforcing plate 20. It is therefore possible to restrain the warpage of the nozzle plate 80, which is caused by the difference in expansion coefficients.

In the nozzle plate 80, the stopper layer 30 is thinner than the nozzle layer 10. On this account, the etching of the stopper layer 30 is precisely performed as compared to a case where the nozzle layer 10 is directly subjected to photolithography without using the stopper layer 30. Also, since the nozzle layer 10 is processed using the stopper layer 30 as a mask and by a highly-selective processing method, it is possible to highly precisely form the first nozzle hole 110*a* that controls the size of discharged droplets.

(Manufacturing Method of Nozzle Plate)

Figure 6:
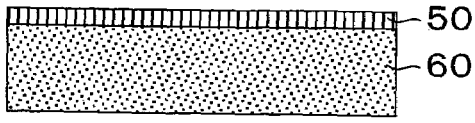
FIGS. 6(*a*)-6(*g*) are cross sections illustrating a manufacturing method of the nozzle plate of Embodiment 2 of the present invention.
Figure 6:
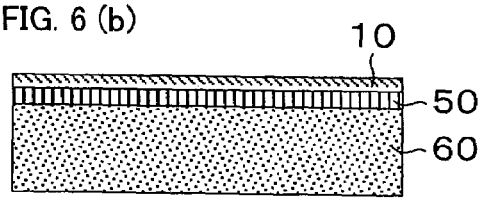
Figure 6:
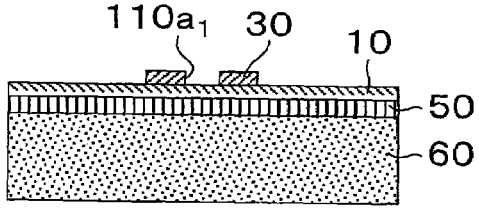
Figure 6:
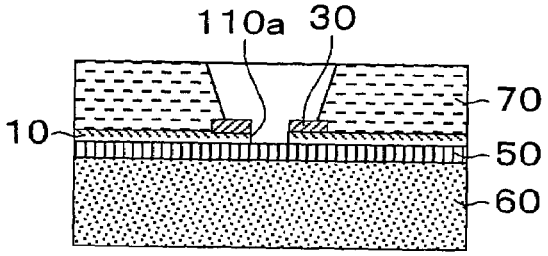
Figure 6:
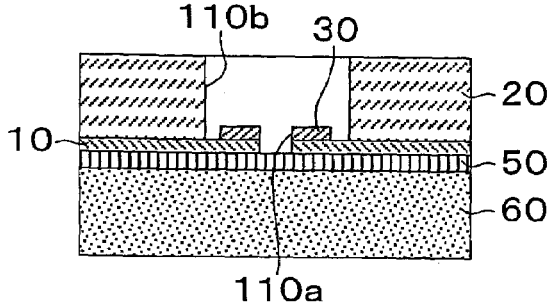
Figure 6:
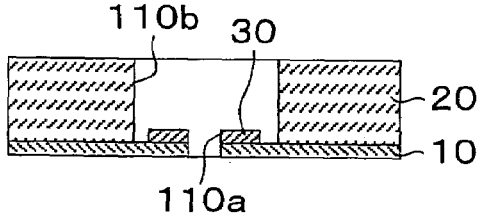
Figure 6:
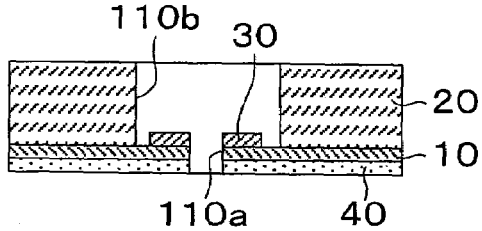

FIGS. 6(*a*)-6(*g*) show the manufacturing steps of the nozzle plate of the present embodiment. In reference to these figures, the following will describe a manufacturing method of the nozzle plate of the present embodiment.

There is provided a substrate 60 made of Si, glass, and the like, which is used for temporarily maintaining a predetermined thickness. A sacrifice layer 50 is formed on this substrate 60, by wet plating using Ni (see FIG. 6(*a*)). The sacrifice layer 50 is 10 μm thick.

Subsequently, to the sacrifice layer 50, polyimide resin is applied so that a polyimide film 1 μm thick is formed, As a result, the nozzle layer 10 is formed (FIG. 6(*b*)). The polyimide resin is applied to the sacrifice layer 50 by spin coating, and is heated for 2 hours at 350° C.

On the nozzle layer 10, the stopper layer 30 (blocking layer) is formed (FIG. 6(*c*)). First, using a material mainly comprising titanium, the stopper layer 30 which is 5000 Å thick is formed by sputtering. Then the stopper layer 30 is subjected to photolithography, and a resist pattern with a predetermined shape is formed thereon. Then the stopper layer 30 is processed so as to substantially have a square shape about 10 μm on a side, by means of dry etching using argon ions, e.g. by ion milling. Through the dry etching, one opening $\mathbf{110}a_1$ 3 μm in diameter is formed inside the substantial square. This opening $\mathbf{110}a_1$ is a formation pattern of the below-mentioned first nozzle hole 110*a*, and becomes a part of the first nozzle hole 110*a*.

Then a resist pattern 70 is formed. This resist pattern 70 has a pattern that corresponds to the opening $\mathbf{110}a_1$ of the stopper layer 30. That is, the resist pattern 70 is formed in such a manner that the opening 70*a* of the resist pattern 70 is overlapped with the opening $\mathbf{110}a_1$ of the stopper layer 30. Thereafter the nozzle layer 10 is etched through the opening $\mathbf{110}a_1$, using the stopper layer 30 as a mask. As a result, the first nozzle hole 110*a* is formed. The etching is dry etching using a gas mainly comprising oxygen (FIG. 6(*d*)).

Subsequently, the resist 70 is removed using a peeling liquid or the like. In this step, the stopper layer 30 is rarely etched by the dry etching using the gas mainly comprising oxygen. For this reason, the pattern formed on the stopper layer 30 scarcely changes, and hence the first nozzle hole 110*a* is processed in a substantially vertical manner as shown in FIG. 6(*d*).

Therefore, the change of the shape as a result of excessive etching does not occur, so that the first nozzle hole 110*a* is formed with an extremely high processing accuracy (±0.1 μm, which is close to the pattering accuracy in the case of photolithography). The resist 70 is preferably thicker than the nozzle layer 10. In the present embodiment, the resist 70 is 2 μm thick.

Subsequently, the reinforcing plate 20, which has the second nozzle hole 110*b* that is a rectangular parallelepiped 15 μm on a side, is bonded in such a manner that the stopper layer 30 is placed inside the second nozzle hole 110*b* (see FIG.

6(*e*)). In this case, the bonding surface between the members (nozzle layer 10 and reinforcing plate 20) is observed by a camera or the like, the members are moved for predetermined distances from the positions of the observation, and the members are mechanically joined with one another.

Figure 10:
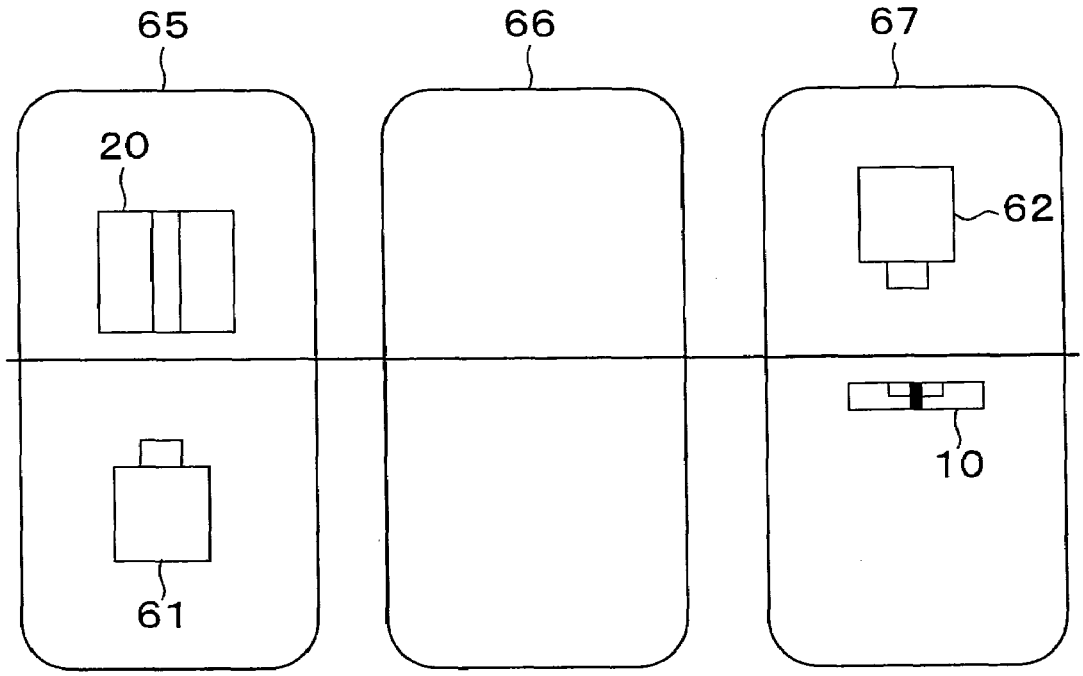
FIGS. 10(*a*) and 10(*b*) are schematic views illustrating how a nozzle layer is joined with the reinforcing plate.
Figure 10:
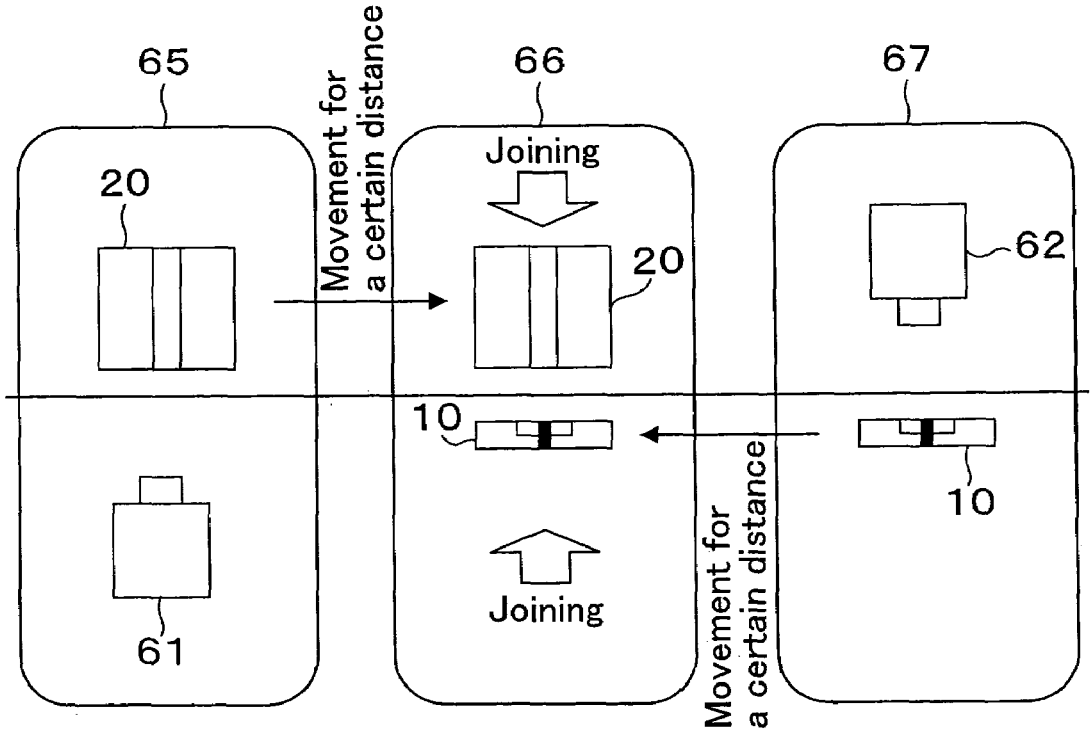

FIG. 10(*a*) shows the alignment (alignment phase) in the aforesaid method. FIG. 10(*b*) shows the bonding (bonding phase).

First, as shown in FIG. 10(*a*), in a reinforcing plate position measuring area 65, the bonding surface of the reinforcing plate 20 is observed using a camera 61, and the outline pattern of the second nozzle hole 110*b* is measured. In a similar manner, in a nozzle layer position measuring area 67, the bonding surface of the nozzle layer 10 is observed using a camera 62, and the outline pattern of the stopper layer 30 is measured.

Subsequently, as shown in FIG. 10(*b*), suitable moving distances of the nozzle layer 10 and the reinforcing plate 20 are worked out based on the measurement results. In accordance with the suitable moving distances thus worked out, the nozzle layer 10 and the reinforcing plate 20 are moved to suitable positions in a bonding surface area 66 (alignment phase).

In the bonding surface area 66, the bonding surfaces are vertically compression-bonded with each other, without observing the surfaces in real time. As a result, the reinforcing plate 20 is bonded with the nozzle layer 10.

In the present case, the reinforcing plate 20 is made of silicon, and the adhesive is epoxy-type having a high chemical resistance. The adhesive is preferably hardened at room temperatures, in order to prevent the warpage of the nozzle plate 80, which is caused by the difference of linear expansion coefficients between (i) the adhesive and (ii) the nozzle layer 10 or the reinforcing plate 20.

Thereafter the nozzle plate 80 is dipped into an aqueous solution predominantly made of nitric acid and water, so that only the sacrifice layer 50 is etched away. As a result, the nozzle plate 80 is detached from the substrate 60 (see FIG. 6(*f*)). At this time, polyimide resin of which the nozzle layer 10 is made, titanium of which the stopper layer 30 is made, and silicon of which the reinforcing plate 20 is made are rarely etched by the etchant for the sacrifice layer 50. For this reason, the etching of the sacrifice layer 50 does not induce the change in the shape and the decrease in the structural reliability.

Then the liquid repellent film 40 is formed on the surface of the nozzle layer 10 (FIG. 6(*g*)). Taking into consideration of the easiness of application, fluoropolymer is applied to the surface nozzle 10 by stamping or the like, and the liquid repellent film 40 as a polymer film is formed. As to a part of the liquid repellent film 40 entered into the first nozzle hole 110*a*, the part is removed after the formation of the liquid repellent film 40, by performing dry etching from the second nozzle hole 110*b* side, using a plasma including oxygen. This makes it possible to minimize the damage of the nozzle plate 80.

Figure 7:
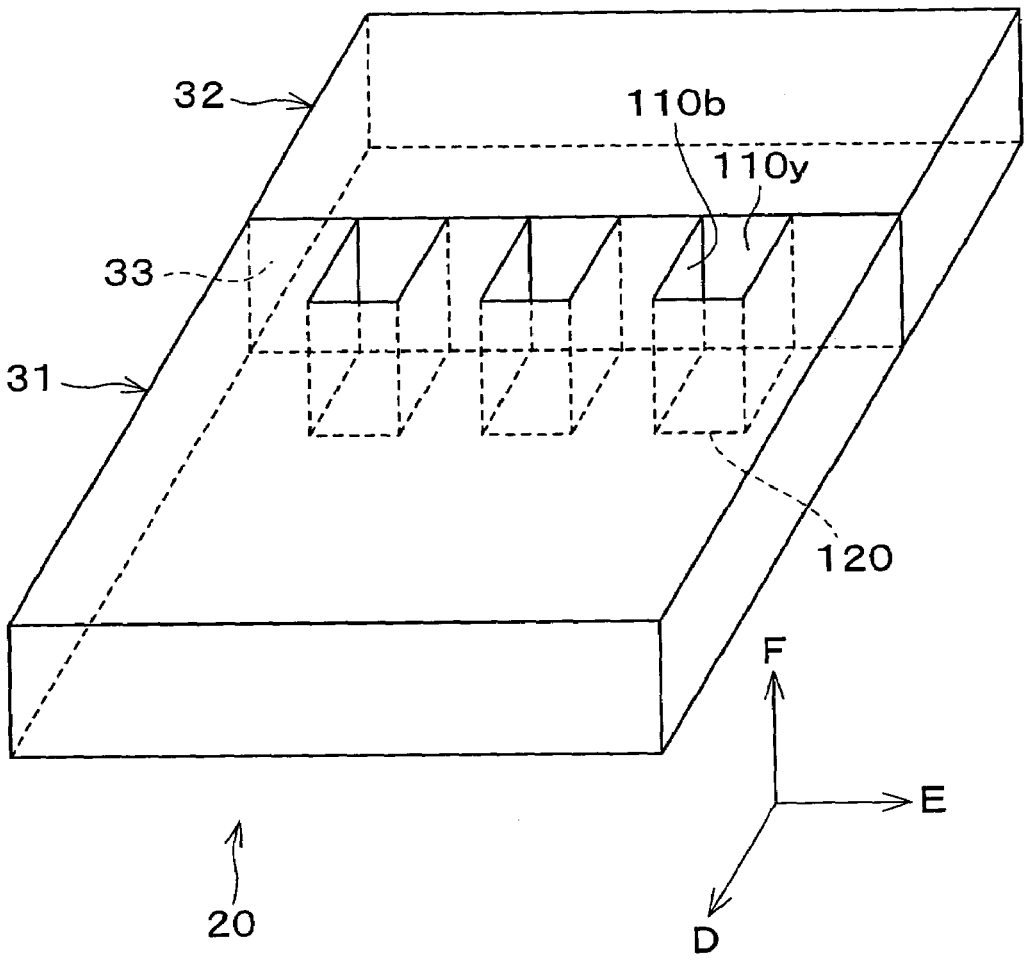
FIG. 7 is an oblique perspective view of a reinforcing plate of Embodiment 2.

A manufacturing method of the reinforcing plate 20 is briefly explained in reference to FIG. 7.

First, in a silicon substrate 31 which is 200 μm thick, pits each of which is 15 μm wide, 15 μm deep, and extends in a direction D in the figure are formed by a dicing device, at predetermined intervals. The pits function as second nozzle holes 110*b*. Subsequently, in the direction D, a silicon substrate 32 which is 100 μm thick is bonded, using an epoxy adhesive, with a surface 33 of the silicon substrate 32 which surface has the pits. Then the bonded substrates are cut by the dicing device, in the direction orthogonal to the pits (i.e. in the direction D). As a result, along an E direction in the figure, a plurality of reinforcing plates 20 each of which is 50 μm thick in the F direction are produced. Each reinforcing plate 20 has one second nozzle hole 110*b* (a substantially square shaped and 15 μm on a side, on cross section).

The above-described method is only an example of the manufacturing method of the reinforcing plate 20. For example, it is possible to manufacture a reinforcing plate 20 that has such an arrangement that plural rows of the second nozzle holes 110*b* (a substantially square shaped and 15 μm on a side, on cross section) are aligned in the D direction. in each row, the second nozzle holes 110*b* are aligned in the E direction. In this case, a plurality of silicon substrates 31 having pits are required. Alternatively, it is possible to form hound's-tooth-patterned second nozzle holes 110*b*, by using a plurality of silicon substrates 31 with pits and adjusting the locations of the pits and the position of the bonding.

In the present embodiment, the stopper layer 30 is only required to be large enough to allow the stopper layer 30 to function as a blocking layer (mask) at the time of etching the first nozzle hole 110*a*. On this account, the stopper layer 30 is smaller than the stopper layer 30 of Embodiment 1.

Since the reinforcing plate 20 and the nozzle layer 10 are independently formed, it is possible to stably manufacture the nozzle plates 80 in a simple manner.

As a result of an evaluation of the shape of each of 200 liquid discharge openings 90 of the nozzle plate 8 made though the steps of the present embodiment, the variation in the shape was very low (±0.2 μm), i.e. the liquid discharge openings 90 were highly precisely formed. Also, the nozzle plate was very flat, as the warpage was not more than 5 μm.

In the present embodiment, the sacrifice layer 50 is made of nickel, the nozzle layer 10 is made of polyimide resin, the reinforcing plate 20 is made of silicon, and the stopper layer 3 is made of titanium, but the combination of the materials is not limited to the above.

Apart from nickel, the material of the sacrifice layer 50 may be chosen from the followings, in consideration of the materials of the nozzle layer 10, the reinforcing plate 20, and the stopper layer 30: (i) copper nitrate or aluminum nitrate, (ii) a material soluble in a KOH aqueous solution, and (iii) a material that can be etched by an oxygen plasma, such as polyimide. Also, apart from the plating, the method for forming the sacrifice layer 50 may be vapor deposition, sputtering, coating, or the like, in consideration of the materials.

The material of the nozzle layers 10 and the reinforcing plate 20 is required to be rarely damaged by the etching of the sacrifice layer 50. The stopper layer 30 is required to be made of a material highly resistant to the etching of the sacrifice layer 50 and the etching of the first nozzle hole 110*a*.

Table. 2 shows preferable combinations of the materials (of the sacrifice layer, nozzle layer, stopper layer, and reinforcing plate) and the methods (for forming the stopper layer and first nozzle hole, and for removing the sacrifice layer).

TABLE 2

| LAYERS | | | |
|---|---|---|---|
| SACRIFICE LAYER | NOZZLE LAYER | STOPPER LAYER | REINFORCING PLATE |
| Ni, Al, Cu | POLYIMIDE | Ti, W, Nb, Au, Pt, SiO2, Si3N4, Al2O3 | Si, GLASS, CERAMICS, POLYIMIDE |
| Ni, Al, Cu | SiO2 | Au, Pt, Al2O3 | Si, GLASS CERAMICS, POLYIMIDE |

TABLE 2-continued

| | | | |
|---|---|---|---|
| POLYIMIDE | SiO2 | Al, Cu, Ni, Fe, Co, Al2O3 | Si, GLASS, CERAMICS |
| POLYIMIDE | Si | Al, Cu, Ni, Fe, Co, Al2O3 | Si, GLASS, CERAMICS |

METHODS

| MANUFACTURING METHOD OF STOPPER LAYER | MANUFACTURING METHOD OF FIRST NOZZLE HOLE | REMOVAL OF SACRIFICE LAYER |
|---|---|---|
| Ar DRY ETCHING | O2 DRY ETCHING | NITRIC ACID |
| Ar DRY ETCHING | O2 DRY ETCHING | NITRIC ACID |
| Ar DRY ETCHING OR Cl DRY ETCHING | CF4 DRY ETCHING | O2 PLASMA ETCHING |
| Ar DRY ETCHING OR Cl DRY ETCHING | SF6 DRY ETCHING | O2 PLASMA ETCHING |

As shown in Table. 2, the material of the nozzle layer 10 is not limited to a polymeric organic material such as polyimide resin. The nozzle layer 10 may be made of an inorganic silicon compound such as silicon and $SiO_2$. Also, the material of the reinforcing plate 20 is not limited to silicon. The reinforcing plate 20 may be made of ceramic mainly comprising glass, $Al_2O_3$ or the like, or polyimide resin.

The material of the stopper layer 30, which is titanium, can also be etched by a plasma of a mixed gas of $CF_4$ and oxygen. However, the nozzle layer 10 (polyimide) formed under titanium is etched by the gas plasma, at a speed higher than that of titanium. As a result, the nozzle layer 10 is greatly damaged. For this reason, the present embodiment adopts dry etching using argon ions, for the patterning of the stopper layer 30. In this manner, the dry etching using argon ions is adopted so that the difference between the etch rate of the stopper layer 30 and the etch rate of the nozzle layer 10 is small, and hence the patterning of the stopper layer 30 is carried out while the damage of the nozzle layer 10 is minimized.

The liquid repellent film 40 is not necessarily made of fluoropolymer. The material of the film 40 may be silicon polymer film, DLC (Diamond-Like Carbon), or the like.

In the present embodiment, the reinforcing plate 20 is merely a silicon plate with the second nozzle hole 110*b*. Alternatively, it is possible to provide a droplet discharge mechanism and droplet discharge signal transmission means on the reinforcing plate 20, by changing the thickness of the reinforcing plate 20.

According to the above-described manufacturing steps, the shape of the liquid discharge opening 90 is determined by the processing accuracy of the nozzle layer 10 which is 1 μm thick. On this account, the accuracy of the shape of the liquid discharge opening 90 is improved.

The rigidity of the nozzle plate 80 is maintained by the reinforcing plate 20. On account of this, the overall rigidity of the nozzle plate 80 is improved, and the handling thereof is easy.

Since the size of the stopper layer 30 is small, it is possible to restrain the warpage of the nozzle plate 80 on account of the stress.

Since the thickness of the nozzle plate 80 is minimum, the size of the liquid inflow opening 120 of the nozzle plate 80 is reduced. For this reason, the concentration of the nozzle holes 110 is increased, so that a high-resolution image can be drawn.

Also, the nozzle plates 80 are stably manufactured without difficulties.

In the nozzle plate 8 (80) of the embodiments above, the stopper layer 3 (30) is thinner than the first nozzle layer 1 (nozzle layer 10).

In this nozzle plate 8 (80), the stopper layer 3 (30) is thinner than the first nozzle layer 1 (nozzle layer 10). On this account, the etching of the stopper layer 3 (30) by means of photolithography is precisely carried out as compared to a case where the first nozzle layer 1 (nozzle layer 10) is directly subjected to photolithography without using the stopper layer 3 (30). Moreover, using the stopper layer 3 (30) as a mask, the first nozzle layer 1 (nozzle layer 10) is processed by a processing method with a high etching selectivity. It is therefore possible to highly precisely form the first nozzle hole 11*a* (110*a*) that controls the size of discharged droplets.

In the nozzle plate 8 of the embodiments above, the first nozzle layer or the second nozzle layer 2 is made of a material which is selected from the group comprising a polymeric organic material, silicon, and an inorganic silicon compound, and the stopper layer 3 is made of a material highly resistant to the means for processing the first nozzle layer 1 or the second nozzle layer 2.

The above-described nozzle plate 8 is arranged such that the first nozzle hole 11*a* formed in the first nozzle layer 1 penetrates the stopper layer 3. The precision of the shape of the first nozzle hole 11 is therefore high. Also, since the second nozzle hole 11*b* formed in the second nozzle layer 2 does not penetrate the stopper layer 3, the thickness of the first nozzle layer 1 is uniform, and there is no variation in the flow resistance.

The manufacturing method of the nozzle plate 8 (80) of the embodiments above may comprise the steps of: (i) joining the first nozzle layer 1 (nozzle layer 10); (ii) forming the stopper layer 3 (30) on the first nozzle layer 1 (nozzle layer 10); (iii) forming an opening on the stopper layer 3 (30); (iv) forming the first nozzle hole 11*a* (110*a*), using the stopper layer 3 (30) with the opening; and (v) detaching the first nozzle layer 1 (nozzle layer 10) from the supporting substrate.

According to the manufacturing method of the aforesaid nozzle plate 8 (80), the first nozzle layer 1 (nozzle layer 10) is supported by the supporting substrate at the time of forming the opening on the stopper layer 3 (30) that functions as a mask for the first nozzle hole 11*a* (110*a*). For this reason, the opening is precisely formed, and hence the first nozzle hole 11*a* (110*a*) which is processed through the opening is highly precisely formed.

In the manufacturing method of the nozzle plate of the above-described embodiments, the first nozzle hole 11*a* or the second nozzle hole 11*b* is formed by dry etching.

According to the manufacturing method of the aforesaid nozzle plate 8, the first nozzle hole 1*a* or the second nozzle hole 11*b* is processed by highly-anisotropic etching. It is therefore possible to process the first nozzle hole 11*a* or the second nozzle hole 11*b*, with a high processing accuracy.

In all of the embodiments above, the blocking layer is capable of functioning as droplet discharge signal transmission means.

The nozzle plate of the present invention can be used for any one of the following inkjet methods: bubble jet (registered trademark), piezoelectric discharge, and electrostatic discharge.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

Embodiment 3

Embodiment 3 of the present invention is described below with reference to the attached drawings.

(Nozzle Plate)

Figure 11:
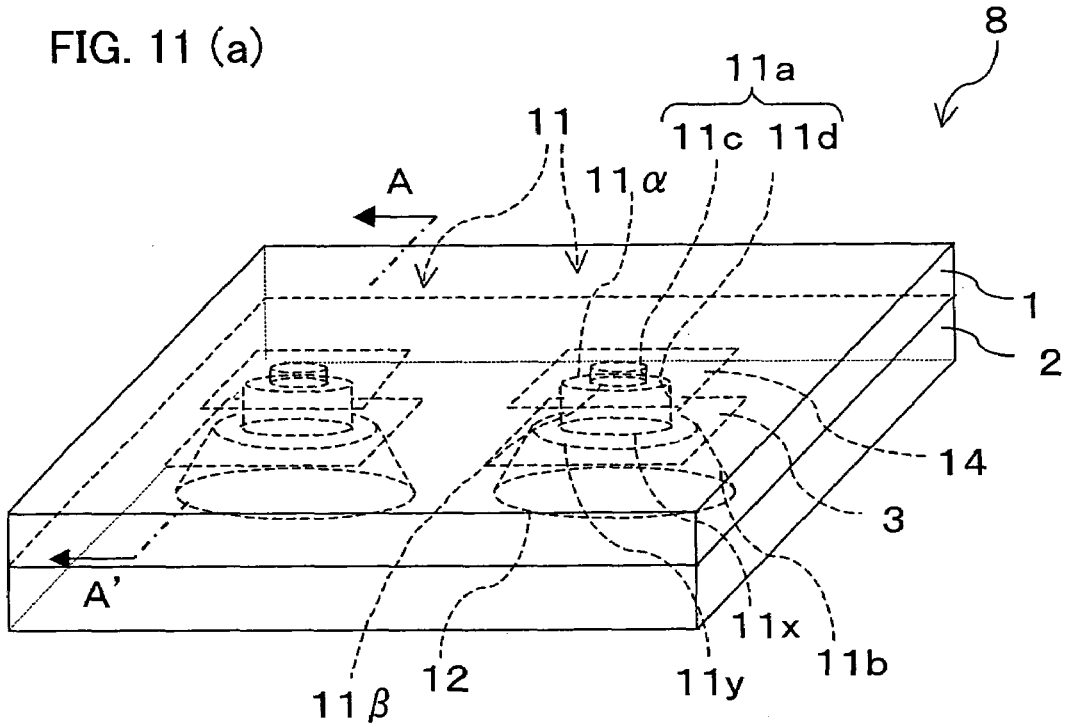
FIG. 11(*a*) is an oblique perspective view of a nozzle plate of Embodiment 3 of the present invention.
Figure 11:
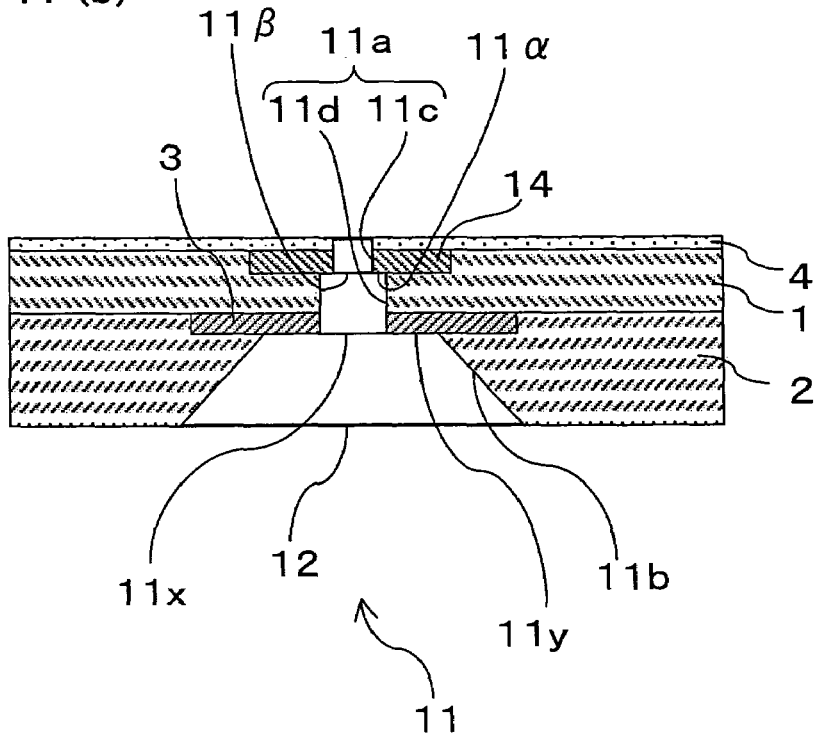

FIG. 11(*a*) is an oblique perspective view of a part of a nozzle plate of the present invention, which is used in a minute dot formation device. FIG. 11(*b*) is a cross section which is taken along a line A-A' of FIG. 11(*a*). On the nozzle plate 8, at least one liquid substance discharge opening (opening and first opening) (hereinafter referred to as discharge opening) 11*c* is formed. In FIG. 11(*a*), there are two discharge openings 11*c*.

As illustrated in FIGS. 11(*a*) and 11(*b*), the nozzle plate 8 includes: a first nozzle layer 1 having a liquid repellent film 4 on the liquid substance discharging side; and a second nozzle layer 2 on the liquid substance supplying side. The first nozzle layer 1 includes a discharge layer 14. The second nozzle layer 2 includes a stopper layer 3 (blocking layer). The nozzle plate 8 further includes a nozzle hole 11 which is provided so as to penetrate the aforesaid members (i.e. liquid repellent film 4, discharge layer 14, first nozzle layer 1, stopper layer 3, and second nozzle layer 2).

More specifically, the liquid repellent film 4 is formed on the liquid substance discharging side of the nozzle plate 8, and the first nozzle layer 1 is formed so as to be in touch with the liquid repellent film 4. The discharge layer 14 is locally formed in the first nozzle layer 1, and a surface of the first nozzle layer 1 facing the liquid repellent film 4 is flush with a surface of the discharge layer 14 facing the liquid repellent film 4. The second nozzle layer 2 has one surface being formed so as to be in touch with a surface of the first nozzle layer 1 which is opposite to the surface of the first nozzle layer 1 where the liquid repellent film 4 is formed. The stopper layer 3 is locally formed in the second nozzle layer 2 and has one surface being formed so as to be in touch with the first nozzle layer 1.

The nozzle hole 11, which penetrates the liquid repellent film 4, the discharge layer 14, the first nozzle layer 1, and the second nozzle layer 2, includes a first nozzle hole 11*a* and a second nozzle hole 11*b*. The first nozzle hole 11*a* is a penetrating part that penetrates the liquid repellent film 4, the discharge layer 14, the first nozzle layer 1, and the stopper layer 3. The second nozzle hole 11*b* is a penetrating part that penetrates the second nozzle layer 2. Further, the first nozzle hole 11*a* includes the discharge opening 11*c* and a first nozzle hole part 11*d*. The discharge opening 11*c* is a penetrating part that penetrates the liquid repellent film 4 and the discharge layer 14. The first nozzle hole part 11*d* is a penetrating part that penetrates the first nozzle layer 1 and the stopper layer 3.

In other words, the discharge layer 14 is located in the first nozzle layer 1 between the liquid repellent film 4 and the first nozzle layer 1, and is in touch with the liquid repellent film 4. Also, the discharge layer 14 is locally formed around the discharge opening 11*c*. The stopper layer 3 is located in the second nozzle layer 2 between the first nozzle layer 1 and the second nozzle layer 2, and is in touch with the first nozzle layer 1. Also, the stopper layer 3 is locally formed around the first nozzle hole part 11*d*.

A liquid substance is supplied from an entrance opening of the second nozzle hole 11*b* which is provided on the back side of the nozzle plate 8 (on the opposite surface of the nozzle plate 8 from the surface where the liquid repellent film 4 is formed). The liquid substance passes through the second nozzle hole 11*b* and the first nozzle hole part 11*d* and is discharged, for example, in the form of droplets from the discharge opening 11*c*. Note that the form of the discharged liquid substance is not limited to droplets.

Here, as illustrated in FIG. 11(*a*), the discharge opening 11*c* and the first nozzle hole part 11*d* are cylindrical, and the second nozzle hole 11*b* is taper-shaped (i.e. shaped like a truncated cone) and spreads to the bottom, from the connecting part with the first nozzle hole part 11*d*.

Further, the cylindrical first nozzle hole part 11*d* has an upper base 11α that is substantially circular around the discharge opening 11*c*. The discharge layer 14 is exposed as the upper base 11α. On this account, a (substantially circular) connecting part 11β between the discharge opening 11*c* and the first nozzle hole part d is smaller in diameter than the external diameter of the upper base 11α of the first nozzle hole part 11*d* (i.e. smaller than the outer shape of the first nozzle hole part 11*d* at the connecting part 11β).

The upper base 11*y* of the truncated-cone-shaped second nozzle hole 11*b* is substantially circular around the first nozzle hole part 11*d*, and the stopper layer 3 is exposed as the upper base 11*y*. On this account, the (substantially circular) connecting part 11*x* between the first nozzle hole part 11*d* and the second nozzle hole 11*b* is smaller in diameter than the external diameter of the upper base 11*y* of the second nozzle hole 11*b* (i.e. smaller than the outer shape of the second nozzle hole 11*b* at the connecting part 11*x*).

Although the sizes and materials of the members will specifically described below, the present invention is not limited to those specific examples.

The discharge layer 14 is a 0.5 μm-thick Ti film mainly comprising Ti. The first nozzle layer 1 is a polyimide film about 1 μm thick. The second nozzle layer 2 is a polyimide film about 20 μm thick.

The stopper layer 3 is made of a metal material mainly comprising titanium and is a substantially square about 20 μm on a side, in order to restrain the warpage due to the overall stress of the nozzle plate 8.

The diameter of the opening, i.e. discharge opening 11*c* of the first nozzle hole 11*a* is about 3 μm. The outer diameter of the upper base 11*y* of the second nozzle hole 11*b* is 10 μm, and the diameter of the entrance opening (liquid inflow opening 12) is 30 μm.

The liquid repellent film 4 formed on the discharge layer 14 and the first nozzle layer 1 is realized by a fluoropolymer or a silicon polymer film about 0.05 μm thick. As described below, an excess portion of the liquid repellent film 4 entering in the discharge opening 11*c* is removed by dry etching. In view of this, the liquid repellent film 4 is preferably thicker than the discharge opening 11*c* so that the discharge opening 11*c* does not deform dramatically by the aforesaid dry etching.

According to the present embodiment, the shape of the discharge opening 11*c* of the nozzle plate 8, which has a large influence on landing accuracy, is determined by the processing accuracy of the 0.5 μm-thick Ti film. Therefore, the processing accuracy of the discharge opening 11*c* is very high. This secures extremely high landing accuracy.

Meanwhile, in order to increase the processing accuracy of the discharge opening 11*c*, the thickness of the discharge layer 14 should be formed to be thin. With this arrangement, an etched amount of the discharge layer 14 becomes small. This shortens the time that the discharge layer 14 is subjected to an etching agent. Making the discharge layer 14 thin could possibly decrease the rigidity of the discharge layer 14 and hence decrease the structural reliability of the discharge opening 11*c*. However, in the present embodiment, the discharge layer 14 is formed in the first nozzle layer 1 so as to be in touch with the surface of the first nozzle layer 1 facing the liquid repellent film 4, so that the discharge layer 14 is reinforced.

Therefore, it is possible to improve the precision of the shape of the discharge opening 11$c$ while ensuring the structural reliability of the discharge opening 11$c$.

Further, the stopper layer 3 is locally formed in line with the location where the nozzle hole 11 (first nozzle hole part 11$d$) is provided. Therefore, in comparison with the conventional arrangement in which the stopper layer is entirely formed between the first nozzle layer 1 and the second nozzle layer 2, it is possible to significantly restrain the stress on account of the difference of linear expansion coefficients between the first and second nozzle layers 1 and 2 and the stopper layer 3, and hence it is possible to prevent the nozzle plate 8 to be greatly warped.

Also, since the second nozzle hole 11$b$ is taper-shaped, the occurrence of the turbulent liquid flow is restrained in the second nozzle hole 11$b$. The stability in the discharge of the liquid substance is therefore improved.

With the liquid repellent film 4, it is possible to prevent the liquid substance from adhering to the discharge layer 14 in the vicinity of the discharge opening 11$c$.

The material of the discharge layer 14 is not limited to the metal material mainly comprising titanium. The material of the discharge layer 14 can be optionally chosen on condition that the material is highly resistant to the etching process of the first and second nozzle layers 1 and 2, the etching of the below-mentioned sacrifice layer 5 (see FIG. 13($f$)), and the etching process of the liquid repellent film 4 entered inside the discharge opening 11$c$. In other words, the material is highly resistant to an etching gas (plasma including oxygen, plasma including fluorine, or the like) or the etchant (nitric acid, an aqueous solution of potassium hydroxide, or the like).

Specific examples of the metal material are: a metal material mainly comprising Ti, Al, Cu, Co, Fe, Ni, Au, Pt, Ta, W, Nb, and the like; an inorganic oxide material mainly including $SiO_2$, $Al_2O_3$ and the like; an inorganic nitride material mainly made of $Si_3N_4$, AlN, or the like; or the like. The metal material is chosen in combination with the etching gas or the etchant.

Further, the material of the first nozzle layer 1 is not limited to polyimide. The material may be (i) a polymer organic material other than polyimide, (ii) Si compound material such as $SiO_2$ and $Si_3N_4$, or (iii) Si.

The material of the stopper layer 3 is not limited to the metal material mainly comprising titanium, either. The material of the stopper layer 3 can be optionally chosen on condition that the material is highly resistant to the etching process of the first and second nozzle layers 1 and 2 and the etching of the below-mentioned sacrifice layer 5. In other words, the material is highly resistant to the etching gas (plasma including oxygen, plasma including fluorine, or the like) or the etchant (nitric acid, an aqueous solution of potassium hydroxide, or the like).

Specific examples of the metal material are: a metal material mainly comprising Ti, Al, Cu, Co, Fe, Ni, Au, Pt, Ta, W, Nb, and the like; an inorganic oxide material mainly including $SiO_2$, $Al_2O_3$ and the like; an inorganic nitride material mainly made of $Si_3N_4$, AlN, or the like; or the like.

The material of the second nozzle layer 2 is not limited to polyimide, either. Being similar to the first nozzle layer 1, the material of the second nozzle layer 2 may be a polymer organic material other than polyimide, an Si compound material such as $SiO_2$ and $Si_3N_4$, or Si.

The shape of the discharge layer 14 is not limited to the substantially square shape, on condition that the discharge layer 14 locally locates at the position where the discharge opening 11$c$ is formed. For example, the discharge layer 14 may have a circular shape. The circular shape is preferable because it has the highest isotropy and hence the reduction of the stress is isotropic.

As shown in FIG. 11($a$), in the present embodiment, one discharge opening 11$c$ is formed for one discharge layer 14. The present invention is not limited to this arrangement, so that a plurality of discharge openings 11$c$ may be formed for one discharge layer 14, as long as the stress is restrained as compared to the conventional arrangement.

The shape of the stopper layer 3 is not limited to the substantially square shape, on condition that the stopper layer 3 locally locates at the position where the nozzle hole 11 is formed. For example, the stopper layer 3 may have a circular shape. The circular shape is preferable because it has the highest isotropy and hence the reduction of the stress is isotropic. As shown in FIG. 11($a$), in the present embodiment, one nozzle hole 11 (first nozzle hole part 11$d$) is formed for one stopper layer 3. A plurality of nozzle holes 11 may be formed for one stopper layer 3, as long as the stress is restrained as compared to the conventional arrangement.

In the present embodiment, as illustrated in FIG. 11($b$), the diameter of the discharge opening 11$c$ is slightly smaller than the diameter of the first nozzle hole part 11$d$. However, the present invention is not limited to this arrangement. When consideration is given to the objective of the present invention, the discharge opening 11$c$ and the first nozzle hole part 11$d$ may be identical in diameter.

Further, in the present embodiment, as illustrated in FIG. 11($b$), the diameter of the connecting part 11$x$ between the first nozzle hole part 11$d$ and the second nozzle hole 11$b$ is smaller than the diameter of the upper base 11$y$ of the second nozzle hole 11$b$. However, it is not necessary to arrange them in that way.

Figure 12:
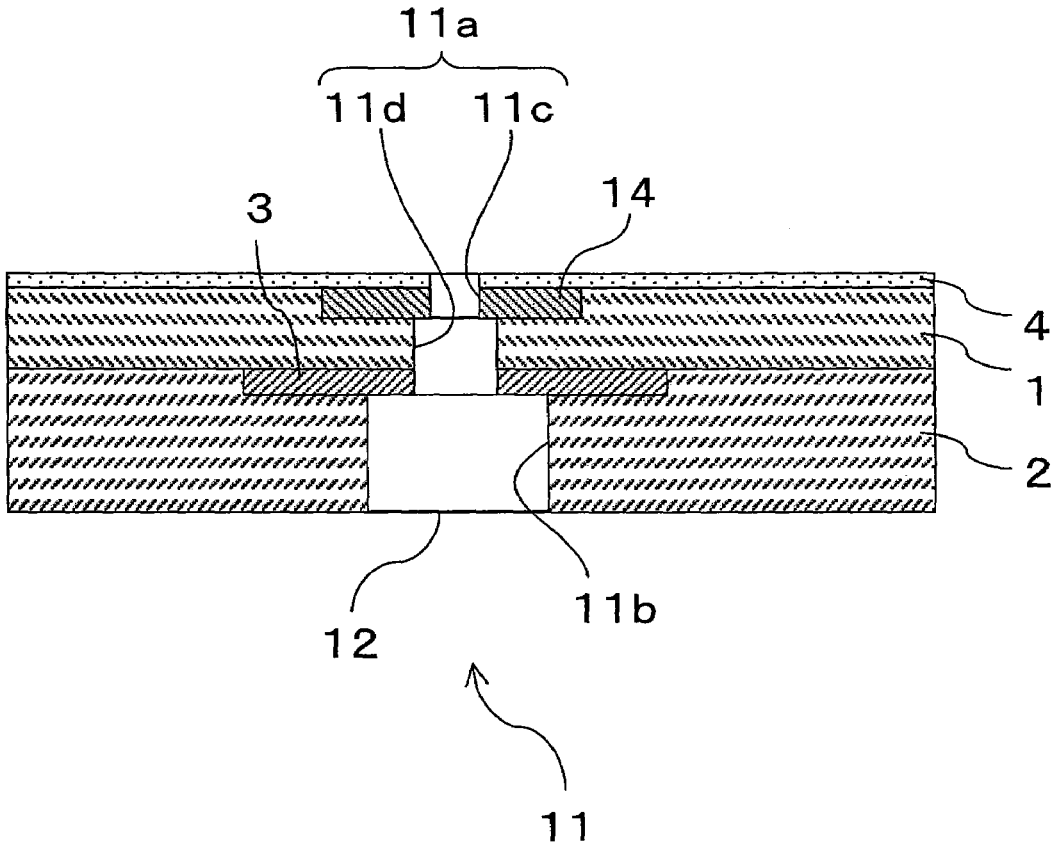
FIG. 12 is a cross section showing a variant example of the aforesaid nozzle plate.

The diameter of the connecting part 11$x$ may be identical with that of the joint section 11$y$. In the present embodiment, the second nozzle hole 11$b$ is truncated-cone-shaped (taper-shaped) so that the connecting part 11$x$ with the first nozzle hole 11$a$ (first nozzle hole part 11$d$) is narrowed, but it is not necessary to arrange the second nozzle hole 11$b$ in that way. For example, as shown in FIG. 12, the second nozzle hole 11$b$ may be straight (cylindrical) so that the side wall of the second nozzle hole 11$b$ is perpendicular to the stopper layer 3. With this arrangement, the liquid inflow opening 12 of the second nozzle hole 11$b$ is further reduced in size, and hence the concentration of the nozzles 11 is further increased. Also, the second nozzle hole 11$b$ may be tapered with bulge, as shown in FIG. 8($c$).

As described above, since the nozzle plate 8 has the discharge layer 14, the first nozzle layer 1, the stopper layer 3, and the second nozzle layer 2, the shape of the discharge opening 11$c$ depends on the processing accuracy of the 0.5 μm-thick discharge layer 14. On this account, the precision of the shape of the discharge opening 11$c$ is improved.

Since the discharge layer 14 is made of a material that is highly resistant to etching means of etching the liquid repellent film 4, the liquid repellent film 4 entered inside the discharge opening 11$c$ is etched away without deformation of the discharge opening 11$c$. This makes it possible to prevent decline in the processing accuracy of the discharge opening 11$c$ in the manufacturing process.

The first nozzle layer is disposed 1 in touch with the discharge layer 14, so that the rigidity of the discharge layer 14 is allowed to be maintained in the first nozzle layer 1 which is a thin layer. This minimizes deformation of the discharge opening 11$c$ in discharge of the liquid substance and thus improves the stability in the discharge of the liquid substance.

The rigidity of the nozzle plate 8 is maintained by the second nozzle layer 2. As a result, the overall rigidity of the nozzle plate 8 is increased and the handling of the same is easy.

Since the shape of the stopper layer 3 is minimized as much as possible, the warpage of the nozzle plate 8 due to the stress is restrained.

Also, since the thickness of the nozzle plate 8 is also minimized as much as possible, the liquid inflow opening 12 of the nozzle plate 8 is reduced in size, and hence the concentration of the nozzle holes 11 is increased. This makes it possible to draw a high-resolution image.

Since the nozzle plate 8 is reinforced by the thick second nozzle layer 2, the warpage is restrained and the handling is easy.

Even if the processing accuracy of the second nozzle hole 11*b* through the thick second nozzle layer 2 is low, the etching does not go beyond the stopper layer 3, at the time of the processing of the second nozzle hole 11*b*. On this account, the low processing accuracy of the second nozzle hole 11*b* does not influence on the discharge opening 11*c* that controls the size of the discharged liquid substance.

(Manufacturing Method of Nozzle Plate)

Figure 13:
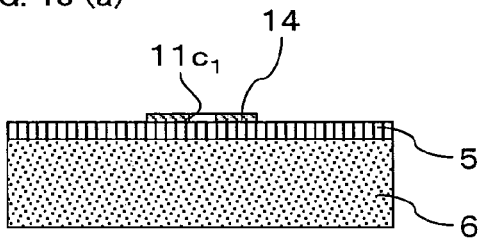
FIGS. 13(*a*)-13(*g*) are cross sections illustrating a manufacturing method of the nozzle plate of Embodiment 3 of the present invention.
Figure 13:
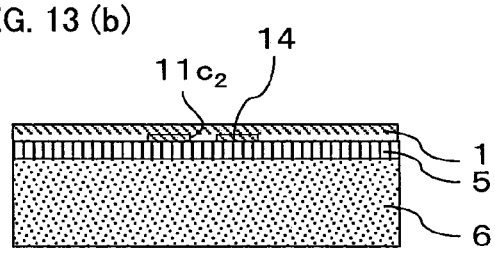
Figure 13:
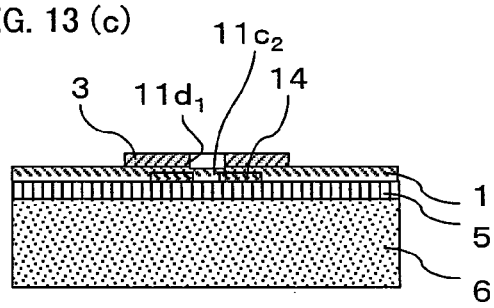
Figure 13:
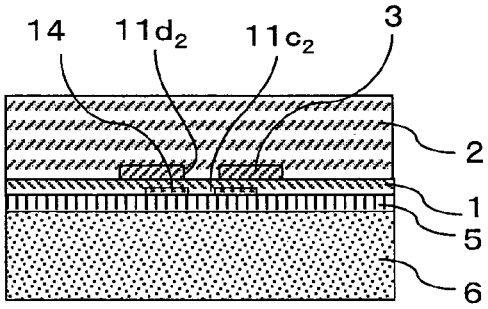
Figure 13:
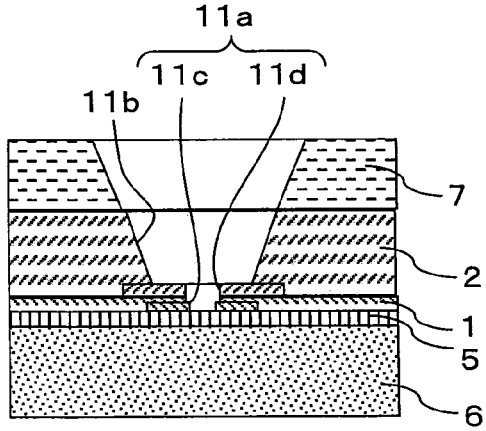
Figure 13:
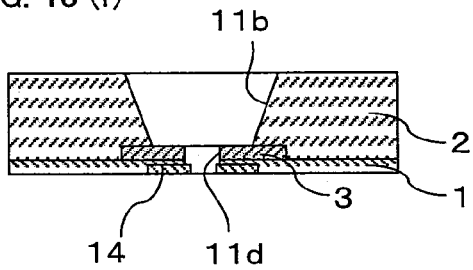
Figure 13:
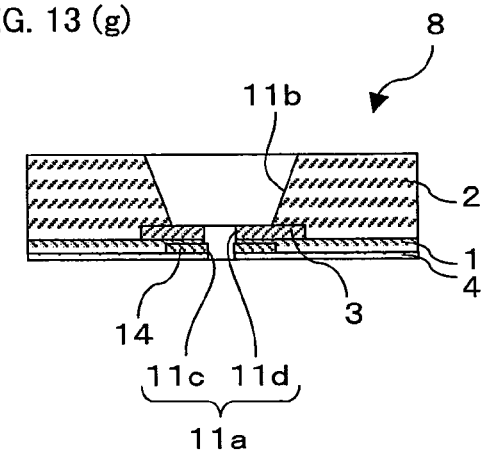
Figure 14:
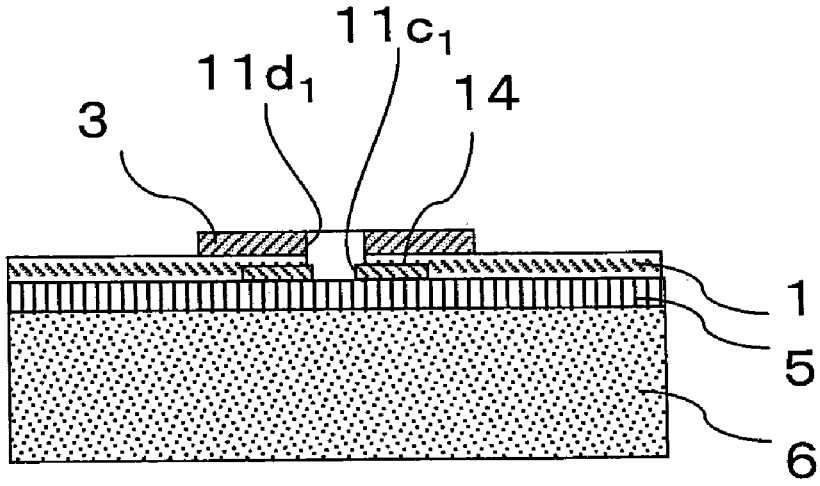
FIG. 14 is a cross section illustrating a variant example of a manufacturing method of the aforesaid nozzle plate.

The following will describe a manufacturing method of the nozzle plate of the present embodiment. FIGS. 13(*a*)-13(*g*) show the manufacturing steps of the nozzle plate of the present embodiment. FIG. 14 shows a variant example of the step shown in FIG. 13(*c*).

There is provided the substrate 6 made of Si, glass, and the like, which is used for temporarily maintaining a predetermined thickness, and the sacrifice layer 5 is formed on this substrate 6, by wet plating using Ni (see FIG. 13(*a*)). The sacrifice layer 5 is 10 μm thick.

Subsequently, on the sacrifice layer 5, a Ti film is formed so as to be 0.5 μm thick by vapor deposition or the like method. By means of photolithography, formed are resist patterns of (i) the outer shape of the discharge layer 14 which is substantially a square 7 μm on a side and (ii) the shape of the discharge opening 11*c* which is a circle having a diameter of 2 μm. Thereafter, the outer shape of the discharge layer 14 and the opening 11$c_1$ which is the discharge opening 11*c* are concurrently processed by dry etching (discharge layer forming step).

As an etching method used in the foregoing processing of the outer shape of the discharge layer 14 and the opening 11$c_1$, adopted is dry etching using plasma containing a mixed gas of $CF_4$ and oxygen. This dry etching allows for processing the Ti film at a high speed and with excellent precession. Also, the dry etching has a high etching selectivity to nickel of which the sacrifice layer 5 is made (i.e. nickel is hardly etched). For this reason, the sacrifice layer 5 suffers no great damage from the foregoing processing, and it is possible to prevent the sacrifice layer 5 from significantly losing flatness of its surface.

Thus, the nozzle plate 8 which is formed on the surface of the sacrifice layer 5 does not lose flatness on its liquid substance discharging side. Further, the aforesaid processing requires an extremely high accuracy. For this reason, highly-anisotropic etching condition is adopted.

Subsequently, to the sacrifice layer 5, polyimide resin is applied so that a polyimide film 1 μm thick is formed. As a result, the first nozzle layer 1 is formed (first nozzle layer forming step; FIG. 13(*b*)).

The polyimide resin is applied to the sacrifice layer 5 by spin coating, and is heated for 2 hours at 350° C. Now, the opening 11$c_1$, which is the discharge opening 11*c*, is formed in the discharge layer 14 is stuffed by the polyimide resin (See 11$c_2$).

Then, on the first nozzle layer 1, the stopper layer 3 having an opening 11$d_1$ is formed (blocking layer forming step; FIG. 13(*c*)).

First, using a material mainly comprising Ti, the stopper layer 3 which is 0.5 μm thick (5000 Å) is formed by sputtering. Then the stopper layer 3 is subjected to photolithography, and a resist pattern with a predetermined shape is formed thereon. Then the stopper layer 3 is processed so as to substantially be a square about 20 μm on a side, by means of dry etching using Ar ions, e.g. by ion milling. Through the dry etching, one opening 11$d_1$ (second opening) 3 μm in diameter is formed inside the substantial square. This opening 11$d_1$ is a formation pattern of the below-mentioned first nozzle hole 11*a*, and becomes a part of the first nozzle hole part 11*d*.

Subsequently, the 20 μm-thick second nozzle layer 2 is formed on the first nozzle layer 1 and the stopper layer 3 (second nozzle hole forming step; FIG. 13(*d*)).

Being similar to the first nozzle layer 1, the second nozzle layer 2 is formed in such a way that polyimide resin is applied by means of spin coat and then formed to be 20 μm thick after the heating for 2 hours at 350° C. At this time, the opening 11$d_1$ of the stopper layer 3 is stuffed by the polyimide resin (See 11$d_2$).

Then, on the second nozzle layer 2, a resist pattern 7 is formed by photolithography, dry etching is performed using a gas mainly comprising oxygen, and the tapered (truncated-cone-shaped) second nozzle hole 11*b* is formed in the second nozzle layer 2 (second nozzle hole forming step; FIG. 13(*e*)).

It is noted that the dry etching does not go beyond the stopper layer 3. That is to say, the dry etching does not proceed at a portion where the stopper layer 3 is exposed, except at the aforesaid opening 11$d_1$ of the stopper layer 3.

To cause the second nozzle hole 11*b* to have a tapered shape, the etch rate of the resist pattern 7 is equalized with the etch rate of the polyimide resin of the second nozzle layer 2, at the time of the etching, the resist pattern 7 is made tapered by post-baking the resist pattern 7 for 60 minutes at 150° C., and the tapered shape is transferred to the second nozzle layer 2 by means of etching.

That is, as shown in FIG. 9; the resist pattern 7 that has a tapered cross section and has an etch rate substantially identical with that of the polyimide resin (second nozzle layer 2) is formed. Then the resist pattern 7 is etched at the rate identical with the rate of the etching of the polyimide resin, so that the edge portion of the resist pattern 7 is widened. The polyimide resin (second nozzle layer 2) is also etched at this time. As a result, the wall (of the second nozzle hole 11*b*) as a result of the etching has a shape identical with that of the initially-formed tapered wall (resist pattern 7) of the resist.

Note that, since the etch rate of the resist pattern 7 is almost identical with the etch rate of the second nozzle layer 2, the resist pattern 7 is preferably thicker than the second nozzle layer 2.

Immediately after the second nozzle hole forming step, the first nozzle hole 11*a* (first nozzle hole part 11*d* and discharge opening 11*c*) is etched through the first nozzle layer 1 (first nozzle hole part forming step, first removing step; see FIG. 13(*e*)).

The first nozzle hole 11*a* is processed so as to have a shape (substantially circular shape, 3 μm in diameter) determined by the opening 11*d*, of the stopper layer 3, which has been made in the previous step, and processed so as to have an identical shape with the pattern of the discharge opening 11*c* (opening 11$c_1$) formed in the discharge layer 14 (That is, material of the first nozzle layer 1 (see 11$c_2$) existing in the opening 11$c$1 of the discharge layer 14 is etched away).

The stopper layer 3 and the discharge layer 14 are rarely etched by the dry etching, of this step, which is performed using a gas mainly comprising oxygen.

Therefore, the first nozzle layer 1 is etched away (substantially perpendicular to the stopper layer 3) by an area of a diameter substantially identical with the diameter of the opening 11$d_1$ of the stopper layer 3. The dry etching is stopped at the point where a portion except for the discharge opening 11$c$ of the discharge layer 14 is exposed so that the first nozzle hole part 11$d$ is formed. Following this, material of the first nozzle layer 1 (see 11$c_2$) existing in the opening 11$c$1 of the discharge layer 14 is etched away so that the discharge opening 11$c$ is formed.

Subsequently, the resist pattern 7 is removed by a resist peeling liquid, and only the sacrifice layer 5 is etched away by dipping into an aqueous solution mainly made of nitric acid and water. As a result, the nozzle plate 8 is detached from the substrate 6 (FIG. 13($f$)).

As described previously, the polyimide resin of which the first and second nozzle layers 1 and 2 are made and Ti of which the stopper layer 3 or the discharge layer 14 is made are scarcely etched by the etching liquid for the sacrifice layer 5. For this reason, the etching of the sacrifice layer 5 does not change the shape and does not decrease the structural reliability.

Then the liquid repellent film 4 is formed on the surface of the first nozzle layer 1 (FIG. 13($g$)).

In this process, fluoropolymer is used in consideration of the easiness of the application. The fluoropolymer is applied to the surface of the first nozzle layer 1 by stamping or the like, and as a result the liquid repellent film 4 which is a polymer film is formed. As to the liquid repellent film 4 entered inside the first nozzle hole 11$a$, such liquid repellent film 4 is removed after the formation of the liquid repellent film 4, by performing dry etching using plasma containing oxygen from the second nozzle hole 11$b$ side. This makes it possible to minimize the damage of the nozzle plate 8. Details will be described below.

Figure 17:
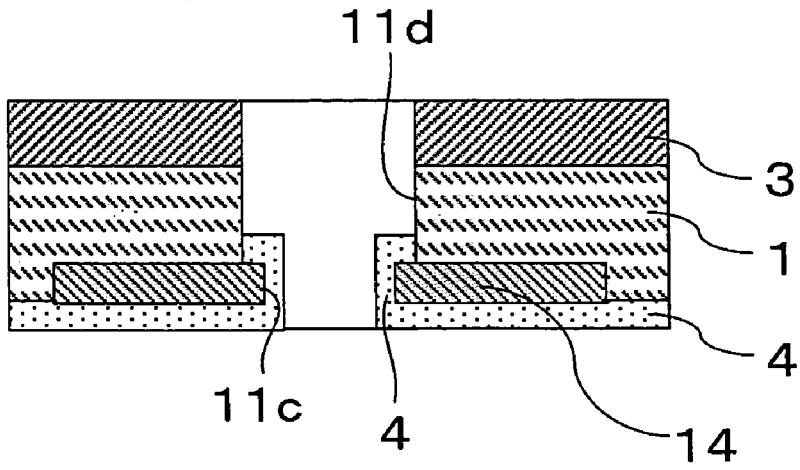
FIGS. 17(*a*)-17(*c*) illustrate steps of etching away and removing a liquid repellent film.
Figure 17:
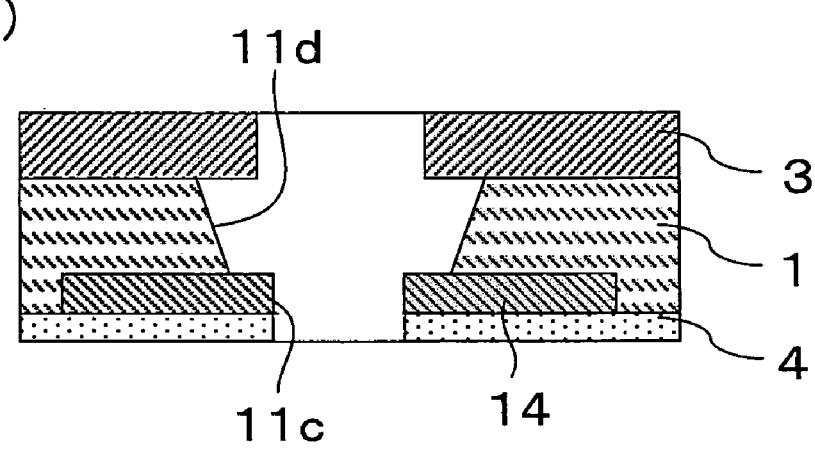
Figure 17:
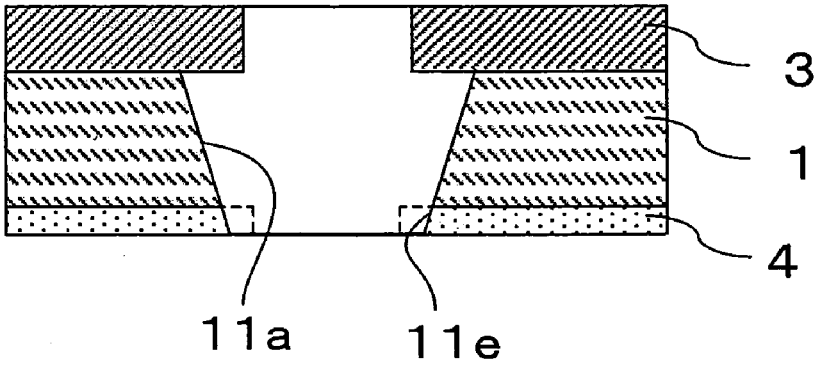

FIGS. 17($a$) through 17($c$) are explanatory schematic drawings of the dry etching process for removing the entering liquid repellent film 4, and are enlarged views of the first nozzle hole 11$a$ and the discharge opening 11$c$ formed in the discharge layer 14.

Specifically, the liquid repellent film 4 is applied and baked on the liquid substance discharging side of the nozzle plate 8. Then, as illustrated in FIG. 17($a$), a part of the liquid repellent film 4 enters into the first nozzle hole 11$a$ (discharge opening 11$c$ and first nozzle hole part 11$d$) and adheres to the inner wall of the first nozzle hole 11$a$. Such an entered liquid repellent film 4 must be removed since it is a main cause of decline in the precision of the shape of the first nozzle hole 11$a$ (specifically, discharge opening 11$c$).

In the present embodiment, the entered part of liquid repellent film 4 is etched away by dry etching using oxygen-containing plasma. In the case where the first nozzle layer 1 is made of an organic material such as polyimide resin, the dry etching causes side etch that takes place in the first nozzle layer 1 formed below the blocking layer 3, so that undercut is formed below the blocking layer 3, as illustrated in FIG. 17($b$).

Meanwhile, in the case where the discharge layer 14 is not provide as illustrated in FIG. 17($c$), the dry etching causes the undercut to reach the liquid substance discharging side. This results in deformation of a discharge opening 11$e$ from which the liquid substance is discharged (Dotted line represents ideal shape.).

However, in the present embodiment, the discharge layer 14 highly resistant to the dry etching using oxygen-containing plasma is formed so as to be in touch with the liquid repellent film 4. Also, the discharge layer 14 determines the shape of the discharge opening 11$c$. Therefore, the aforesaid dry etching never changes the shape of the discharge opening 11$c$ (see FIG. 17($c$)). Thus, it is possible to form the nozzle hole 11 (first nozzle hole 1$a$) with extremely highly precision.

Note that, as a result of an evaluation of the shape of each of 200 discharge openings 11$c$ of the nozzle plate 8 made though the steps of the present embodiment, the variation in the shape was very low (±0.15 μm), i.e. the discharge openings 11$c$ were highly precisely formed. Also, the nozzle plate 8 was very flat, as the warpage was not more than 10 μm.

According to the present embodiment, the discharge opening 11$c$ (opening 11$c_1$) is formed in the discharge layer 14 0.5 μm thick. This allows the discharge opening 11$c$ to be formed with high precision.

At the time of etching the first nozzle layer 1 so as to form the discharge opening 11$c$, the discharge layer 14 functions as an etching stopper which determines the shape of the discharge opening 11$c$, so that the aforesaid etching is reliably and precisely stopped at the point where the side wall of the discharge opening 11$c$ is exposed during the etching. Thus, the discharge opening 11$c$ is formed.

As a result of this, the precision of the shape of the discharge opening 11$c$ is dramatically improved, as compared with the arrangement where the discharge opening 11$c$ is formed directly on the first nozzle layer 1 (the arrangement where the etching stopper which determines the shape of the discharge opening 11$c$ is not formed in the first nozzle layer 1).

Further, at the time of forming the first nozzle hole part 11$d$ by etching, the first nozzle layer 1 is etched by using the stopper layer 3 as a mask (blocking layer). Therefore, it is possible to form the first nozzle hole part 11$d$ highly precisely.

Further, at the time of etching the second nozzle layer 2, the etching automatically stops at the stopper layer 3. This makes it possible to define the etching depth of the second nozzle hole 11$b$.

The material of the stopper layer 3 is chosen in consideration of the function as a blocking layer for the etching of the first nozzle hole part 11$d$ or of the function as a side wall of the first nozzle hole part 11$d$. For this reason, the first nozzle hole part 11$d$ is formed with more highly precision. Moreover, since the first nozzle layer 1 or the second nozzle layer 2 is formed so as to be thin, an amount of the first and second nozzle layers 1 and 2 to be etched away is small at the time of forming the first nozzle hole part 11$d$ and the second nozzle hole 11$b$ by etching, and hence the formation error is reduced. It is therefore possible to form the nozzle hole 11 highly precisely.

Further, at the time of forming the first nozzle hole 11$a$ and the second nozzle hole 11$b$ by etching, the etching of the stopper layer 3 is performed in one direction. On this account, the first nozzle hole 11$a$ is easily aligned with the second nozzle hole 11$b$, as compared to a conventional arrangement in which the etching is performed in two opposing directions.

In the steps of forming the first and second nozzle holes 11$a$ and 11$b$ (i.e. first nozzle hole part forming step and second nozzle hole forming step), it is possible to carry out the etching in the first nozzle hole part forming step and the second nozzle hole forming step using the etching device and (i) etching liquid or (ii) etching gas, which are used in the first nozzle hole part forming step. This makes it possible to simplify the manufacturing process.

In the present embodiment, the sacrifice layer 5 is made of nickel, the first and second nozzle layers 1 and 2 are made of polyimide resin, and the stopper layer 3 is made of titanium, but the combination of the materials is not limited to the above.

Apart from nickel, the material of the sacrifice layer 5 may be chosen from the followings, in consideration of the materials of the first and second nozzle layers 1 and 2 and the stopper layer 3: (i) copper nitrate or aluminum nitrate, (ii) a material soluble in a KOH aqueous solution, and (iii) a material that can be etched by oxygen plasma, such as polyimide. Also, apart from the plating, the method for forming the sacrifice layer 5 may be vapor deposition, sputtering, coating, or the like, in consideration of the materials.

The material of the first and second nozzle layers 1 and 2 is required to be rarely damaged by the etching of the sacrifice layer 5. The discharge layer 14 and the stopper layer 3 are required to be made of a material highly resistant to the etching of the sacrifice layer 5 and the etching of the first and second nozzle holes 11*a* and 11*b*.

Table. 3 shows preferable combinations of the materials (of the sacrifice layer, discharge layer, first nozzle layer, stopper layer, and second nozzle layer) and the methods (for forming the discharge layer, stopper layer, first nozzle hole, and second nozzle hole, and for removing the sacrifice layer).

rial such as polyimide resin, and an inorganic silicon compound such as silicon and $SiO_2$ may be used.

However, the dry etching of $SiO_2$ and silicon requires a reactive gas including fluorine, but titanium used in the present embodiment does not excel in the resistance to such dry etching. For this reason, it is preferable to use the discharge layer 14 or the stopper layer 3 made of an etching-resistant material such as Au and Pt.

The silicon compound such as $SiO_2$ and silicon has a high resistance to the aforesaid etching means of removing the entered liquid repellent film 4. This prevents change in the shape of the first nozzle hole 11*a*, and thus further increases shape stability of the discharge opening 11*c*.

In addition, the discharge layer 14 or the stopper layer 3 can be made of the material given in Table. 3 apart from titanium, in consideration with the combinations shown in Table 1. Titanium, which is a material of the stopper layer 3, can be subjected to etching using a mixed gas of $CF_4$ and oxygen at the time of patterning of the stopper layer 3. However, the first nozzle layer 1 (polyimide) formed under titanium is etched by the mixed-gas plasma at a speed higher than that of titanium. As a result, the first nozzle layer 1 is greatly damaged. For this reason, the present embodiment adopts dry etching using argon ions, for patterning of the stopper layer 3.

In this manner, the dry etching using argon ions is adopted so that the difference between the etch rate of the stopper layer 3 and the etch rate of the nozzle layer 1 is small, and

TABLE 3

| LAYERS | | | | |
|---|---|---|---|---|
| SACRIFICE LAYER | DISCHARGE LAYER | FIRST NOZZLE LAYER | STOPPER LAYER | SECOND NOZZLE LAYER |
| Ni, Al, Cu | Ti, W, Nb, Au, Pt, $SiO_2$, $Si_3N_4$, $Al_2O_3$ | POLYIMIDE | Ti, W, Nb, Au, Pt, $SiO_2$, $Si_3N_4$, $Al_2O_3$ | POLYIMIDE |
| Ni, Al, Cu | Ti, W, Nb, Au, Pt, $Al_2O_3$ | POLYIMIDE | Au, Pt, $Al_2O_3$ | $SiO_2$, Si |
| Ni, Al, Cu | Au, Pt, $Al_2O_3$ | $SiO_2$, Si | Au, Pt, $Al_2O_3$ | POLYIMIDE |
| Ni, Al, Cu | Au, Pt, $Al_2O_3$ | $SiO_2$, Si | Au, Pt, $Al_2O_3$ | $SiO_2$, Si |
| POLYIMIDE | Al, Cu, Ni, Fe, Co, $Al_2O_3$ | $SiO_2$, Si | Al, Cu, Ni, Fe, Co, $Al_2O_3$ | $SiO_2$, Si |

| METHODS | | | | |
|---|---|---|---|---|
| MANUFACTURING METHOD OF DISCHARGE LAYER | MANUFACTURING METHOD OF STOPPER LAYER | MANUFACTURING METHOD OF FIRST NOZZLE HOLE | MANUFACTURING METHOD OF SECOND NOZZLE HOLE | REMOVAL OF SACRIFICE LAYER |
| $CF_4$ or Ar | Ar DRY ETCHING | $O_2$ DRY ETCHING | $O_2$ DRY ETCHING | NITRIC ACID |
| Ar | Ar DRY ETCHING | $O_2$ DRY ETCHING | $CF_4$ DRY ETCHING OR $SF_6$ DRY ETCHING | NITRIC ACID |
| Ar | Ar DRY ETCHING | $CF_4$ DRY ETCHING OR $SF_6$ DRY ETCHING | $O_2$ DRY ETCHING | NITRIC ACID |
| Ar | Ar DRY ETCHING | $CF_4$ DRY ETCHING OR $SF_6$ DRY ETCHING | $CF_4$ DRY ETCHING OR $SF_6$ DRY ETCHING | NITRIC ACID |
| Ar or Cl | Ar DRY ETCHING OR Cl DRY ETCHING | $CF_4$ DRY ETCHING OR $SF_6$ DRY ETCHING | $CF_4$ DRY ETCHING OR $SF_6$ DRY ETCHING | $O_2$ PLASMA ETCHING |

As shown in Table. 3, the first and second nozzle layers 1 and 2 are not necessarily made of a polymeric organic matehence the patterning of the stopper layer 3 is carried out while the damage of the first nozzle layer 1 is minimized.

Further, in the above step, the discharge layer 14 (in the discharge layer forming step) or the stopper layer 3 (blocking layer forming step) is formed to have a square shape. The present invention, however, is not limited to this. The shape and size of the discharge layer 14 or the stopper layer 3 may be optionally determined on condition that, at the time of forming the first nozzle hole 11*a* (first nozzle hole part 11*d*) or the second nozzle hole 11*b*, the first nozzle hole 11*a* (first nozzle hole part 11*d*) and the second nozzle hole 11*b* reach the discharge layer 14 and the stopper layer 3, respectively, and the etching cannot proceed beyond the discharge layer 14 or the stopper layer 3. It is preferable that the shape and size of the discharge layer 14 or the stopper layer 3 is suitable for maximally restraining the warpage of the nozzle plate 8 on account of the stress from the discharge layer 14 or the stopper layer 3. As to the size of the discharge layer 14 or the stopper layer 3, the size is preferably as small as possible.

Further, in the blocking layer forming step, (i) the formation of the shape of the stopper layer 3 and (ii) the formation of the opening 11$d_1$ that functions as the formation pattern of the first nozzle hole part 11*d* are carried out at the same time. Alternatively, these two processes (i) and (ii) may be carried out as two etching steps (etching for forming the shape of the stopper layer 3 and etching for forming the opening 11$d_1$).

In the meanwhile, in the blocking layer forming step for forming the processing pattern of the first nozzle hole part 11*d* (the opening 11$d_1$ of the stopper layer 3), the first nozzle hole part 11*d* can be processed as illustrated in FIG. 14. In such a case, the first nozzle hole part 11*d* which has been formed is stuffed by the material used for formation of the second nozzle layer 2 at the time of forming the second nozzle layer 2. For this reason, the first nozzle hole part 11*d* is formed again in the first nozzle hole part forming step.

In the second nozzle hole forming step, it is possible to form a second nozzle hole 11*b* whose side wall is bulged (curved) as shown in FIGS. 8(*a*)-8(*c*), by adjusting the material of the mask and the etching conditions at the time of processing the second nozzle hole 11*b*.

That is, a mask 13 made of $SiO_2$, which is highly resistant to oxygen plasma etching, is formed on the second nozzle layer 2 (see FIG. 8(*a*)), and the oxygen plasma etching is carried out with a high gas pressure (e.g. 500 mTorr) (see FIG. 8(*b*)). As a result, undercut is carried out below the mask 13, so that a bulged tapered part is formed (see FIG. 8(*c*)).

However, if the etching is excessively performed, the diameter d of the second nozzle hole 11*b* becomes wide at the connecting part between the second nozzle hole 11*b* and the stopper layer 3, so that a large stopper layer 3 is required. For this reason, it is preferable to suitably control the etching.

The liquid repellent film 4 is not necessarily made of fluoropolymer. The material of the film 4 may be silicon polymer film, DLC (Diamond-Like Carbon), or the like.

Thus, in the above manufacturing process, the discharge opening 11*c* is formed in the discharge layer 14 which is more highly resistant to etching than the first nozzle layer 1 (and the liquid repellent film 4), so that the droplet discharge opening 11*c* is formed of substantially identical in shape (diameter) with the opening 11$c_1$ by using the discharge layer 14 as an etching stopper. This makes it possible to manufacture the nozzle plate 8 having the discharge opening 11*c* whose precision of the shape is dramatically high.

In addition, no change in the shape of the discharge opening 11*c* occurs at the time of etching away the liquid repellent film 4 entering inside the first nozzle hole 11*a* in the final step of the manufacturing process of the nozzle plate 8. This makes it possible to stably manufacture the nozzle plate 8 having a high precision of the shape of the discharge opening 11*c*.

Figure 18:
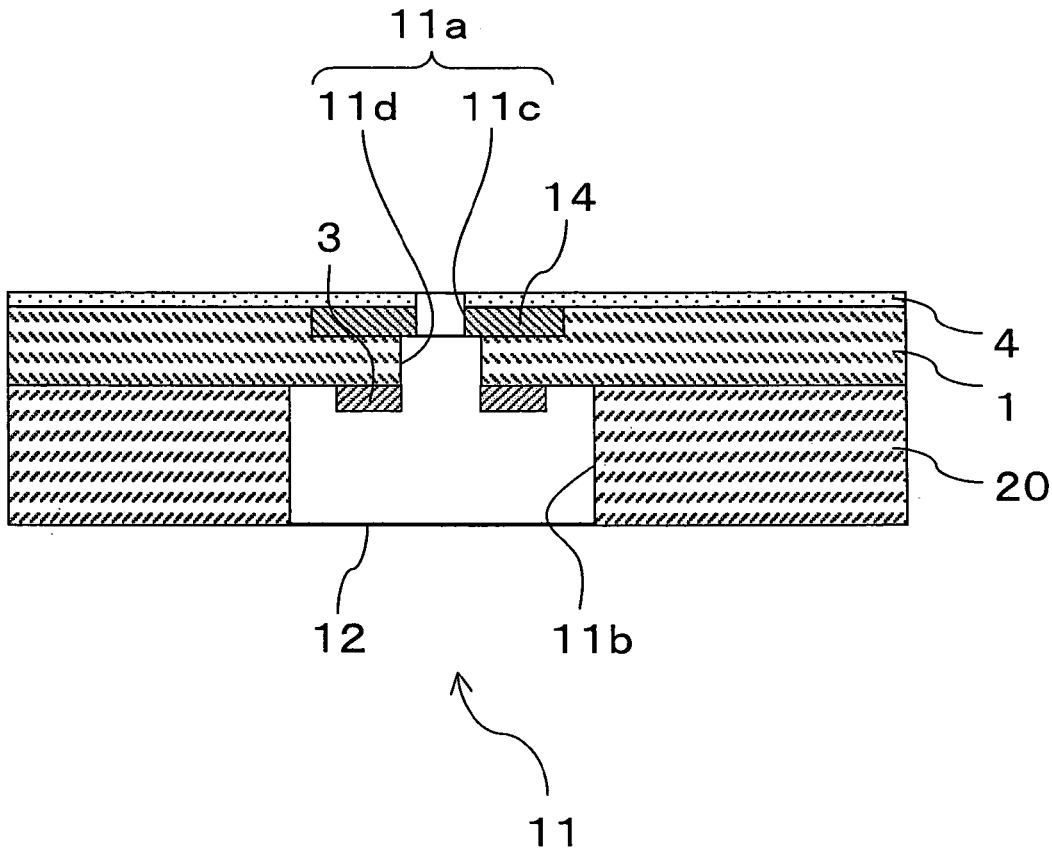
FIG. 18 is a cross section illustrating a variant example of the nozzle plate of Embodiment 3.

Note that, the present embodiment has described the arrangement in which the second nozzle layer 2 is formed on the liquid substance supplying side of the first nozzle layer 1. However, the present invention is not limited to this arrangement. Alternatively, as illustrated in FIG. 18, the arrangement in which the first nozzle layer 1 is joined with a reinforcing plate 20 having the second nozzle hole 11*b* may be adopted, for example. That is, the following arrangement may be adopted: the liquid repellent film 4 is formed on the liquid substance discharging side, the first nozzle layer 1 having the first nozzle hole part 11*d* is formed so as to be in touch with the liquid repellent film 4, the discharge layer 14 having the discharge opening 11*c* is locally formed in the first nozzle layer 1, the surface of the discharge layer 14 facing the liquid repellent film 4 and the surface of the first nozzle layer 1 facing the liquid repellent film 4 are flush with each other, the first nozzle layer 1 is joined with the reinforcing plate 20 having (i) the stopper layer 3 locally formed so as to be in touch with one side of the first nozzle layer 1 and (ii) the second nozzle hole 11*b*, and the discharge opening 11*c*, the first nozzle hole part lid, and the second nozzle hole 11*b* are connected with one another.

Embodiment 4

Embodiment 4 of the present invention is described below with reference to the attached drawings.

(Nozzle Plate)

Figure 15:
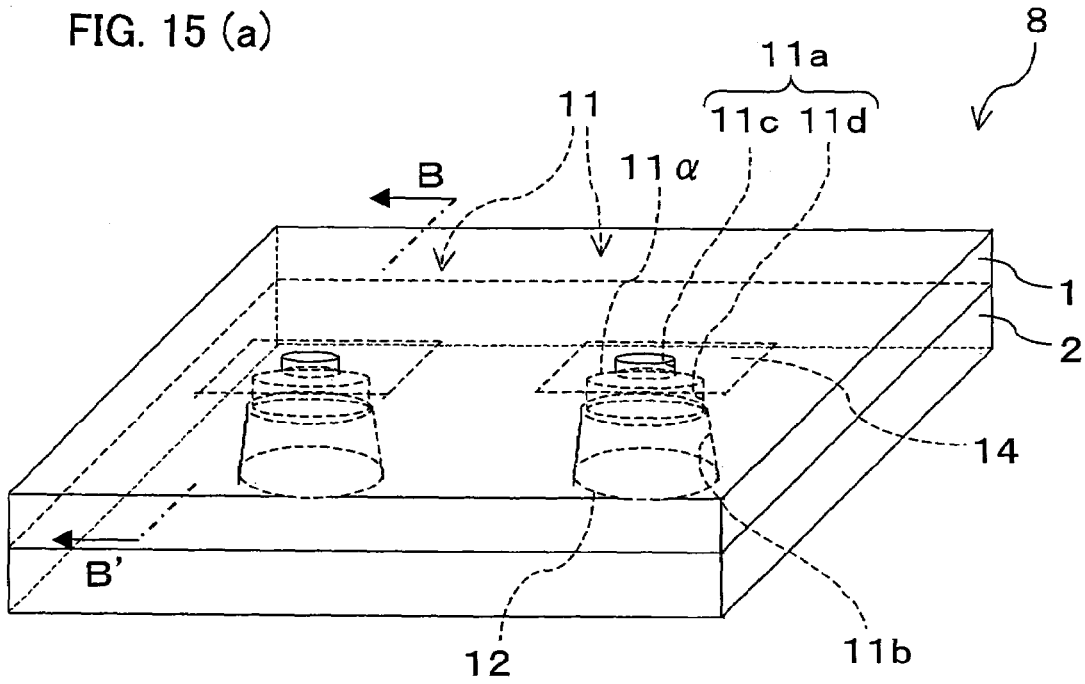
FIG. 15(*a*) is an oblique perspective view of a nozzle plate of Embodiment 4 of the present invention.
Figure 15:
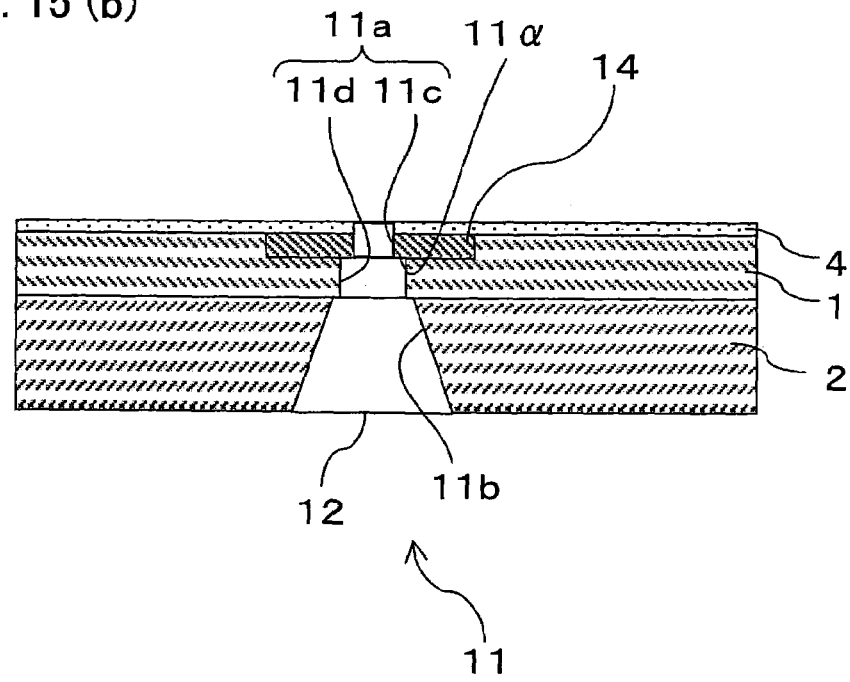

FIG. 15(*a*) is an oblique perspective view of a part of a nozzle plate of the present invention, which is used in a minute dot formation device. FIG. 15(*b*) is a cross section which is taken along a line B-B' of FIG. 15(*a*). On the nozzle plate 8, at least one liquid substance discharge opening (opening and first opening) (hereinafter referred to as discharge opening) 11*c* is formed. In FIG. 15(*a*), there are two discharge openings 11*c*.

As illustrated in FIGS. 15(*a*) and 15(*b*), the nozzle plate 8 includes: a first nozzle layer 1 having a liquid repellent film 4 on the liquid substance discharging side; and a second nozzle layer 2 on the liquid substance supplying side. The first nozzle layer 1 includes a discharge layer 14. The nozzle plate 8 further includes a nozzle hole 11 which is provided so as to penetrate the aforesaid members (i.e. liquid repellent film 4, discharge layer 14, first nozzle layer 1, and second nozzle layer 2).

More specifically, the liquid repellent film 4 is formed on the liquid substance discharging side of the nozzle plate 8, and the first nozzle layer 1 is formed so as to be in touch with the liquid repellent film 4. The discharge layer 14 is locally formed in the first nozzle layer 1, and a surface of the first nozzle layer 1 facing the liquid repellent film 4 is flush with a surface of the discharge layer 14 facing the liquid repellent film 4. The second nozzle layer 2 has one surface being formed so as to be in touch with a surface of the first nozzle layer 1 which is opposite to the surface of the first nozzle layer 1 where the liquid repellent film 4 is formed.

The nozzle hole 11, which penetrates the liquid repellent film 4, the discharge layer 14, the first nozzle layer 1, and the second nozzle layer 2, includes a first nozzle hole 11*a* and a second nozzle hole 11*b*. The first nozzle hole 11*a* is a penetrating part that penetrates the liquid repellent film 4, the discharge layer 14, and the first nozzle layer 1. The second nozzle hole 11*b* is a penetrating part that penetrates the second nozzle layer 2. Further, the first nozzle hole 11*a* includes the discharge opening 11$c$ and a first nozzle hole part 11$d$. The discharge opening 11$c$ is a penetrating part that penetrates the liquid repellent film 4 and the discharge layer 14. The first nozzle hole part 11$d$ is a penetrating part that penetrates the first nozzle layer 1.

In other words, the discharge layer 14 is located in the first nozzle layer 1 between the liquid repellent film 4 and the first nozzle layer 1, and is in touch with the liquid repellent film 4. Also, the discharge layer 14 is locally formed around the discharge opening 11$c$.

A liquid substance is supplied from an opening of the second nozzle hole 11$b$ which is provided on the back side of the nozzle plate 8 (on the opposite surface of the nozzle plate 8 from the surface where the liquid repellent film 4 is formed). The liquid substance passes through the second nozzle hole 11$b$ and the first nozzle hole part 11$d$ and is discharged, for example, in the form of the liquid substance from the discharge opening 11$c$.

Here, as illustrated in FIG. 15($a$), the discharge opening 11$c$ and the first nozzle hole part 11$d$ are cylindrical, and the second nozzle hole 11$b$ is taper-shaped (i.e. shaped like a truncated cone) and spreads to the bottom, from the connecting part with the first nozzle hole part 11$d$.

Further, the cylindrical first nozzle hole part 11$d$ has an upper base 11$\alpha$ that is substantially circular around the discharge opening 11$c$. The discharge layer 14 is exposed as the upper base 11$\alpha$.

The discharge layer 14 is made of a metal material mainly comprising platinum and is substantially square 0.5 μm thick and 10 μm on a side, in order to restrain the overall stress of the nozzle plate 8.

Further, the first nozzle layer 1 of the present embodiment is formed with a $SiO_2$ film 2 μm thick, and the second nozzle layer 2 is made of an organic material mainly comprising polyimide resin and formed to be 20 μm thick.

The discharge opening 11$c$ is 3 μm in diameter and formed perpendicular to a film surface so as to extend to the connecting part with the first nozzle hole part 11$d$. The first nozzle hole part 11$d$ is formed to be 4 μm in diameter at the connecting part with the discharge opening 11$c$ and formed substantially perpendicular to the film surface so as to extend to the connecting part with the second nozzle hole 11$b$. The second nozzle hole 11$b$ is formed to be 10 μm in diameter at the connecting part with the first nozzle hole part 11$d$. Also, the second nozzle hole 11$b$ is taper-shaped (i.e. shaped like a truncated cone) and spreads to the bottom, and penetrates the second nozzle layer 2 so as to open at an opening 12 which is opposite to the liquid repellent film 4.

The liquid repellent film 4 is made of a polymeric material having fluoropolymer 0.05 μm thick.

According to the present embodiment, since the discharge layer 14 has a high resistance to etching means which forms the first nozzle hole part 11$d$, it is possible to prevent the change in the shape of the discharge opening 11$c$, which could be possibly caused by the etching of forming the first nozzle hole part 11$d$.

The shape of the discharge opening 11$c$ of the nozzle plate 8, which has a large influence on landing accuracy, is determined by the processing accuracy of the 0.5 μm-thick Pt film. Therefore, the processing accuracy of the discharge opening 11$c$ is very high. This secures extremely high landing accuracy.

Reduction in thickness of the discharge layer 14 increases the processing accuracy of the discharge opening 11$c$, but decreases the rigidity of the discharge layer 14 and hence decreases the structural reliability of the discharge opening 11$c$. However, in the present embodiment, the first nozzle layer 1 is formed so as to be in touch with the discharge layer 14. This reinforces the discharge layer 14 and thus allows improvement in the precision of the shape of the discharge opening 11$c$ without decreasing the structural reliability of the discharge layer 14.

In addition, the first nozzle layer 1 has a high resistance to etching means which forms the second nozzle hole 11$b$. This causes (i) no significant deformation of the first nozzle hole part 11$d$, which is caused by formation of the second nozzle hole 11$b$, and (ii) no complete removal of the first nozzle layer 1, which is caused by excessive etching at the time of forming the second nozzle hole 11$b$.

The material of the discharge layer 14 is not limited to the metal material mainly comprising platinum, either. The material of the discharge layer 14 may be optionally determined on condition that the material is highly resistant to the etching of forming the first nozzle hole 11$a$, and the etching of forming the second nozzle hole 11$b$, the (below-described) etching of the sacrifice layer 5, and the (below-described) etching of the liquid repellent film 4 entering inside the discharge opening 11$c$. In other words, the material is required to be highly resistant to plasma including fluorine, plasma including oxygen, nitric acid, an aqueous solution of potassium hydroxide, or the like. The material can be chosen in combination with the etching of the sacrifice layer 5, a processing method of the first nozzle hole 11$a$, and a processing method of the second nozzle hole 11$b$.

Specific examples of the material of the discharge layer 14 are: a metal material mainly comprising Al, Au, Pt, $Al_2O_3$, AlN, $SiO_2$, and the like; an inorganic oxide material; an inorganic nitride material, or the like.

The material of the first nozzle layer 1 is not limited to $SiO_2$. Alternatively, the material may be (i) a silicon compound material, such as $Si_3N_4$, other than $SiO_2$ or (ii) silicon. Further, the material can be a material mainly comprising aluminum, depending upon the combination with the discharge layer 14 and the second nozzle layer 2.

The material of the second nozzle layer 2 is not limited to polyimide, either. The material may be any material as far as it is a material that is excellently processed by dry etching using oxygen-gas-containing plasma. For example, the material may be an organic resin other than polyimide.

The shape of the discharge layer 14 is not limited to the substantially square shape, on condition that the discharge layer 14 locally locates at the position where the discharge opening 11$c$ is formed. For example, the discharge layer 14 may have a circular shape. The circular shape is preferable because it has the highest isotropy and hence the reduction of the stress is isotropic. As shown in FIG. 15($a$), in the present embodiment, one discharge opening 11$c$ 11 is formed for one discharge layer 14. The present invention is not limited to this arrangement, so that a plurality of discharge openings 11$c$ may be formed for one discharge layer 14.

In the present embodiment, the second nozzle hole 11$b$ is truncated-cone-shaped (taper-shaped) so that the connecting part 11$x$ with the first nozzle hole part 11$d$ is narrowed, but it is not necessary to arrange the second nozzle hole 11$b$ in that way. For example, the second nozzle hole 11$b$ may be straight (cylindrical) so that the side wall of the second nozzle hole 11$b$ is perpendicular to the surface of the nozzle plate 8. With this arrangement, the liquid inflow opening 12 of the second nozzle hole 11$b$ is further reduced in size, and hence the concentration of the nozzles is further increased.

As described above, since the nozzle plate 8 has the discharge layer 14 highly resistant to an etching agent for the first nozzle layer 1, the first nozzle layer 1 highly resistant to an etching agent for the second nozzle layer 2, and the second nozzle layer 2, the shape of the discharge opening 11*c* depends on the processing accuracy of the 0.5 μm-thick discharge layer 14. On this account, the precision of the shape of the discharge opening 11*c* is improved.

No stopper layer is formed, so that the process can be simplified and a stress caused by the stopper layer can be reduced. This allows for easy control of the warpage of the nozzle plate 8 due to the stress.

The rigidity of the nozzle plate 8 is maintained by the second nozzle layer 2. This improves the overall rigidity of the nozzle plate 8, and the handling of the nozzle plate 8 is easy.

Since the discharge layer 14 is made of a material that is highly resistant to etching means of etching the liquid repellent film 4, a part of the liquid repellent film 4 entered inside the first nozzle hole 11*a* is etched away without deformation of the discharge opening 11*c*. This makes it possible to prevent decline in the processing accuracy of the discharge opening 11*c* in the manufacturing process.

(Manufacturing Method of Nozzle Plate)

Figure 16:
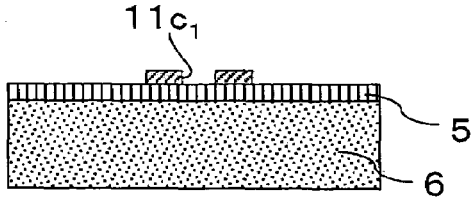
FIGS. 16(*a*)-16(*g*) are cross sections illustrating a manufacturing method of the nozzle plate of Embodiment 4 of the present invention.
Figure 16:
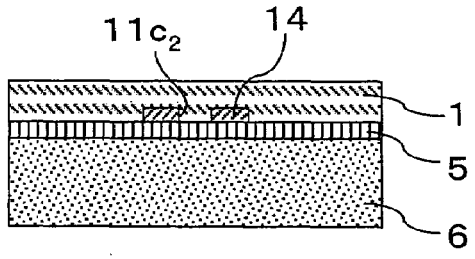
Figure 16:
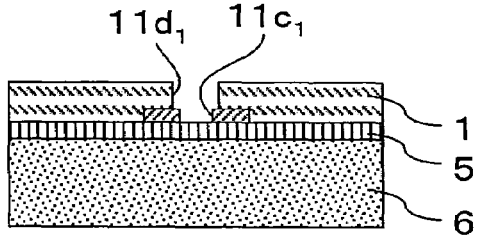
Figure 16:
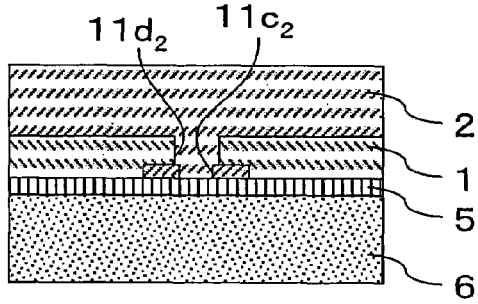
Figure 16:
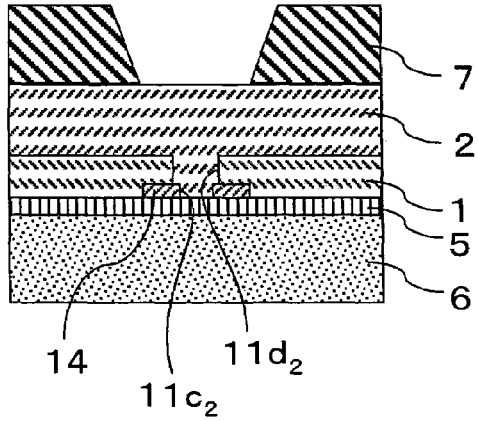
Figure 16:
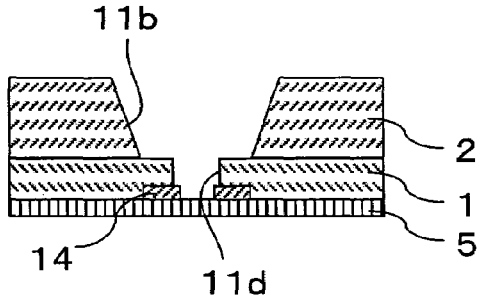
Figure 16:
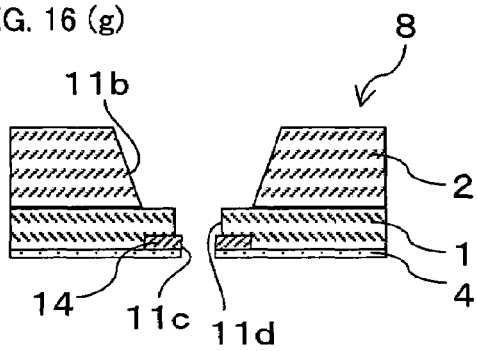

FIGS. 16(*a*)-16(*g*) show the manufacturing steps of the nozzle plate of the present embodiment. The following will describe a manufacturing method of the nozzle plate of the present embodiment.

There is provided the substrate 6 made of Si, glass, and the like, which is used for temporarily maintaining a predetermined thickness, and the sacrifice layer 5 is formed on this substrate 6, by wet plating using Ni. The sacrifice layer 5 is 10 μm thick.

Subsequently, on the sacrifice layer 5, a Pt film is formed so as to be 0.5 μm thick by vapor deposition or the like method. By means of photolithography, formed are resist patterns of (i) the outer shape of the discharge layer 14 and (ii) the shape of the discharge opening 11*c*. Thereafter, the outer shape of the discharge layer 14 and an opening 11$c_1$ that is the discharge opening 11*c* are concurrently processed by dry etching (discharge layer forming step; FIG. 16(*a*)).

The Pt film is a chemically relatively inactive material, so that the dry etching in the present embodiment is sputter etching using argon and is a method in which physical processing is dominantly carried out. Further, such a processing is carried out with extremely high accuracy. For this reason, highly-anisotropic etching condition is adopted.

Next, the first nozzle layer 1 made of $SiO_2$ film is formed on the sacrifice layer 5 or the discharge layer 14 by the P-CVD method (first nozzle layer forming step; FIG. 16(*b*)).

The P-CVD method allows for controlling stress of the $SiO_2$ film to be formed by the composition of gas used in the film formation, gas pressure, and RF power for producing plasma. Also, the P-CVD method realizes an excellent filming around an uneven part of the discharge layer 14, thus causing no cracks in the uneven part of the discharge layer 14. This improves the structural reliability of the film, thus improving the overall structural reliability of the nozzle plate 8.

Next, resist patterns are formed on the first nozzle layer 1 by means of photolithography, and (i) an opening 11$d_1$ that is the first nozzle hole part 11*d* and (ii) the opening 11$c_1$ that is the discharge opening 11*c* are processed by reactive ion etching (RIE) containing fluorine gas (first nozzle hole part forming step, first removal step; FIG. 16(*c*)).

The shape of the opening 11$d_1$ is processed so as to be larger than the opening 11$c_1$ (and smaller than the outer shape of the discharge layer 14) so that the etching for forming the first nozzle hole part 11*d* stops at the discharge layer 14.

In the foregoing etching method, since fluorine having been activated by plasma selectively reacts with atoms of silicon, $SiO_2$ is etched at an extremely high speed. On the contrary, as previously described, since platinum is chemically stable material, platinum hardly reacts with the activated fluorine. Therefore, platinum is etched at a low speed. This makes it possible to stop this etching with good accuracy at the boundary between the discharge layer 14 and the first nozzle layer 1.

Subsequently, polyimide resin is applied to the first nozzle layer 1 so that the second nozzle layer 2 is formed to be 20 μm thick (second nozzle layer forming step; FIG. 16(*d*)).

The polyimide resin is applied to the first nozzle layer 1 by spin coating, and is baked for 2 hours at 350° C. Now, the opening 11$d_1$ and the opening 11$c_1$ are stuffed by the polyimide resin (See 11$c_2$ and 11$d_2$).

Then, on the second nozzle layer 2, a resist pattern 7 is formed by photolithography (FIG. 16(*e*)).

Subsequently, dry etching is performed using a gas mainly comprising oxygen, and the tapered (truncated-cone-shaped) second nozzle hole 11*b* is formed in the second nozzle layer 2 (second nozzle hole forming step; FIG. 16(*f*)). Thereafter, (i) the etching for processing the first nozzle layer 1 to form the first nozzle hole pate 11*d* and (ii) the etching for processing the discharge layer 14 to form the discharge opening 11*c* are carried out (first nozzle hole part forming step, first removal step; see FIG. 16(*f*)).

Note that in the present embodiment, the first nozzle hole part 11*d* and the discharge opening 11*c* are continuously formed, and etching does not go beyond the discharge layer 14 (The dry etching stops at a portion where the discharge layer 14 is exposed, except at the discharge opening 11*c* of the discharge layer 14.). However, the present invention is not limited to this arrangement. Alternatively, the following arrange can be adopted: The aforesaid etching is intentionally stopped at the first nozzle layer 1, and the formation of the discharge opening 11*c* (etching a portion 11$c_2$ stuffed by the first nozzle layer 1) is carried out in another etching step (by another etching method or under another etching condition).

The step of processing the second nozzle hole 11*b* in a tapered manner is the same as that described in the foregoing embodiments. Therefore, the explanation thereof is omitted here.

In this process, the first nozzle hole 11*a* is reproduced by removal of the polyimide resin from the portion which is stuffed by the polyimide resin in the previous step). Also, as to the discharge opening 11*c*, the material (see 11$c_2$) of the second nozzle layer 2 stuffing the opening 11$c_1$ of the discharge layer 14 is removed. This reproduces the previous shape of the portion 11*c* which has been stuffed by the polyimide resin in the previous step.

Subsequently, the resist pattern 7 is removed by a resist peeling liquid.

Then, only the sacrifice layer 5 is etched away by dipping into an aqueous solution mainly made of nitric acid and water. As a result, a laminated structure as the nozzle plate 8 is detached from the substrate 6 (FIG. 16(*f*)).

As described previously, $SiO_2$ of which the first nozzle layer 1 is made, the polyimide resin of which the second nozzle layer 2 is made, and platinum of which the discharge layer 14 is made are hardly etched by the etching liquid for the sacrifice layer 5. For this reason, the etching of the sacrifice layer 5 does not change the shape of the nozzle hole 11 and does not decrease the structural reliability of the nozzle plate 8.

Then, the liquid repellent film 4 is formed on the surface of the first nozzle layer 1 (FIG. 16(*g*)).

In this process, fluoropolymer is used in consideration of the easiness of the application. The fluoropolymer is applied to the surface of the first nozzle layer 1 by stamping or the like, and as a result the liquid repellent film 4 which is a polymer film is formed. As to the liquid repellent film 4 entered inside the first nozzle hole 11*a*, such liquid repellent film 4 is removed after the formation of the liquid repellent film 4, by performing dry etching using plasma containing oxygen from the second nozzle hole 11*b* side, which completes the nozzle plate 8. This makes it possible to minimize the damage of the nozzle plate 8.

In the present embodiment, the liquid repellent film 4 entered inside the first nozzle hole 11*a* is etched away by dry etching using oxygen-containing plasma. As described previously, in the present embodiment, the discharge layer 14 highly resistant to the dry etching using oxygen-containing plasma exists on the liquid substance discharging side. Also, the discharge layer 14 determines the shape of the discharge opening 11*c*. Therefore, the aforesaid dry etching never changes the shape of the discharge opening 1*c*. Thus, it is possible to form the nozzle hole 11 with extremely highly precision.

As a result of an evaluation of the shape of each of 200 discharge openings 11*c* of the nozzle plate 8 made though the manufacturing steps of the present embodiment, the variation in the shape was very low (±0.15 μm), i.e. the discharge openings 11*c* were highly precisely formed. Also, the nozzle plate 8 was very flat, as the warpage was not more than 10 μm.

In the present embodiment, the sacrifice layer 5 is made of nickel, the discharge layer 14 is made of platinum, the first nozzle layer 1 is made of $SiO_2$, and the second nozzle layer 2 is made of polyimide resin, but the combination of the materials is not limited to the above.

Apart from nickel, the material of the sacrifice layer 5 may be chosen from the followings, in consideration of the materials of the discharge layer 14 and the first and second nozzle layers 1 and 2: (i) copper nitrate or aluminum nitrate, or (ii) a material soluble in a KOH aqueous solution.

Also, apart from the plating, the method for forming the sacrifice layer 5 may be vapor deposition, sputtering, coating, or the like, in consideration of the materials.

The material of the second nozzle layer 2 is required to be rarely damaged by the etching of the sacrifice layer 5. However, in consideration with the below-mentioned etching selectivity with the first nozzle layer 1 or the discharge layer 14, the material of the second nozzle layer 2 is preferably an organic resin which is able to be subjected to etching using oxygen-containing plasma. Additionally, the use of an organic resin having a molecular structure in which crosslinking reaction occurs between molecular chains allows the second nozzle layer 2 to have a high heat resistance and a high environmental resistance. This improves reliability of the nozzle plate 8.

Each of the discharge layer 14 and the first nozzle layer 1 is required to be made of a material highly resistant to the etching of the sacrifice layer 5 and the etching of the second nozzle hole 11*b*.

Further, the discharge layer 14 is required to be made of a material highly resistant to the etching of the sacrifice layer 5, the etching of the second nozzle hole 11*b*, and the etching of the first nozzle hole 11*a*.

Table. 4 shows preferable combinations of the materials (of the sacrifice layer, discharge layer, first nozzle layer, and second nozzle layer) and the methods (for forming the discharge layer, first nozzle hole, and second nozzle hole, and for removing the sacrifice layer).

TABLE 4

| LAYERS | | | |
|---|---|---|---|
| SACRIFICE LAYER | DISCHARGE LAYER | FIRST NOZZLE LAYER | SECOND NOZZLE LAYER |
| Ni, Cu, Al, | Au, Pt, $Al_2O_3$, AlN | $SiO_2$, $Si_3N_4$ | PI, RESIST |
| Cu | Al, Au, Pt, $Al_2O_3$, AlN | $SiO_2$, $Si_3N_4$ | PI, RESIST |
| Cu | $SiO_2$ | Al | PI, RESIST |

| METHODS | | | |
|---|---|---|---|
| DISCHARGE LAYER | FIRST NOZZLE HOLE | SECOND NOZZLE HOLE | SACRIFICE LAYER |
| Ar DRY ETCHING | CF4 DRY ETCHING | O2 DRY ETCHING | DILUTE NITRIC ACID |
| Ar DRY ETCHING | CF4 DRY ETCHING | O2 DRY ETCHING | CONCENTRATED NITRIC ACID |
| CF4 DRY ETCHING | Cl DRY ETCHING | O2 DRY ETCHING | CONCENTRATED NITRIC ACID |

As shown in Table. 4, the material of the first nozzle layer 1 is not limited to a silicon compound such as $SiO_2$. In the case where concentrated nitric acid is used for the etching of the sacrifice layer 5, the material of the first nozzle layer 1 can be a material, such as aluminum, which passivates on its surface. Aluminum can be subjected to processing at a high selection ratio to $SiO_2$ by dry etching using Cl-gas-containing plasma. Therefore, it is possible to further improve the processing accuracy of the discharge opening 11*c*.

The liquid repellent film 4 is not necessarily made of fluoropolymer. The material of the film 4 may be silicon polymer film, DLC (Diamond-Like Carbon), or the like.

With the above-mentioned manufacturing process, the thin discharge layer 14 is processed so that the discharge opening 11*c* (opening $11c_1$) is formed. This makes it possible to manufacture the nozzle plate 8 having the discharge opening 11*c* whose precision of the shape is dramatically high.

Further, in the final step of the manufacturing process of the nozzle plate 8, the liquid repellent film 4 entering inside the first nozzle hole 11*a* is removed. Additionally, no change in the shape of the discharge opening 11*c* occurs in this step. This makes it possible to stably manufacture the nozzle plate 8 having a high precision of the shape of the discharge opening 11*c*.

No stopper layer (blocking layer) is formed, so that the process can be simplified and a stress caused by the stopper layer (blocking layer) can be reduced. This allows for easy control of the warpage of the nozzle plate 8 due to the stress.

According to the manufacturing method of the aforesaid nozzle plate 8, the first nozzle hole 1*a* or the second nozzle hole 11*b* is processed by highly-anisotropic etching. It is therefore possible to process the first nozzle hole 11*a* or the second nozzle hole 11*b*, with a high processing accuracy.

In the manufacturing method of the nozzle plate 8 of the above-described embodiments, the discharge opening 11*c*, the first nozzle hole 11*a*, or the second nozzle hole 11*b* is formed by dry etching.

Further, in the manufacturing method of the nozzle plate 8 of the present invention, it is preferable that after the discharge layer 14 or the first nozzle layer 1 is formed on the sacrifice layer 5 which is formed on the substrate 6, and the first nozzle hole 11*a* and the second nozzle hole 11*b* are processed, the sacrifice layer 5 is etched so that the nozzle plate 8 is detached from the substrate 6.

In such a manner, the discharge layer 14 having the discharge opening 11*c* required to have a high precision of the shape is protected by the sacrifice layer 5 and the substrate 6 until the final step of the nozzle manufacturing process. Because of this, the discharge opening 11*c* suffers no damage during the treatments in the manufacturing process. This makes it possible to easily manufacture the nozzle plate 8 while maintaining the discharge opening 11*c* with a high precision of the shape. Thus, it is possible to stably manufacture the nozzle plate 8 having the discharge opening 11*c* with a high precession and to improve the yields of the nozzle plate 8 in its manufacture.

In the Embodiments 3 and 4, the arrangement in which the liquid repellent film 4 is not formed may be adopted. The arrangement in which the liquid repellent film 4 is not formed on the discharge layer 14 or the first nozzle layer 1, further improves the precision of the shape of the discharge opening 11*c*.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention relates to an electrophotographic developing device and an image forming apparatus both of which develops an electrostatic latent image formed on an image carrier by using a developing agent. Particularly, the present invention can be used in applications such as a developing device and an image forming apparatus both of which carries the developing agent to a development position on the image carrier by using traveling-wave electric field.

The invention claimed is:

1. A nozzle plate, comprising:

a first nozzle layer having a first nozzle hole through which a liquid substance is discharged;

a second nozzle layer having a second nozzle hole that is connected to the first nozzle hole and receives the liquid substance; and a discharge layer that has an opening and has a higher resistance to etching than the first nozzle layer, the discharge layer being provided on a liquid substance discharging side in a liquid substance flow direction of the first nozzle layer, the opening determining a diameter of a discharge opening of the liquid substance discharge side, and the first nozzle hole penetrating the first nozzle layer and being connected with the opening, wherein the first nozzle layer has an outer surface, an inner surface and an intermediate surface, the outer surface being a surface facing the liquid substance discharge side, the inner surface being a surface facing the second nozzle layer, and the intermediate surface being a base surface of a concave section for locating the discharge layer formed on the outer surface;

wherein the discharge layer is made of a metal, an inorganic oxide or an inorganic nitride, the discharge layer is located on the intermediate surface of the first nozzle layer, and the discharge layer has a discharging surface facing the liquid substance discharge side, and wherein the discharging surface of the discharge layer is flush with the outer surface of the first nozzle layer.

2. The nozzle plate as defined in claim 1, wherein, the discharge layer is formed in the first nozzle layer.

3. The nozzle plate as defined in claim 1, wherein, the discharge layer is predominantly made of an inorganic material.

4. The nozzle plate as defined in claim 1, wherein, the discharge layer is locally formed around the opening.

5. The nozzle plate as defined in claim 1, wherein, between the first nozzle layer and the second nozzle layer, a blocking layer which has a higher resistance to etching than the first nozzle layer is locally formed, and the first nozzle hole penetrates the blocking layer and is connected to the second nozzle hole.

6. The nozzle plate as defined in claim 5, wherein, the first nozzle layer is made of organic resin, and the discharge layer is made of a material that mainly includes at least one of Ti, Al, Au, Pt, Ta, W, Nb, $SiO_2$, $Al_2O_3$, $Si_3N_4$, and AlN.

7. The nozzle plate as defined in claim 5, wherein, the first nozzle layer is made of a material mainly including at least one of Si, $SiO_2$, and $Si_3N_4$, and the discharge layer is made of a material mainly including at least one of Al, Ni, Fe, Co, Cu, Au, Pt, aluminum oxide, and aluminum nitride.

8. The nozzle plate as defined in claim 5, wherein, the blocking layer has a higher resistance to etching than the second nozzle layer, and an outer shape of the blocking layer is larger than an outer shape of the second nozzle hole at a connecting part at which the first nozzle hole is connected to the second nozzle hole.

9. The nozzle plate as defined in claim 1, wherein, the first nozzle layer has a higher resistance to etching than the second nozzle layer.

10. The nozzle plate as defined in claim 1, wherein, a first nozzle hole part that penetrates the first nozzle layer is taper-shaped so that a connecting part at which the first nozzle hole part contacts the opening is narrow.

11. The nozzle plate as defined in claim 1, wherein, the second nozzle hole is taper-shaped so that a connecting part where the second nozzle hole contacts the first nozzle hole is narrow.

12. The nozzle plate as defined in claim 1, wherein, a liquid repellent film is formed at least on a liquid substance discharge side of the discharge layer.

13. The nozzle plate as defined in claim 12, wherein the discharge layer is made of a material that is resistant to etching means of etching the liquid repellant film.

14. The nozzle plate as defined in claim 1, wherein the discharge layer is made of a material mainly including at least one of Al, Pt, Au, $Al_2O_3$, and AlN, the first nozzle layer is made of a silicon compound, and the second nozzle layer is made of organic resin.

15. The nozzle plate as defined in claim 1, wherein, the discharge layer is made of a silicon compound, the first nozzle layer is made of a metal material mainly comprising aluminum, and the second nozzle layer is made of organic resin.

16. The nozzle plate as defined in claim 1, wherein the etching is dry etching.

17. The nozzle plate as defined in claim 16, wherein the etching is dry etching using plasma.

18. The nozzle plate as defined in claim 17, wherein the etching is dry etching using oxygen-containing plasma.

19. The nozzle plate as defined in claim 1, wherein the first nozzle hole is cylindrical and the second nozzle hole is taper-shaped so that a connecting part where the second nozzle hole contacts the first nozzle hole is narrow.

20. The nozzle plate as defined in claim 19, wherein the discharge opening is cylindrical.

21. The nozzle plate as defined in claim 20, wherein the first nozzle layer has a first nozzle hole part which is cylindrical and which penetrates the first nozzle layer, and the discharge opening is concentric to the first nozzle hole part, the diameter of the discharge opening being smaller than the diameter of the first nozzle hole part.

22. The nozzle plate as defined in claim 21, wherein a surface of the discharge layer facing the liquid substance discharge side is flush with a surface of the first nozzle layer facing the liquid substance discharge side.

23. The nozzle plate as defined in claim 22, wherein the nozzle hole part has an upper base that is substantially circular around the discharge opening, and the discharge layer is exposed as the upper base.

24. The nozzle plate as defined in claim 23, wherein the discharge layer is formed in the first nozzle layer.

25. The nozzle plate as defined in claim 24, wherein a liquid repellant film is formed at least on the surface of the discharge layer facing the liquid substance discharge side.

26. The nozzle plate as defined in claim 25, wherein the liquid repellant film is formed on both the surface of the discharge layer facing the liquid substance discharge side and the surface of the first nozzle layer facing the liquid substance discharge side.

27. The nozzle plate as defined in claim 1, wherein the discharge layer is made of a material mainly including at least one of Al, Au, Pt, $Al_2O_3$, and AlN.

28. The nozzle plate as defined in claim 1, wherein the first nozzle layer is made of silicon, a silica or a silicon compound.

29. The nozzle plate as defined in claim 1, wherein the discharge layer is square.

* * * * *